US009665038B2

(12) United States Patent
Kubo et al.

(10) Patent No.: US 9,665,038 B2
(45) Date of Patent: May 30, 2017

(54) DEVELOPING DEVICE HAVING A DEVELOPER CARRYING MEMBER WITH RECESSED PORTIONS

(71) Applicant: CANON KABUSHIKI KAISHA, Tokyo (JP)

(72) Inventors: Kenta Kubo, Kamakura (JP); Shunichi Takada, Soka (JP); Koichi Hashimoto, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/940,408

(22) Filed: Nov. 13, 2015

(65) Prior Publication Data

US 2016/0139539 A1 May 19, 2016

(30) Foreign Application Priority Data

Nov. 17, 2014 (JP) ..... 2014-233149

(51) Int. Cl.
*G03G 15/08* (2006.01)
*G03G 15/09* (2006.01)
*G03G 15/095* (2006.01)

(52) U.S. Cl.
CPC ..... *G03G 15/0818* (2013.01); *G03G 15/081* (2013.01); *G03G 15/0815* (2013.01);
(Continued)

(58) Field of Classification Search
CPC ..... G03G 15/0877; G03G 15/0806; G03G 15/0818; G03G 15/0921; G03G 15/0928; G03G 15/081
(Continued)

(56) References Cited

U.S. PATENT DOCUMENTS 5,799,234 A 8/1998 Furuya et al.
9,104,142 B2 8/2015 Kubo et al.
(Continued)

FOREIGN PATENT DOCUMENTS

EP 1 162 516 A2 12/2001
EP 2 743 776 A2 6/2014
(Continued)

OTHER PUBLICATIONS

European Search Report dated Mar. 16, 2016, in corresponding European Patent Application No. 15192888.4.

*Primary Examiner* — Robert Beatty
(74) *Attorney, Agent, or Firm* — Fitzpatrick, Cella, Harper & Scinto

(57) ABSTRACT

A developing device includes a developing container, a feeding member, a developer carrying member, and a collecting device. A coverage which is a percentage of coating of surfaces of the carrier particles with the toner particles is 100% or more and 200% or less. The developer carrying member has a plurality of recessed portions formed on a surface thereof so that at least the toner particles having an average particle size are contactable with inner surfaces of the recessed portions, and the carrier particles having an average particle size are not contactable with the inner surfaces of the recessed portions. The recessed portions are formed so that not less than half of the toner particles having the average particle size are exposed from the recessed portions when the toner particles having the average particle size enter the recessed portions.

14 Claims, 39 Drawing Sheets

(52) U.S. Cl.
CPC ..... *G03G 15/095* (2013.01); *G03G 15/0928* (2013.01); *G03G 2215/0609* (2013.01)

(58) Field of Classification Search
USPC ..... 399/274, 282, 276, 277, 279, 288
See application file for complete search history.

(56) References Cited

U.S. PATENT DOCUMENTS

| | | | | |
|---|---|---|---|---|
| 2008/0279592 | A1* | 11/2008 | Matsumoto ..... | G03G 15/0855 399/259 |
| 2010/0158578 | A1 | 6/2010 | Kojima et al. | |
| 2014/0161493 | A1* | 6/2014 | Kubo ..... | G03G 15/0818 399/272 |
| 2015/0227077 | A1 | 8/2015 | Kubo et al. | |
| 2015/0227078 | A1 | 8/2015 | Kubo et al. | |
| 2015/0227087 | A1 | 8/2015 | Kubo et al. | |

FOREIGN PATENT DOCUMENTS

| | | | |
|---|---|---|---|
| EP | 2 940 529 | A1 | 4/2015 |
| JP | H06-236113 | A | 8/1994 |
| JP | H08-137243 | A | 5/1996 |
| JP | 10312105 | A * | 11/1998 |
| JP | 2003-167441 | A | 6/2003 |
| JP | 2004-157458 | A | 6/2004 |
| JP | 2007-108350 | A | 4/2007 |
| JP | 2014-115518 | A | 6/2015 |

* cited by examiner (b)

(a)

(b)

(a)

(b)

(a)

(a)

(b)

DEVELOPING DEVICE HAVING A DEVELOPER CARRYING MEMBER WITH RECESSED PORTIONS

FIELD OF THE INVENTION AND RELATED ART

The present invention relates to a developing device in which an electrostatic latent image formed on an image bearing member by an electrophotographic process, an electrostatic recording process or the like is developed to form a visible image.

As a dry development type applied to the electrophotographic process, a one-component development type using only toner particles and a two-component development type using a developer consisting of toner particles and carrier particles have been known. In a developing device of such a one-component development type, for example, the toner is carried on a surface of a developing roller as a developer carrying member by a toner supplying roller formed of a foam material and then the electrostatic latent image on the image bearing member is developed with the toner. The toner remaining on the developing roller surface after the development is peeled off by the toner supplying roller.

As the developing device having such a constitution, also a structure in which the surface of the developing roller is provided with a plurality of recessed portions and a uniform toner is carried on the surface of the developing roller has been proposed (Japanese Laid-Open Patent Application (JP-A) 2007-108350).

In the case of a developing device of the one-component development type as disclosed in JP-A 2007-108350, there is a possibility that improper replacement of the toner on the developing roller generates. That is, the toner remaining on the developing roller after the development is peeled off by the toner supplying roller. At this time, a fresh (new) toner is supplied from a toner supplying member (roller) to the developing roller, so that the residual toner on the developing roller is replaced (substituted) with the fresh toner. However, in the case of the constitution in which the developing roller is provided with the plurality of recessed portions as described above, the residual toner in the recessed portions is not readily peeled off by the toner supplying roller. This is because the toner supplying member (roller) cannot sufficiently contact the residual toner coated in the recessed portions and thus a force necessary to peel off the toner is not readily applied to the toner.

On the other hand, it would be considered that a surface layer shape of the toner supplying roller is devised to improve a contact property with the residual toner in the recessed portions and thus the toner is easily peeled off. However, due to a lowering in rigidity and durability with the device of the surface layer of the toner supplying roller, it is difficult to realize and continue a desired peeling-off property. Even if the toner peeling-off property can be enhanced, in order to supply the new toner to an associated space with reliability, there is a limitation in toner supply amount by the toner supplying roller, and therefore it is difficult to ensure a desired toner supply amount.

For the reason described above, in the case of the developing device disclosed in JP-A 2007-108350, improper replacement of the toner is liable to generate. When such an improper replacement of the toner generates, the same toner is liable to remain on the developing roller, so that a ghost image generated due to a difference in characteristic between new and old toners and a lowering in image quality due to filming or the like of the developing roller are liable to be caused.

In view of these circumstances, the present invention has been accomplished in order to realize a constitution in which replacement of the toner carried on a developer carrying member is satisfactorily made in a state in which the surface of the developer carrying member is provided with the plurality of the recessed portions.

SUMMARY OF THE INVENTION

According to an aspect of the present invention, there is provided a developing device comprising: a developing container for accommodating a developer containing non magnetic toner particles and magnetic carrier particles; a feeding member for feeding the developer in the developing container; a developer carrying member, provided opposed to an image bearing member for bearing an electrostatic latent image, for carrying and feeding the developer fed to a surface thereof by the feeding member; and a collecting device for collecting a part of the developer carried on the developer carrying member, wherein the collecting device is provided upstream of a developing portion where the developer carrying member opposes the image bearing member and downstream of a supplying portion where the developer fed by the feeding member is supplied to the developer carrying member with respect to a developer feeding direction of the developer carrying member, and the collecting device is disposed opposed to the developer carrying member, wherein a coverage which is a percentage of coating of surfaces of the carrier particles with the toner particles is 100% or more and 200% or less, wherein the developer carrying member has a plurality of recessed portions formed on a surface thereof so that at least the toner particles having an average particle size are contactable with inner surfaces of the recessed portions and the carrier particles having an average particle size are not contactable with the inner surfaces of the recessed portions, and wherein, the recessed portions are formed so that not less than half of the toner particles having the average particle size are exposed from the recessed portions when the toner particles having the average particle size enter the recessed portions.

These and other objects, features and advantages of the present invention will become more apparent upon a consideration of the following description of the preferred embodiments of the present invention taken in conjunction with the accompanying drawings.

DESCRIPTION OF THE EMBODIMENTS

<First Embodiment>

Figure 1:
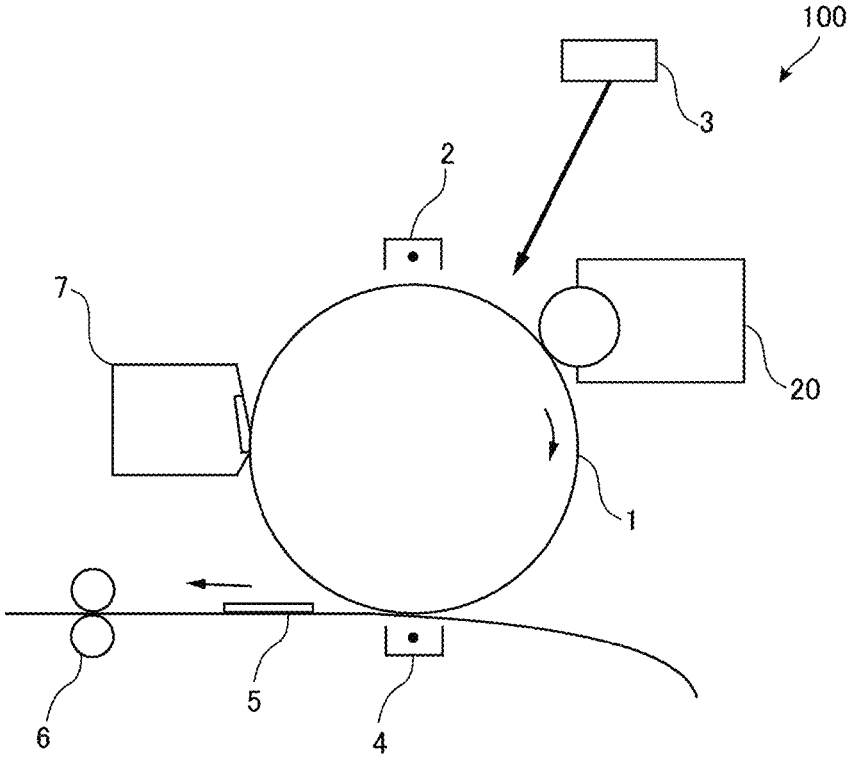
FIG. 1 is a schematic illustration of an image forming apparatus in a first Embodiment of the present invention.

First Embodiment of the present invention will be described using FIGS. 1 to 22. Incidentally, with respect to dimensions, materials, shapes and relative arrangement of constituent elements described in this embodiment, the scope of the present invention is not intended to be limited thereto only. First, a general structure of a developing device according to this embodiment will be described using FIG. 1.

[Image Forming Apparatus]

An image forming apparatus 100 in this embodiment is of an electrophotographic type, and includes a photosensitive drum 1 as an image bearing member. The photosensitive drum 1 is a drum shaped photosensitive member constituted by applying a photoconductive layer onto an electroconductive substrate, and is rotatably provided on an unshown frame. The photosensitive drum 1 is rotationally driven in an arrow direction in FIG. 1 by an unshown driving means (such as a motor), and the surface thereof is electrically charged uniformly by a charger 2 as a charging means. Then, the surface of the photosensitive drum 1 is exposed to, e.g., laser light as an exposure means depending on image information by a light emitting element (laser scanner) 3 emitting the laser light, so that an electrostatic latent image is formed on the surface of the photosensitive drum 1. The electrostatic latent image on the photosensitive drum 1 is developed and visualized as a toner image by a developing device 20. Then, the toner image on the photosensitive drum 1 is transferred onto a recording material 5 by a transfer charger 4 as a transfer means, and is fixed on the recording material 5 by a fixing device 6. The recording material 5 is a sheet material such as a sheet or an OHP sheet. Transfer residual toner particles (toner) remaining on the photosensitive drum 1 after the transfer is removed by a cleaning device 7. In this embodiment, the image bearing member is the photosensitive drum including a drum shaped base layer and a photosensitive layer formed on the base layer, but may also be a belt shaped photosensitive belt.

[Developing Device]

Figure 2:
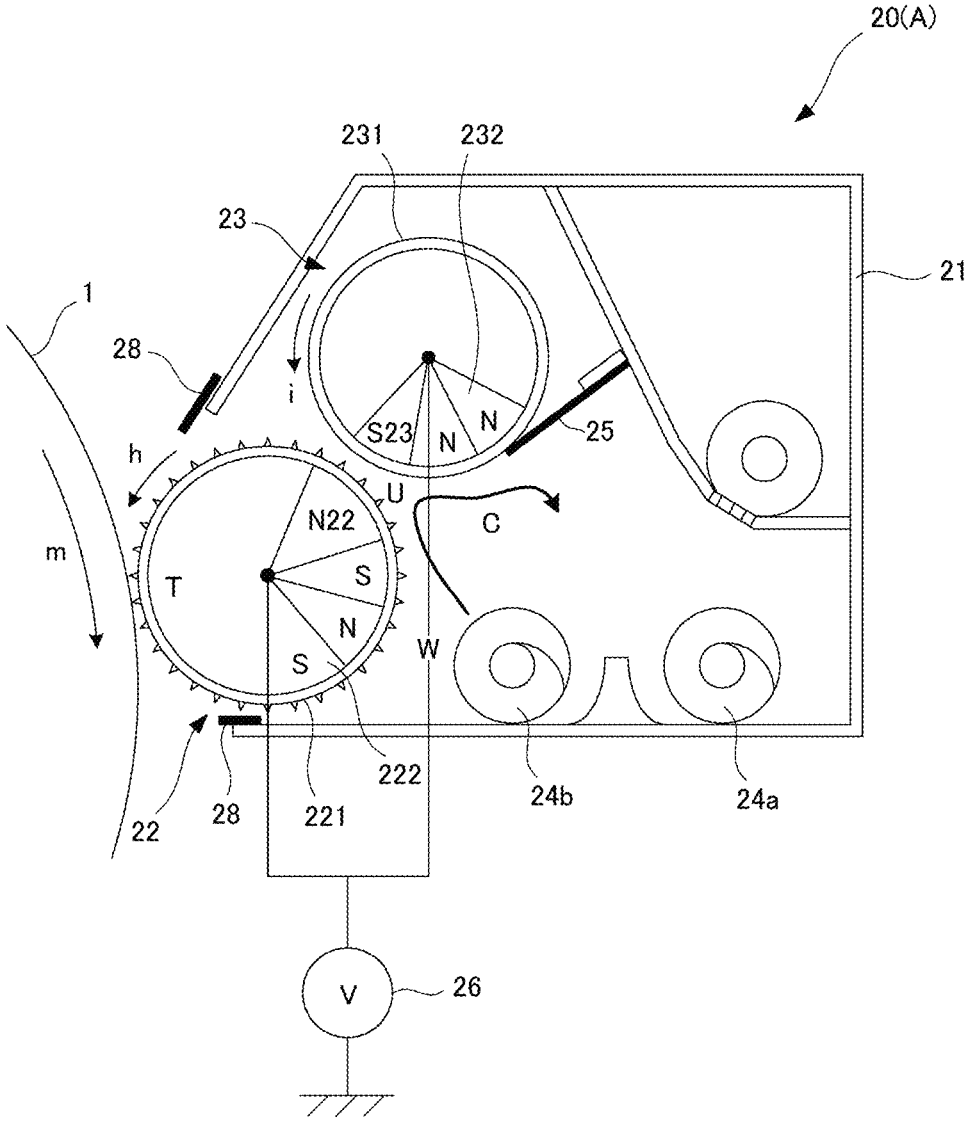
FIG. 2 is a schematic illustration according to the first Embodiment.

The developing device 20 in this embodiment will be described. First, a general structure of the developing device 20 will be described using FIG. 2. As shown in FIG. 2, the developing device 20 includes a developing container 21 for accommodating a developer containing non-magnetic toner particles (toner) and magnetic carrier particles (carrier). As for the developer, in this embodiment, a two-component development type is used as a development type, and the non-magnetic toner and the magnetic carrier are mixed and used as the developer. The non-magnetic toner is constituted by incorporating a colorant, a wax component and the like into a resin material such as polyester or styrene-acrylic resin, and is formed in powder by pulverization or polymerization. The magnetic carrier is prepared by subjecting a surface layer of a core material consisting of ferrite particles or resin particles in which magnetic powder is kneaded to resin material coating.

In this embodiment, the non-magnetic toner is a positive-polarity toner which is manufactured by a polymerization method and which is 7.8 μm in number-average particle size (D40) rt and 0.97 in average circularity. The average circularity may preferably be 0.95 or more in order to sufficiently replace easily the toner in the recessed portion with a fresh toner. As the magnetic carrier, a standard carrier P-02 (manufactured by the Imaging Society of Japan) of 90 μm in number-average particle size rc was used. Measuring methods of the number-average particle sizes of the toner and the carrier and the average circularity of the toner will be described later. The two-component developer was obtained by mixing the toner with the carrier so that a ratio of a toner weight to an entire weight of the developer (hereinafter referred to as a TD ratio q) was 10%.

The developing container 21 is open at a portion (opening) opposing the photosensitive drum 1, and at this opening, a cylindrical developing roller 22 as a developer carrying member is rotatably supported. The developing roller 22 is rotationally driven in an arrow h direction in FIG. 2 by an unshown driving means. The surface of the developing roller 22 is provided with a plurality of recessed portions 221 formed as described later. Inside the developing roller 22, a developing magnet (permanent magnet) 222 has a plurality of magnetic poles which are fixedly provided. The developing roller 22 is provided in contact with the photosensitive drum 1. In the present invention, the developer carrying member and the image bearing member may be in contact with or in non contact with each other, but in this embodiment, the developing roller 22 as the developer carrying member is disposed so as to contact the photosensitive drum 1 as the image bearing member. Further, the developing roller 22 is provided rotatably in the same direction h as the rotational direction m of the photosensitive drum 1 at a developing portion T where the developing roller opposes the photosensitive drum 1 and the toner carried and fed on the developing roller 22 is transferred onto the photosensitive drum 1. At the opening of the developing container 21, a scattering suppressing sheet 28 for suppressing scattering of the developer to the outside of the developing container 21 is provided.

The developing container 21 is provided with feeding members 24*a*, 24*b* such as screws as a feeding means for feeding the developer in the developing container 21. The developer supplied into the developing container 21 and the developer collected by a developer collecting device 23 described subsequently are fed to the neighborhood of the developing roller 22 while being stirred by the feeding members 24*a*, 24*b*. In this feeding process, the toner and the carrier are charged to different polarities, respectively. The fed developer is carried on the developing roller 22 by a magnetic force of the developing magnet 222 disposed in the developing roller 22 at a supplying portion W. That is, the magnetic carrier is attracted to and carried on the developing roller 22 by the magnetic force of the developing magnet 222. At this time, on the surface of the carrier, the toner charged to the different (opposite) polarity is electrostatically deposited, and therefore the toner and the carrier are carried on the surface of the developing roller 22. Accordingly, the developer containing the toner and the carrier fed by the feeding members 24*a*, 24*b* is supplied to the developing roller 22 at the supplying portion W.

Inside the developing container 21, the developer collecting device 23 as a collecting means for collecting a part of the developer carried on the developing roller 22 is disposed. The developer collecting device 23 is disposed upstream of the developing portion T and downstream of the supplying portion W with respect to a developer feeding direction (rotational direction h) of the developing roller 22 so as to oppose the developing roller 22 with a gap (spacing) with the developing roller 22. The developer collecting device 23 includes a collecting roller 231 rotatably supported by the developing container 21 and a collecting magnet (permanent magnet) which are fixedly provided inside the collecting roller 231 and which has a plurality of magnetic poles. The collecting roller 231 is rotationally driven by an unshown driving means so as to move in an opposite direction to the rotational direction of the developing roller 22 at a collecting portion U where the collecting roller 231 opposes the developing roller 22. The collecting roller 231, the developing roller 22 and the feeding members 24*a*, 24*b* and driven by distributing a driving force from a single driving motor as a driving means by a gear train. However, each or some of these members may also be driven by a separate driving motor.

The developer collecting device 23 constituted as described above collects a part of the developer carried on the developing roller 22 by the magnetic force by forming a magnetic field by a cooperation between the developing magnet 222 disposed in the developing roller 22 and the collecting magnet 232 disposed therein. Specifically, by a magnet field formed by N22 pole of the developing magnet 222 and S23 pole of the collecting magnet 232, a part of the developer is carried on the surface of the collecting roller 231. At this time, the developer collecting device 23 is positioned downstream of the supplying portion W and upstream of the developing portion T with respect to the rotational direction of the developing roller 22, and therefore a part of the developer supplied to the developing roller 22 is collected before being fed to the developing portion T.

The developer carried on the developer collecting device 231 is moved in an arrow i direction and is peeled off from the developer collecting device 231 by a repelling magnetic field of two N poles (repelling poles), and thus is fed into a developer feeding path by the feeding members 24*a*, 24*b*. Incidentally, a collecting blade 25 is provided in contact with or closely to the surface of the collecting roller 231 so as to oppose the repelling poles (N poles), so that the developer on the collecting roller 231 is peeled off also by the collecting blade 25 and thus is fed to the feeding path.

[Structure of Recessed Portions of Developing Roller]

Figure 3:
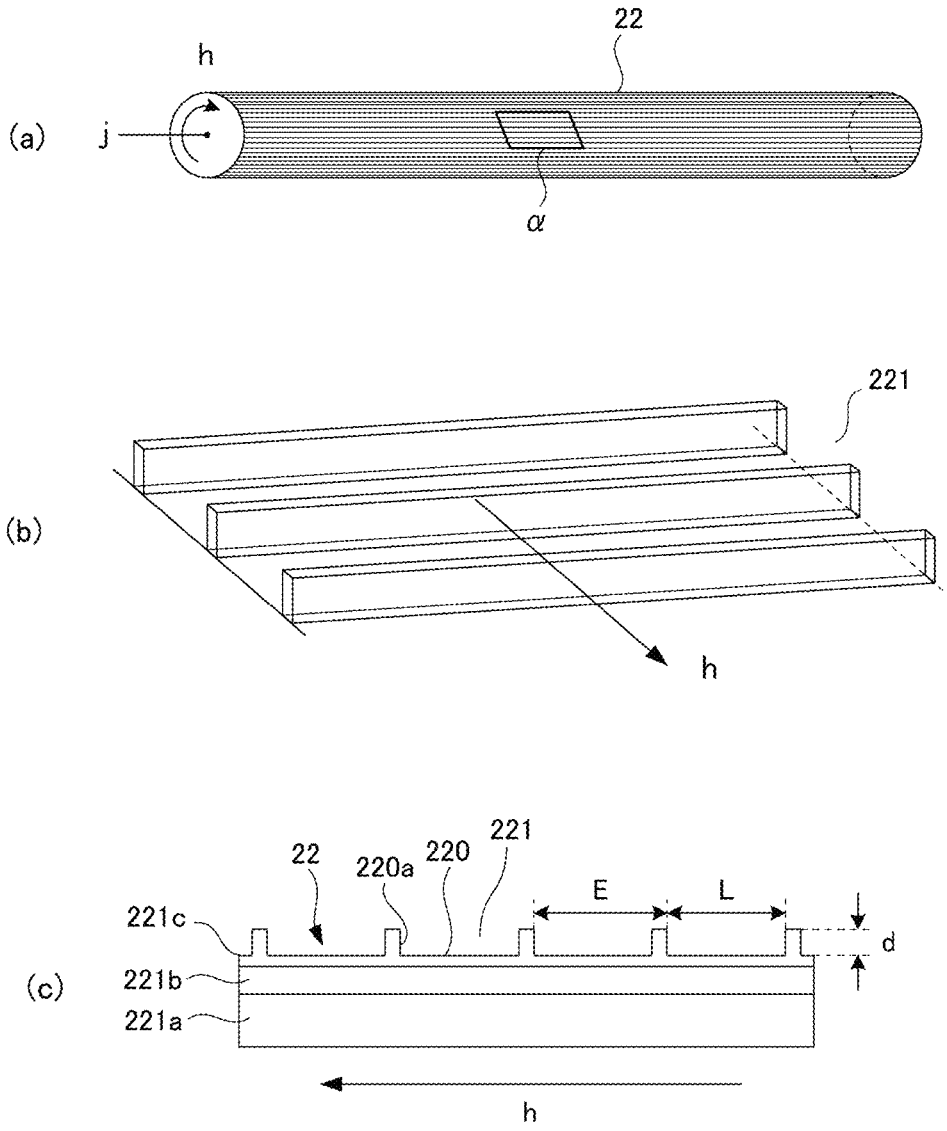
In FIG. 3, (a) is a schematic perspective view of a developing roller in the first Embodiment, (b) is an enlarged schematic view of a portion α shown in (a) of FIG. 3, and (c) is a cross sectional view showing a part of the developing roller.

A structure (projection-recess structure) of the plurality of recessed portions 221 formed on the surface of the developing roller 22 will be described using FIGS. 3 and 4. In the figures, the arrow h shows the rotational direction of the developing roller 22 having a rotational axis j. The plurality of recessed portions 221 are formed by a plurality of grooves which are arranged in parallel to the rotational axis j and which are arranged regularly with respect to the rotational direction h. The developing roller 22 is formed with a member having a structure in which an elastic layer 221*b* is coated on a base layer 221*a* which is a cylindrical member formed of a metal material. The base layer 221*a* is not limited when a material therefor has electroconductivity and rigidity, but may also be formed of SUS, iron, aluminum or the like.

The elastic layer 221*b* uses a rubber material having proper elasticity as a base material, and electroconductivity is imparted to the base material by adding electroconductive fine particles into the base material. As the base material, it is possible to use silicone rubber, acrylic rubber, nitrile rubber, urethane rubber, ethylene propylene rubber, isopropylene rubber, styrene-butadiene rubber, and the like. As the electroconductive fine particles, it is possible to use carbon black fine particles, titanium oxide fine particles, metal fine particles and the like. In the elastic layer 221*b*, in addition to the electroconductive fine particles, spherical resin particles may also be dispersed in order to adjust surface roughness. In this embodiment, the developing roller 22 is constituted by the base layer 221*a* formed of stainless steel, the elastic layer 221*b* formed on the base layer 221*a* by dispersing carbon black fine particles in silicone rubber and urethane rubber, and a coating layer 221*c*, formed on the elastic layer 221*b*, including the plurality of recessed portions 221.

Specifically, the coating layer 221*c* formed of the resin material is provided on the elastic layer 221*b* and is provided with the plurality of recessed portions 221. The coating layer 221*c* is formed of a fluorine-containing UV-curable resin material and the plurality of recessed portions 221 are formed by UV curing.

At this time, in order to enhance an adhesive property between the elastic layer 221*b* and the coating layer 221*c*, a primer layer may also be provided therebetween. In this embodiment, the projection-recess structure is formed on the coating layer 221*c* on the elastic layer 221*b*, but may also be formed on the elastic layer 221*b*. At this time, on the elastic layer, the coating layer may be formed or not formed.

The developing roller 22 may be provided or not provided with the elastic layer 221*b*. Specifically, the coating layer 221*c* of resin or metal is formed on the base layer 221*a*, the projection-recess structure may be formed on the coating layer 221*c* or may also be directly formed on the base layer 221*a*. On each of the coating layer, the elastic layer and the base layer provided with the projection-recess structure, a high-hardness material or an insulating material may also be coated in order to prevent abrasion or to perform an insulation process. At this time, there is a need to form a thin coating layer to the extent that the projection-recess structure sufficiently remains.

Figure 4:
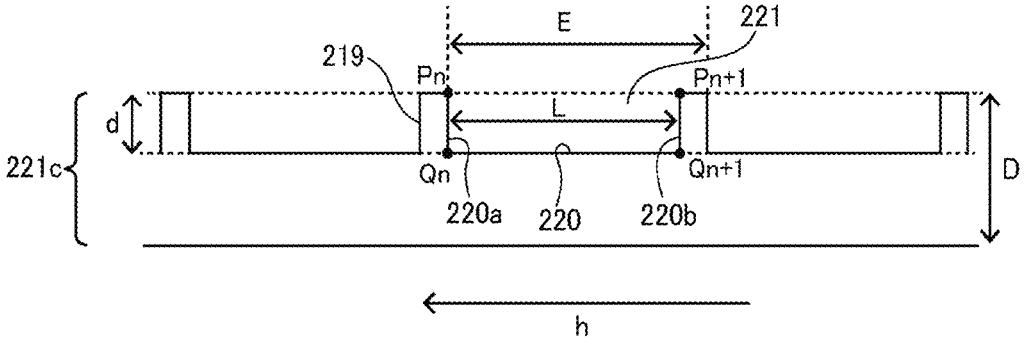
FIG. 4 is a schematic view showing a state of recessed portions of the developing roller in the first Embodiment.

FIG. 4 is a sectional view of the coating layer 221*c* on which the projection-recess structure is formed. The projection-recess structure in this embodiment is formed by grooves each having a rectangular cross-section defined by points Pn, Qn, Qn+1 and Pn+1. That is, in this embodiment, each recessed portion 221 refers to a recessed shape formed in a region between adjacent tops (Pn and Pn+1), and an inner surface refers to a structural surface, between the tops Pn and Pn+1, from which the tops Pn and Pn+1 are removed. Each of the tops Pn and Pn+1 is the remotest point from a bottom surface 220 on an associated one of side surfaces 220*a*, 220*b* opposing each other with respect to the developer feeding direction at the recessed portion 221. In other words, each of the tops Pn and Pn+1 is a top of a projected portion 219 existing between adjacent recessed portions 221.

Each of the plurality of recessed portions 221 has the bottom surface 220 which is substantially unchanged in depth d with respect to the developer feeding direction of the developing roller 22. Such a projection-recess structure is grooves which are regularly arranged with a period E in the rotational direction h and which have a minimum opening width L. In this embodiment, each recessed portion 221 is 9 μm in period E, 8 μm in minimum opening width L, 2 μm in depth d, and the coating layer 221*c* is 5 μm in thickness D. In this embodiment, the grooves are disposed in parallel to the rotational axis j but may also have an inclination relative to the rotational axis j.

[Behavior of Developer in Developing Device]

Figure 5:
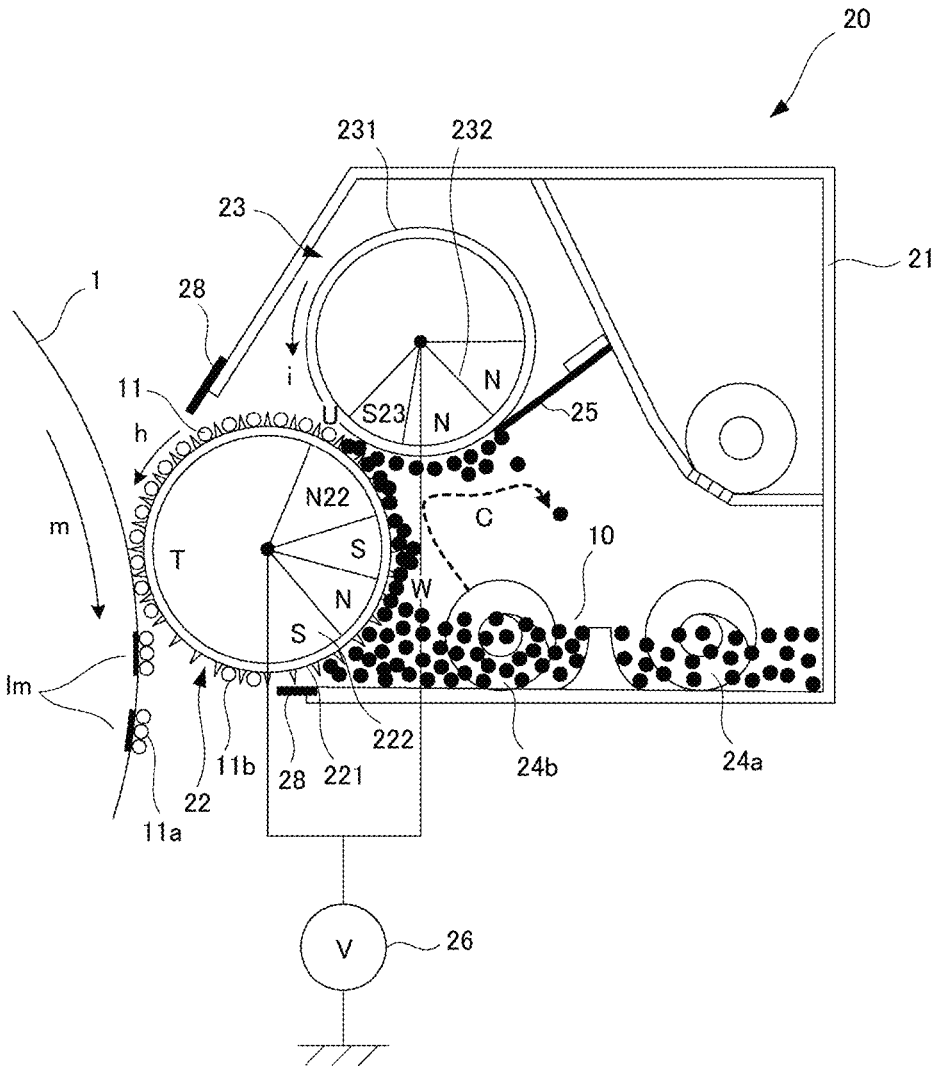
FIG. 5 is a schematic view showing a state of feeding of a two component developer in the developing device in the first Embodiment.

A behavior of the two-component developer in the developing device 20 during feeding in this embodiment will be described using FIG. 5. As described above, in the developing container 21, the two-component developer 10 containing at least the non-magnetic toner and the magnetic developer is accommodated. The two-component developer 10 is supplied at the supplying portion W to the developing roller 22 provided at the surface thereof with the plurality of recessed portions 221. In a feeding process from the supply of the two-component developer 10 until the two-component developer 10 is collected by the developer collecting device 23, the toner 11 in the two-component developer 10 contacting the developing roller 22 is stably coated uniformly in a thin layer in each of the plurality of recessed portions 221. That is, the toner 11 in the two-component developer 10 contacting the developing roller 22 contacts the inner surface of each of the plurality of recessed portions 221, and then is detached from the magnetic carrier by a confining force of the structure, so that the toner 11 is stably coated uniformly in a thin layer in each recessed portion.

Here, the two-component developer 10 from which the coated toner 11 is removed is collected at the collecting portion U by the developer collecting device 23 by the action of the magnetic force, and then is sent along a path of an arrow C to be fed again to the feeding path by the feeding members 24. Thereafter, the two-component developer 10 is stirred and fed by the feeding members 24. Subsequently, this operation is repeated.

On the other hand, the toner 11 coated uniformly in the thin layer on the developing roller 22 without being collected by the developer collecting device 23 contacts the photosensitive drum 1 at the developing portion T. Then, by a potential difference generated between a voltage applied to the developing roller 22 by a voltage applying portion 26 and a latent image potential of the photosensitive drum 1, an image portion Im of the electrostatic latent image on the photosensitive drum 1 is developed with a toner 11*a*.

At this time, by properly setting a moving speed ratio v22/v1 defined by a moving speed v22 of the developing roller 22 and a moving speed v1 of the photosensitive drum 1, the electrostatic latent image can be developed on the photosensitive drum 1 using a desired toner amount. In this embodiment, the moving speed ratio was set to 1.05. A residual toner 11*b* remaining on the developing roller 22 without contributing to development is fed to the supplying portion W by rotation of the developing roller 22 is supplied with the developer again, so that the residual toner 11*b* is replaced with the new toner. Thereafter, this operation is repeated. In this embodiment, the developing roller 22 and the developer collecting device 23 are made equipotential by the voltage applying portion 26, but the developer collecting device 23 may also be in a floating structure in which no voltage is applied thereto.

[Coating of Toner on Developing Roller and Replacement of Toner]

Coating of the toner on the developing roller 22 and replacement of the toner will be described in detail. First, the toner coating on the developing roller 22 will be described. As described above, the two-component developer 10 fed to the supplying portion W is supplied to the developing roller 22 by a magnetic field formed by the developing magnet 222 disposed fixedly inside the developing roller 22. The supplied two-component developer 10 is magnetically formed in a chain by the influence of a magnetic field formed by rotation of the developing roller 22 and the developing magnet 222, and then is fed in the rotational direction h.

Figure 6:
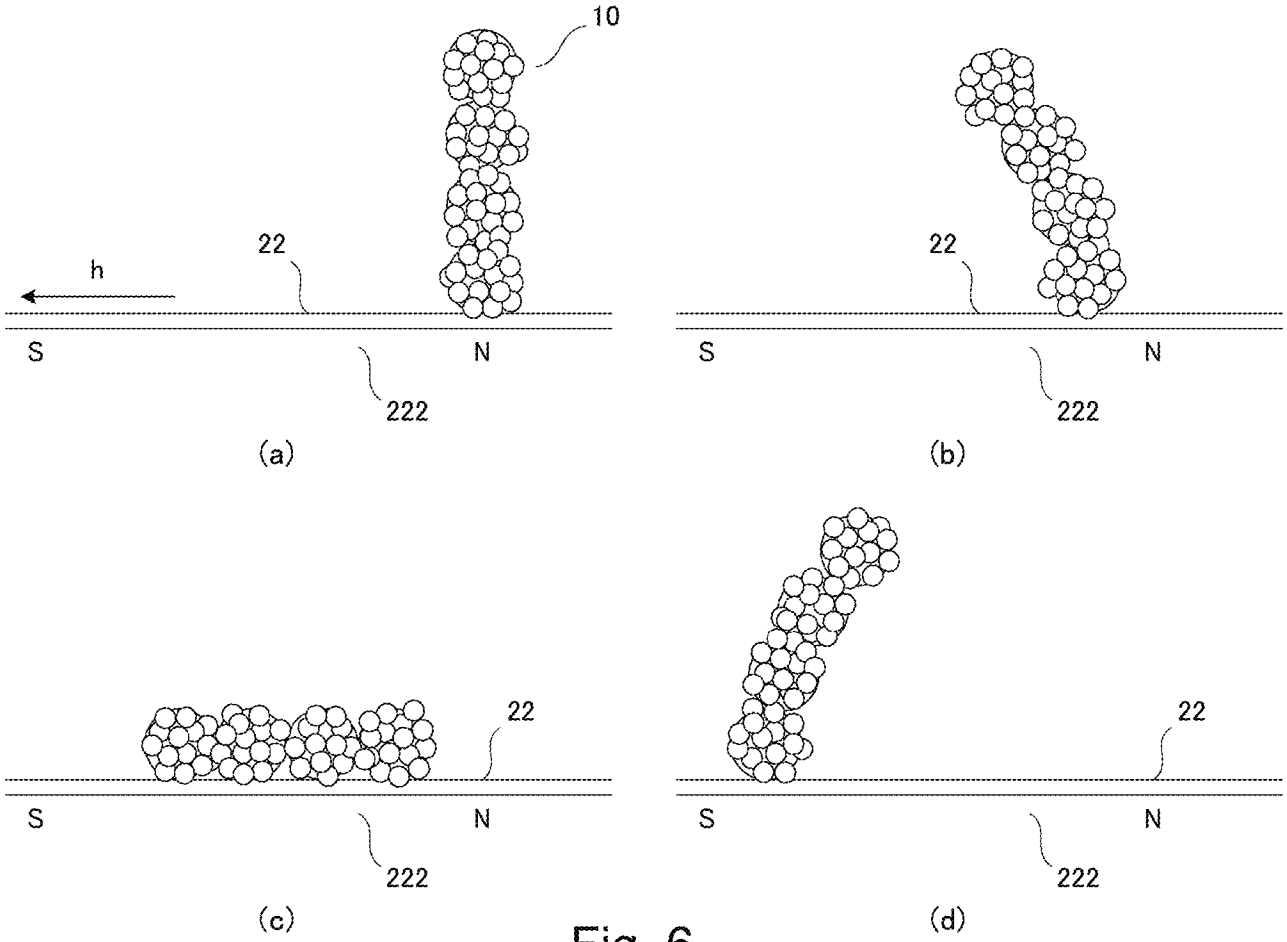
In FIG. 6, (a) to (d) are schematic views each showing a feeding behavior of a magnetic chain on the developing roller in the first Embodiment.

FIG. 6 is a schematic view for illustrating a feeding structure of the two-component developer 10. In FIG. 6, the projection-recess structure on the roller surface is omitted. First, as shown in (a) of FIG. 6, by the magnetic field of the developing magnet 222, the two-component developer 10 is magnetically formed in a chain. Then, as shown in (b) of FIG. 6, with rotation of the developing roller 22, the magnetic chain of the two-component developer 10 is started to come under the influence of an adjacent magnetic pole. Then, as shown in (c) of FIG. 6, when the developing roller 22 is further rotated, the magnetic chain falls down on the developing roller 22. As shown in (d) of FIG. 6, when the developing roller 22 is further rotated, the magnetic chain is raised by being strongly influenced by the adjacent magnetic pole. Thereafter, this operation is repeated.

At this time, the magnetic chain comes under the influence of the magnetic force in addition to the feeding force by the developing roller 22, and therefore compared with the moving speed of the developing roller 22, the moving speed of the magnetic chain is easily increased. That is, in the feeding process, in order to feed the two-component developer 10 with a speed difference relative to the developing roller 22, there is a need to dispose the developing magnet 222 having a plurality of magnetic poles, i.e., at least two magnetic poles in the developing roller 22.

Figure 7:
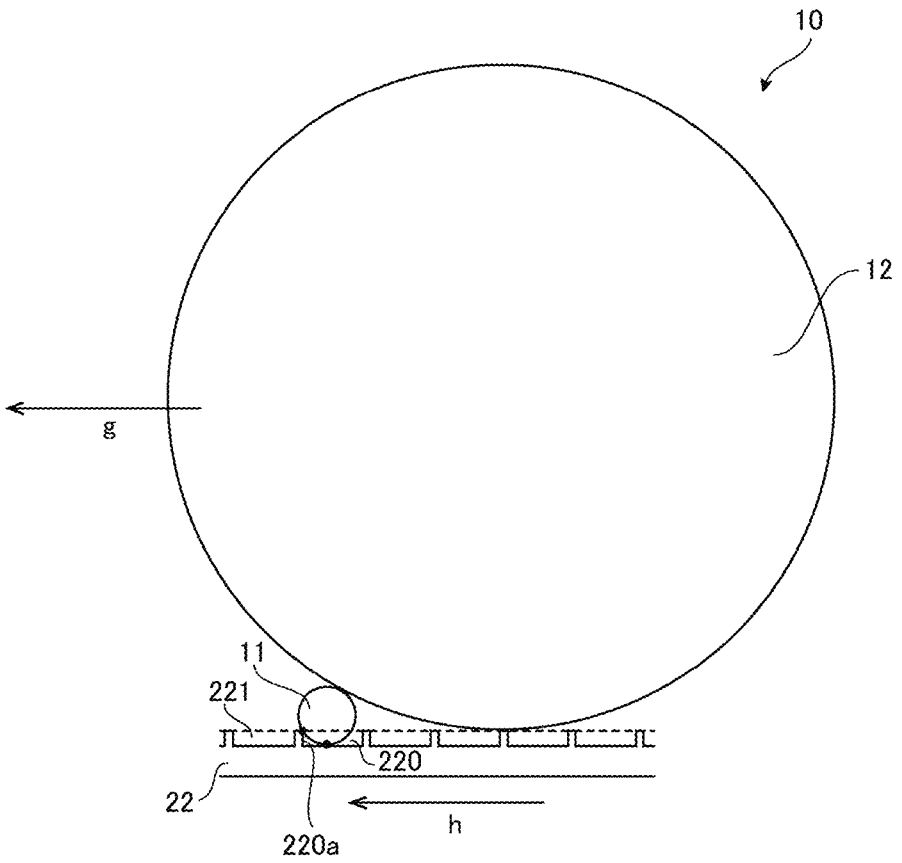
FIG. 7 is a schematic view for illustrating a behavior of a toner during feeding of the two component developer on the developing roller in the first Embodiment.

FIG. 7 is a schematic view for illustrating a state of the two-component developer 10 on the developing roller 22 during the feeding. The toner and the carrier particles which are unnecessary for explanation are omitted. A strong magnetic force acts on the magnetic chain on the developing roller 22, particularly on the magnetic carrier 12 contacting the developing roller 22 close to the developing magnet 222. By the rotation of the developing roller 22 and the magnetic force by the developing magnet 222, the magnetic carrier 12 moves in an arrow g direction in the figure at a speed higher than the moving speed of the developing roller 22. For this reason, the toner 11 coated on the magnetic carrier 12 is sandwiched between the magnetic carrier 12 and the recessed portion 221 and is triboelectrically charged, so that the toner 11 contacts the top of the recessed portion 221 and the inner surface of the recessed portion 221 in a multipoint contact manner, and thus is strongly confined by the structure of the recessed portion 221.

As a result, the non magnetic toner 11 is detached from the magnetic carrier and is moved to the recessed portion 221. The toner 11 moved to the recessed portion 221 contacts the magnetic chain which is subsequently fed, so that peeling off by the magnetic chain and movement to the magnetic chain are repeated. At this time, when a probability x of movement of the toner to the recessed portion 221 is sufficiently larger than a probability y of peeling off of the toner from the recessed portion 221 by the magnetic chain, an amount of the toner moved to the recessed portion 221 is increased with an increase in toner contact frequency in the feeding process.

As a result, after passing through the collecting portion U, the toner is selectively coated uniformly in the thin layer on the recessed portion 221 on the developing roller 22. That is, in order to uniformly coat the toner on the recessed portion 221 in the feeding process, the toner is made easy to be confined by the recessed portion 221 and the toner which is not confined by the recessed portion 221 is mad easy to be peeled off by the subsequent carrier. For this purpose, in this embodiment, at least the plurality of recessed portions 221 formed on the surface of the developing roller 22 are formed so that at least the toner having the average particle size is contactable with the inner surface of the recessed portion 221 and the carrier having the average particle size is not contactable with the inner surface of the recessed portion 221. In this embodiment, as described above, in order to feed the two-component developer 10 by the developing roller 22, the developing magnet 222 having the plurality of (two or more) magnetic poles is disposed inside the developing roller 22.

Figure 8:
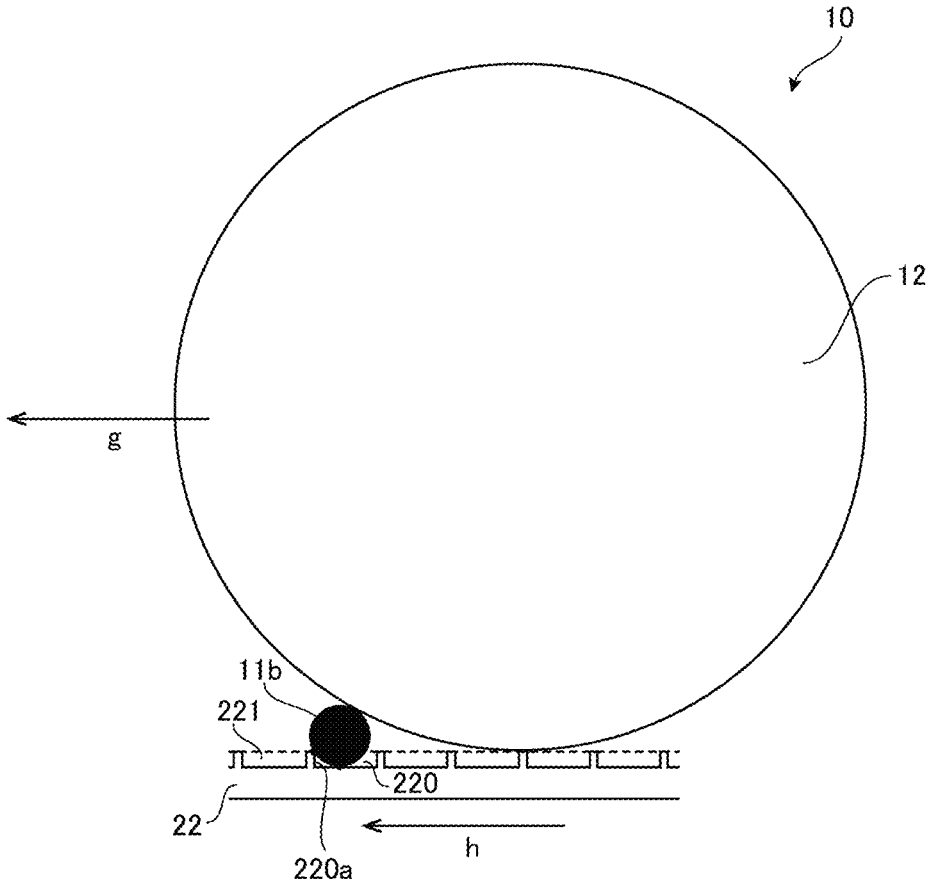
FIG. 8 is a schematic view for illustrating a behavior of a residual toner during feeding of the two component developer on the developing roller in the first Embodiment.

Replacement of the toner will be described in detail. FIG. 8 is a schematic view for illustrating a state in which the recessed portion 11*b* remaining on the developing roller 22 without contributing to the development is fed to the supplying portion W and then is subjected again to the feeding process. As described above, the residual toner 11*b* on the recessed portion 221 contacts the magnetic chain formed by the two-component developer 10 which is newly supplied. In the case where the replacement of the toner is satisfactorily made, the residual toner 11*b* contacts the magnetic chain and is peeled off, and then the new (fresh) toner 11 is supplied, and thus the residual toner 11*b* is replaced (substituted) with the new toner 11. On the other hand, in the case where the replacement of the toner is not satisfactorily made, e.g., when the force of confining the residual toner 11*b* by the recessed portion 221 is excessively large, in the feeding process, the residual toner 11*b* is not readily peeled off by the magnetic chain. As a result, the residual toner is fed again to the developing portion T, so that an amount of the toner which cannot be replaced with the new toner becomes large.

Figure 9:
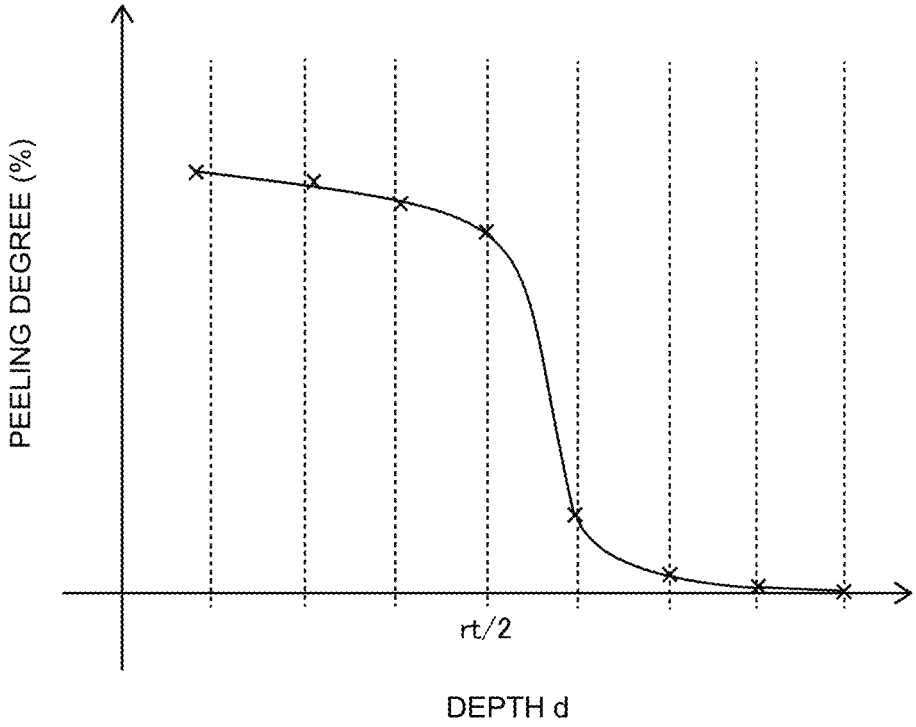
FIG. 9 is a graph showing a measurement result of a peeling(-off) degree relative to a depth d of the recessed portions of the developing roller.

FIG. 9 is a result of measurement of a degree of peeling off the residual toner by variably changing a depth d of the recessed portion 221. A specific measuring method will be described later. As is apparent from FIG. 9, the peeling(-off) degree abruptly changes in the neighborhood of 50% (rt/2) of an average particle size rt of the toner in terms of the depth d of the recessed portion 221. The reason for this would be considered as follows.

Figure 10:
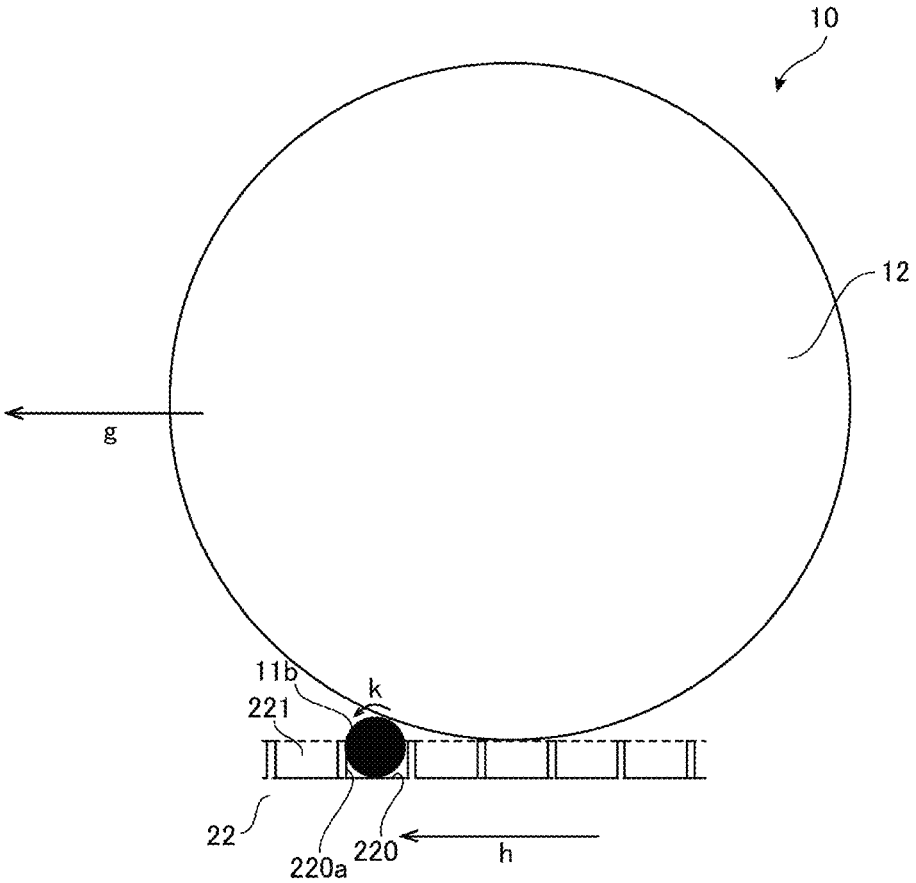
FIG. 10 is a schematic view for illustrating a behavior of the residual toner when the depth d of the recessed portions exceeds 50% of an average particle size rt of the toner.

FIG. 10 is a schematic view showing a state of the residual toner 11*b* when the depth d of the recessed portion 221 exceeds 50% of the average particle size rt. By a force acting from the magnetic carrier on the residual toner 11*b* and a force acting from the recessed portion 221 on the residual toner 11*b*, a couple of the forces act on the residual toner 11*b* so that the residual toner 11*b* is liable to rotate in a rotational direction k. At this time, in order to detach the residual toner 11*b* from the recessed portion 221, there is a need that the residual toner 11*b* rotates and gets over the top (projected portion) of the recessed portion 221. However, in the case where the depth d of the recessed portion 221 exceeds 50% of the average particle size rt of the toner, it would be considered that the residual toner 11*b* is difficult to get over the projected portion of the recessed portion 221.

That is, in order to satisfactorily perform the replacement of the toner in the feeding process, it is preferable that the plurality of recessed portions 221 are formed so that the depth d of the recessed portions 221 is not more than a half of the average particle size rt of the toner. Further, it is preferable that the plurality of recessed portions 221 are formed so that the top of the recessed portion 221 is at least lower than a position of the center of gravity of the toner which contacts the bottom surface of the recessed portion 221 and which has the average particle size rt. By forming the recessed portion 221 in this manner, the toner 11*b* rotates and easily gets over the top of the recessed portion 221, so that a toner peeling(-off) property is improved.

Here, in the illustrated example, in order to detach the toner 11*b* from the recessed portion 221, the recessed portions 221 are formed so that the toner 11*b* rotates and gets over the top of the recessed portion 221. However, depending on a shape or inclination of the side surface 220*a* of the recessed portion 221 in a downstream side with respect to the developer feeding direction (rotational direction h) of the developing roller 22, the toner contacting the bottom surface 220 does not contact the top but contacts a part of the side surface 220*a* in some cases. For example, in the case where the side surface 220*a* is inclined so that the side surface 220*a* is spaced from the bottom surface 220 toward the downstream side, the toner contacting the bottom surface 220 does not contact the top but contacts a part of the side surface 220*a* in some cases. However, even the recessed portion 221 having such a shape is required to get over the top in order to be detached from the recessed portion 221, and therefore a relationship between the top and the toner having the average particle size is defined as described above.

On the other hand, in order to improve the degree of the toner peeling-off, when the depth d of the plurality of recessed portions 221 is made shallow, a probability y that the toner is peeled off from the recessed portion by the magnetic chain becomes large. For this reason, finally, after the toner passes through the collecting portion U, the new toner in a sufficient amount cannot be coated on the recessed portions 221. For this reason, in order to coat the recessed portions 221 with the new toner in the sufficient amount, there is a need to move, to the recessed portions 221, the new toner in the sufficient amount relative to the amount of the toner to be peeled off.

Figure 11:
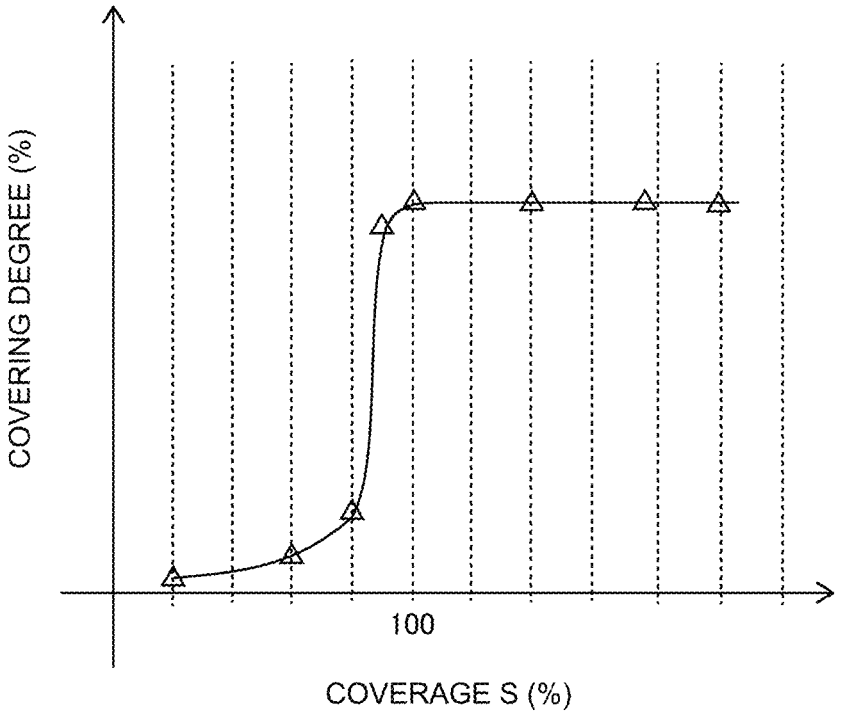
FIG. 11 is a graph showing a measurement result of a covering degree relative to coverage S.

FIG. 11 is a result of measurement of a covering degree of the toner coated newly on the developing roller 22 while variably changing a coverage S of the two-component developer 10 when the depth d of the recessed portions 221 is set in the above-described range (d=2 μm) in order to check the coating amount of the recessed portions 221 with the new toner. A specific measuring method will be described later. Here, the coverage S refers to a percentage, and is calculated from a TD ratio q of the two-component developer, particle sizes r and densities ρ by the following formula 1.

$$S\ (\%) = \frac{\rho_c r_c q}{4\rho_t r_t (100 - q)} \times 100 \qquad \text{formula 1}$$

In the formula 1, ρc represents a true density (4.8 g/cm$^3$) of the carrier and pt is a true density (1.1 g/cm$^3$) of the toner. In the neighborhood of the coverage S of 90%, the covering degree of the new toner abruptly changes. The reason for this would be considered as follows. In order to move the new toner in a sufficient amount to the recessed portions 221 in the feeding process, there is a need that a frequency of contact between the toner and the recessed portions 221 is increased and that a probability x of movement of the toner to the recessed portions 221 is made sufficiently larger than a probability of peeling-off of the toner from the recessed portions 221 by the magnetic chain. When the coverage S of the two-component developer 10 is high, the number of the toner particles contacting the recessed portions 221 increases and thus not only the above-described contact frequency is increased but also the magnetic carrier surface is not readily exposed by coating the magnetic carrier surface with the toner, so that the probability x is liable to become larger than the probability. For this reason, in the case where the coverage S is 90% or more at which the surface of the magnetic carrier is not substantially exposed, it would be considered that the covering degree described above is remarkably improved.

On the other hand, if the coverage S is less than 90%, even when the residual toner can be peeled off, the new toner in a sufficient amount cannot be coated on the developing roller 22. When the coverage S exceeds 200%, of the toner to be coated on the developing roller 22, a percentage of the toner deposited on a single layer of the toner contacting the recessed portions 221 abruptly increases, so that the coating amount becomes unstable. This would be considered because it is difficult to coat the magnetic carrier with the toner in three or more layers and thus the amount of the toner cannot be completely controlled by the magnetic carrier increases. Accordingly, in order to coat the developing roller 22 with the new toner in a sufficient amount, the coverage which is the percentage of the coating of the carrier surface with the toner may preferably be 90% or more and 200% or less.

In summary, in order to improve a degree of the toner replacement by peeling off the residual toner and then by coating the recessed portions 221 with the new toner in a sufficient amount in the feeding process, the following requirements are satisfied. First, the plurality of recessed portions 221 are formed so that the depth d of the recessed portions 221 is not more than a half of the average particle size rt of the toner. Or, the plurality of recessed portions 221 are formed so that the tops of the recessed portions 221 are at least lower than the position of the center of gravity of the toner which contacts the bottom surface 220 of each recessed portion 221 and which has the average particle size rt. In addition, the coverage which is the percentage of the coating of the carrier surface with the toner is 90% or more and 200% or less.

Figure 12:
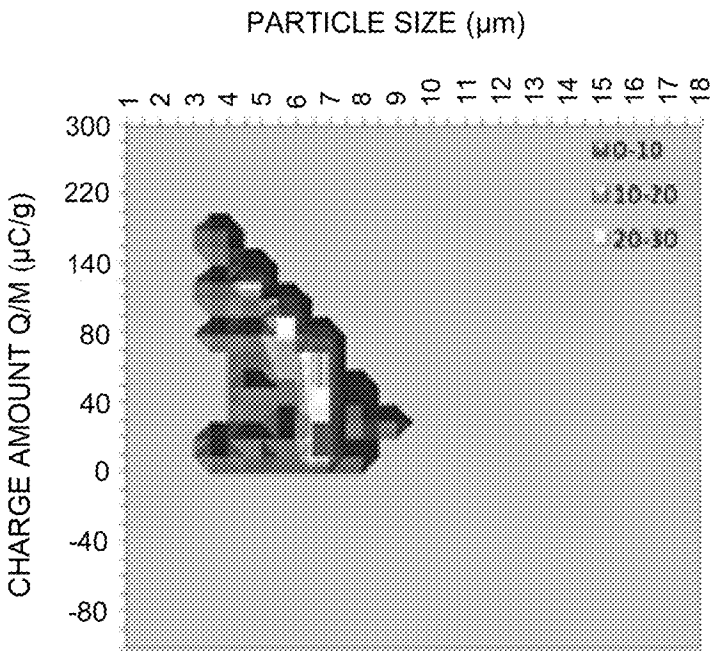
In FIG. 12, (a) and (b) are schematic views each showing a measurement result of a toner charge amount in a developing container (for (a)) or on the developing roller (for (b)).
Figure 12:
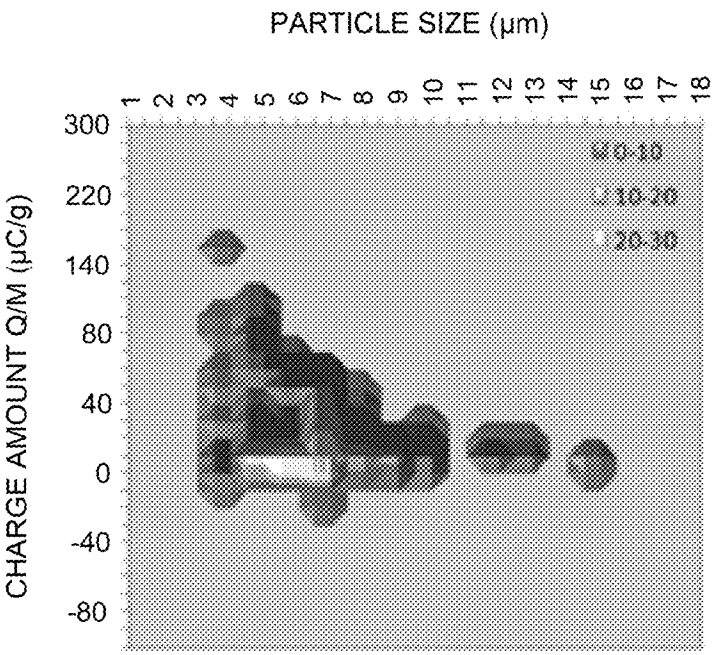

In FIG. 12, (a) is a charge amount measurement result of the toner in the developing container 21 in this embodiment, and (b) is a charge amount measurement result of the toner coated on the developing roller 22 in this embodiment. The charge amount was measured using a measuring device (E SPART Analyzer", manufactured by Hosokawa Micron Corp.) in accordance with an operation manual of the measuring device. Then, from particle sizes of the respective toner particles, data of charge amounts and the toner true density pt, a relationship between the toner particle size (μm) and a toner charge amount Q/M (μC/g) was graphed. As shown in (a) of FIG. 12, it is understood that the coverage (TD ratio) of the toner in the developing container is set to a high value for the reason described above, and therefore the toner charge amount is low. On the other hand, as shown in (b) of FIG. 12, it is understood that the toner coated on the developing roller 22 is sufficiently charged by contact and slide thereof with the recessed portions and the magnetic carrier.

As a result, it is possible to suppress adverse effects such as fog by an uncharged toner and toner scattering which are liable to generate due to a high TD ratio (coverage). Further, as in this embodiment, even when coarse powder of the toner which cannot contact the recessed portion 221, the toner is not coated on the developing roller 22, but the toner having a sharp particle size distribution is selectively coated as in this embodiment. However, as described above, when the toner is selectively coated, the toner such as the coarse powder, which does not contribute to the coating is liable to stagnate in the developing container, and therefore the particle size distribution may preferably be optimized. Details thereof will be described later.

[Verification Experiment of Replacement of Toner]

Figure 13:
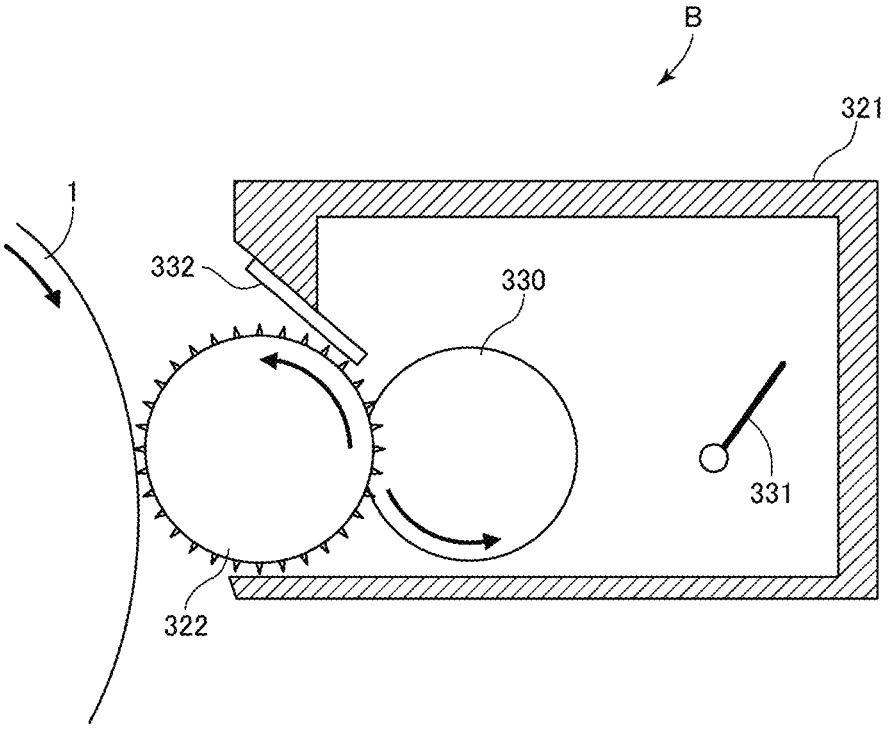
FIG. 13 is a schematic illustration of a developing device according to a comparison example.

An experiment in which the replacement of the toner as described above is verified will be described. In this experiment, the replacement of the toner on the developing roller was verified with respect to a developing device A (Embodiment 1) as shown in FIG. 2 in this embodiment and a developing device B (comparison example) having a structure shown in FIG. 13. First, the developing device B in the comparison example will be described. As shown in FIG. 13, the developing device B includes a developing container 321 in which a developing roller 322, a toner supplying member 330, a toner stirring member 331 and a regulating member 332 are provided.

The developing container 321 accommodates only the non-magnetic toner, as the developer, which is the same as that in the developing device A. Similarly as in the developing device A, the developing roller 322 rotates in the same direction as the rotational direction of the photosensitive drum 1 at the contact portion while contacting the photosensitive drum 1. On the other hand, the toner supplying member 330 rotates in an opposite direction to the rotational direction of the developing roller 322 at a contact portion therebetween while contacting the developing roller 322. The regulating member 332 is disposed in contact with the developing roller 322 in a downstream side of the toner supplying member 330 with respect to the rotational direction of the developing roller 322.

The developing roller 322 is a roller consisting of a base layer formed of stainless steel, an elastic layer formed, on the base layer, of silicone rubber or urethane rubber in which carbon black is dispersed, and a coating layer, formed on the elastic layer, on which the same projection-recess structure as that in the developing device A is formed. The toner supplying member 330 is an elastic sponge roller which has a foam skeleton structure formed on a core metal and which is formed with a relatively low hardness polyurethane foam in a thickness of 4 mm, and a penetration amount thereof into the toner (developer) carrying member is 1.2 mm. The regulating member 332 uses a 1.2 mm-thick iron plate fixed to the developing container as a supporting metal plate and uses a 80 μm-thick SUS plate as a thin plate-like elastic member. The elastic member is supported by the supporting metal plate at one end portion. A distance from the one end portion where the thin plate-like elastic member is supported to the contact portion with the developing roller 322 is 10 mm, and a contact pressure of the regulating member 332 against the developing roller 322 is 30 g/cm in terms of a linear pressure.

The thus-constituted developing device B is operated as follows. First, the toner in the developing container 321 is stirred by the toner stirring member 331 and is fed to the toner supplying member 330. The toner fed by the toner stirring member 331 is filled in a foam material at a surface of the toner supplying member 330, and then is fed to the contact portion with the developing roller 322. At the contact portion, the filled toner is electrically charged by contact with the developing roller 322 and then is moved (transferred) onto the developing roller 322. The toner supplying member 330 also has the function of peeling off the residual toner remaining on the developing roller 322 after the development. The toner supplied onto the developing roller 322 by the toner supplying member 330 is regulated by the regulating member 332 and is adjusted so as to have a desired toner amount and a desired charge amount. Then the toner is fed to the developing portion, where the electrostatic latent image on the photosensitive drum 1 is developed.

The verification experiment of the replacement of the toner in the developing device B as described above and the developing device A having the constitution in this embodiment will be described. In order to differentiate the development residual toner and the new toner, the following verification experiment was conducted using two toners different in color. In the developing device A, the two component developer described above is accommodated, and in the developing device B, only the non-magnetic toner which is the same as that in the developing device A. At first, each of the developing devices A and B was mounted in the image forming apparatus, and a normal developing operation was performed using a cyan toner, and during the developing operation, a power source was forcedly turned off.

Figure 14:
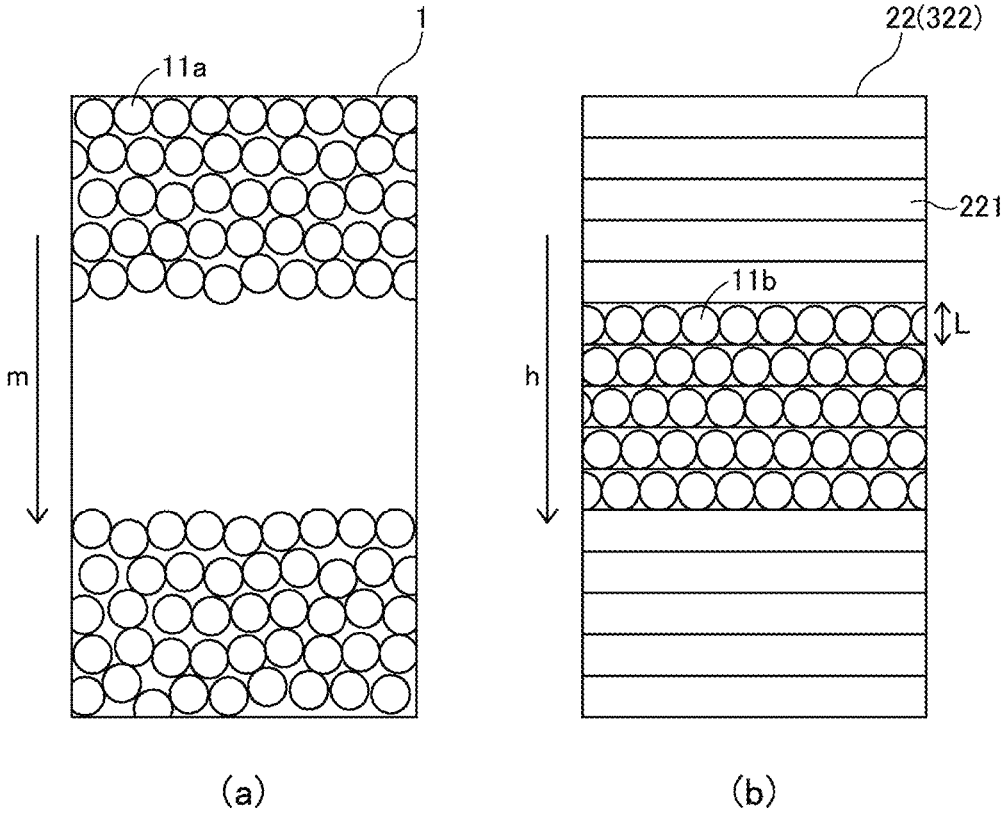
In FIG. 14, (a) and (b) are schematic views showing toner images on a photosensitive drum and the developing roller, respectively, when a developing operation is stopped, for illustrating a verification experiment of replacement of the toner.

In FIG. 14, (a) and (b) are schematic views each showing the toner image when the developing operation is stopped, in which (a) shows a state of the toner image on the photosensitive drum 1, and (b) shows a state of the toner image on the developing roller 32 or 322. As shown in (a) of FIG. 14, on the photosensitive drum 1, an electrostatic latent image of 600 dpi was formed in a 1L1S (1 line/1 space) manner. For this reason, as shown in (b) of FIG. 14, on the developing roller 22, 322 after the development, the residual toner 11*b* of cyan corresponding to the one space (42 μm) remained.

Figure 15:
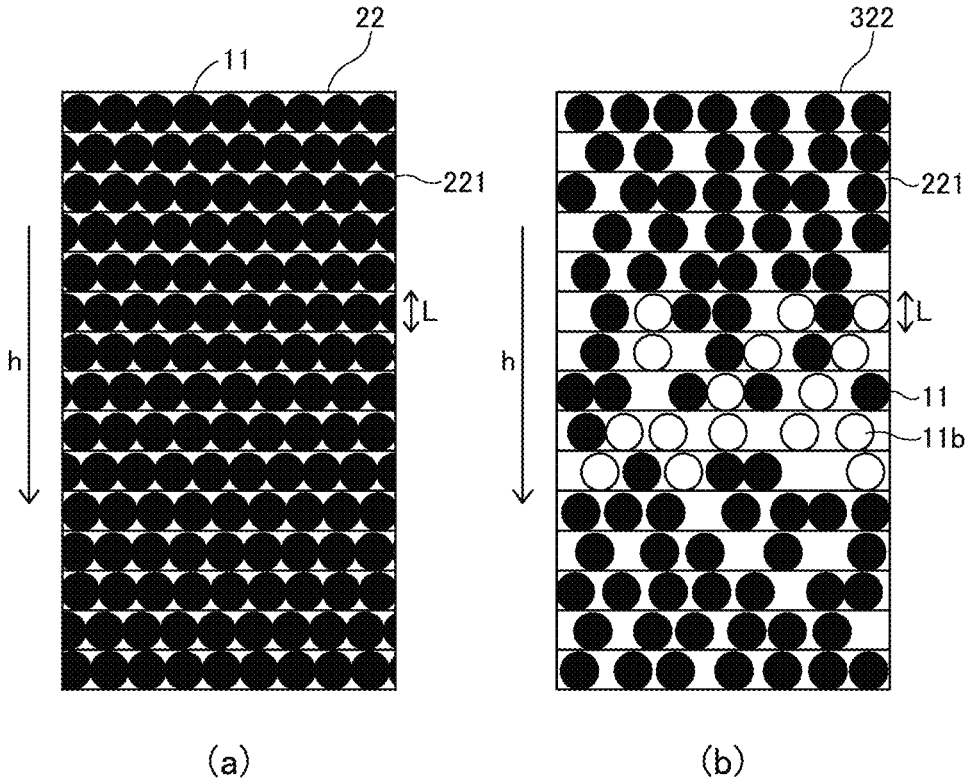
In FIG. 15, (a) and (b) are schematic views each showing toner images on the developing roller when the developing operation is stopped, in which (a) shows the case of the developing device according to the first Embodiment and (b) shows the case of the developing device according to the comparison example.

Then, each of the developing devices A and B was demounted from the image forming apparatus, and then the developer in the developing container of each of the developing devices A and B was collected. Thereafter, the developer containing yellow toner was newly accommodated in the developing container. Then, using an external driving motor, the same operation as the above described developing operation was performed outside the image forming apparatus, each of the developing rollers 22 and 322 was rotated one turn and then the drive thereof was stopped. In FIG. 15, (a) and (b) are schematic views each showing the toner image when the drive of the developing roller is stopped, in which (a) shows a state of the toner image on the developing roller 22 in the developing device A, and (b) shows a state of the toner image on the developing roller 322 in the developing device B.

Here, the toner indicated by a hollow white circle represents the residual toner 11*b* of cyan, and the toner indicated by a solid black circle represents the yellow toner 11 newly coated. As shown in (a) of FIG. 15, it is understood that on the developing roller 22 in the developing device A in this embodiment, the residual toner 11*b* is peeled off after one full turn and then the new toner 11 is coated in a sufficient amount and thus the degree of the toner replacement is improved. On the other hand, as shown in (b) of FIG. 15, on the developing roller 322 in the developing device B in the comparison example, the residual toner 11*b* is not completely peeled off after one full turn and then also the new toner 11 is not coated in a sufficient amount and thus the degree of the toner replacement is not improved.

Next, in order to convert a peeling(-off) property of the residual toner and a coating property of the new toner into numericals, a peeling degree and a covering degree were employed. Specific measuring methods will be described.

[Measuring Method of Peeling Degree]

The peeling degree was measured in the following manner. First, as shown in (b) of FIG. 14, a region (40 μm×80 μm) in which the residual toner 11*b* exists on the developing roller 22, 322 after the development was photographed using a microscope ("VHX-5000", manufactured by Keyence Corp.). From the resultant image, only an area (px) of the residual toner 11*b* of cyan was extracted using an image processing software ("Photoshop", available from Adobe Systems Inc.), so that a ratio H1(%) of the area (px) to an entire area was calculated. Then, as shown in FIG. 15, the same region on the developing roller 22, 322 after being coated with the developer containing the yellow toner was photographed through the microscope. Then, from the resultant image, only the area (px) of the residual toner 11*b* of cyan was extracted using the image processing software, so that a ratio H2(%) of the area (px) to the entire area was calculated. The peeling degree is calculated from H1 and H2 by the following formula 2. The peeling degree calculated by the measuring method described above was 98% for the developing device A and 50% for the developing device B.

$$(\text{Peeling degree})=[(H1-H2)/H1]\times 100 \qquad \text{formula 2}$$

[Measuring Method of Covering Degree]

The covering degree was measured in the following manner. Similarly as in the measurement of the peeling degree described above, the same region on the developing roller 22, 322 (FIG. 15) after being coated with the developer containing the yellow toner was photographed through the microscope. Then, from the resultant image, only an area (px) of the yellow toner 11 was extracted using the image processing software, so that a ratio H3(%) of the area (px) to the entire area was calculated and was used as the covering degree of the toner on the developing roller 22, 322. The thus-calculated covering degree by the above measuring method was 71% for the developing device A and 25% for the developing device B.

As described above, in the developing device B in the comparison example, both of the peeling degree and the covering degree were low, so that the degree of the toner replacement was not good. On the other hand, in the developing device A in this embodiment, both of the peeling degree and the covering degree were high, so that it was confirmed that the degree of the toner replacement was good.

Figure 16:
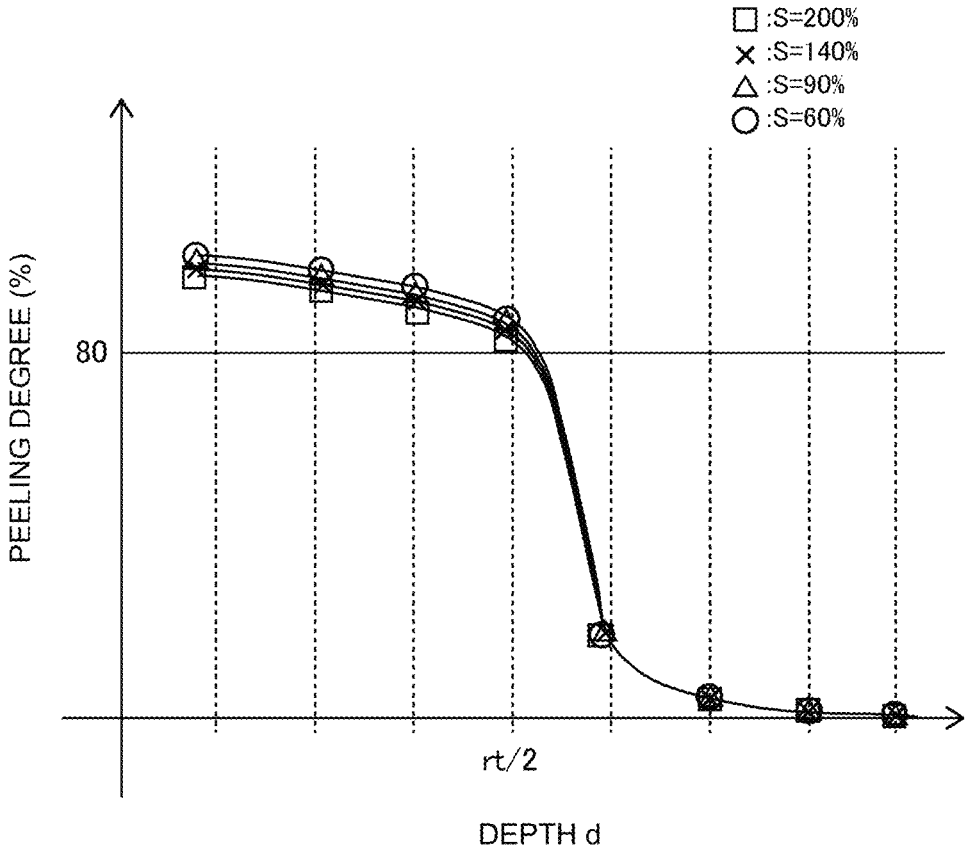
FIG. 16 is a graph showing a measurement result of the peeling degree relative to the depth d of the recessed portions of the developing roller in the case where the coverage S is changed.

Next, using the developing device A in this embodiment, each of the peeling degree and the covering degree was measured when the depth d of the recessed portions 221 and the TD ratio q of the two-component developer were adjusted to variably change the coverage S. FIG. 16 is a measurement result of the above-described peeling degree. Here, a tolerance of the peeling degree is set to 80% through evaluation of a ghost image by eye observation. Although the tolerance varies depending on specifications of a product, the tolerance may preferably be not less than a value at which at least the peeling degree is high and a change thereof is small with respect to a fluctuation in depth d.

As is apparent from FIG. 16, in the neighborhood of 50% of the average particle size rt of the non-magnetic toner in terms of the depth d of the recessed portions 221, the peeling degree abruptly changes independently of the coverage S. This would be considered because as described above, in the case where the depth d exceeds 50% of the average particle size rt of the non-magnetic toner, there is a need that the non-magnetic toner rotates and gets over the top of the recessed portion 221 and the non-magnetic toner is difficult to get over the top of the recessed portion 221.

Figure 17:
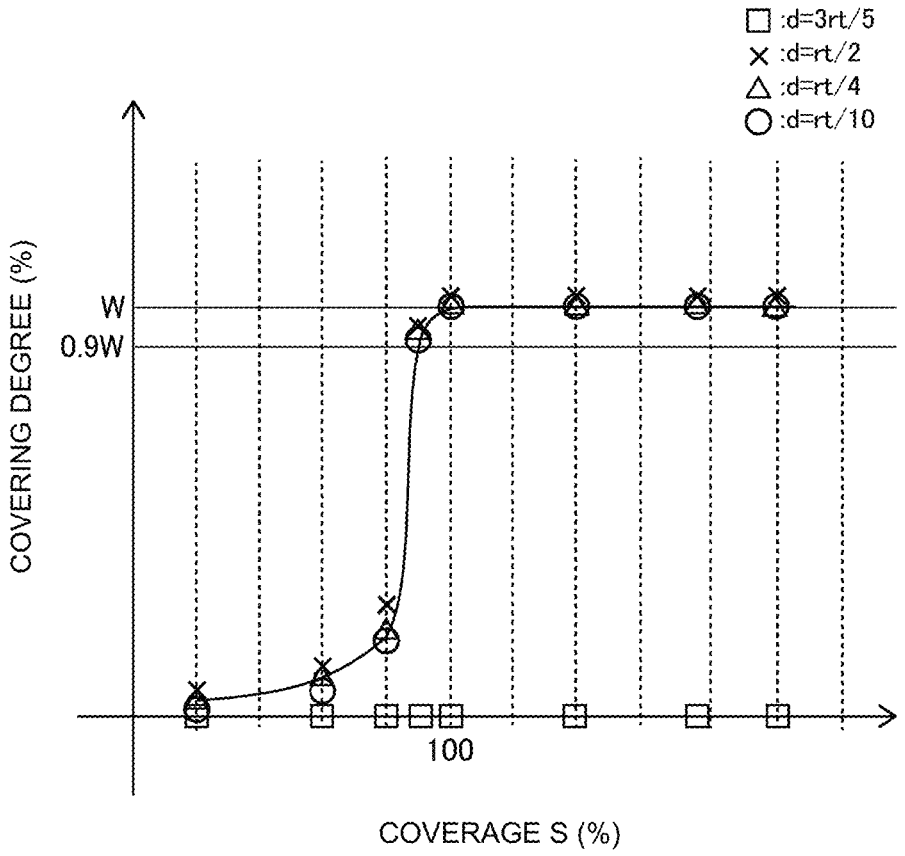
FIG. 17 is a graph showing a measurement result of the covering degree relative to the coverage S in the case where the depth d of the recessed portions of the developing roller is changed.

FIG. 17 is a measurement result of the above-described coating degree. Here, a tolerance of the coating degree is set to 90% of a saturation value w. Although the tolerance varies depending on specifications of a product, the tolerance may preferably be not less than a value at which at least the coating degree is high and a change thereof is small with respect to a fluctuation in coverage S.

As is apparent from FIG. 17, in the neighborhood of 90% of the coverage S, the coating degree of the new toner abruptly changes. As described above, in the case the coverage S is less than 90%, the number of the toner particles coated on the magnetic carrier is decreased and the contact frequency is lowered, and in addition, the toner cannot completely cover the surface of the carrier and thus the carrier surface is exposed partly, so that the probability y is liable to be larger than the probability x. For this reason, it would be considered that even when the residual toner can be peeled off, the new toner in a sufficient amount cannot be coated on the developing roller 22. On the other hand, when the coverage S exceeds 200%, of the toner coated on the developing roller 22, the percentage of the toner which does not contact the recessed portions 221 abruptly increases, so that the amount of coating becomes unstable. This would be considered because the toner is difficult to be coated in the three or more layers on the magnetic carrier and thus the amount of the toner which cannot be completely controlled by the magnetic carrier increases. That is, in order to improve the degree of the toner replacement by peeling off the residual toner and then by coating the new toner in a sufficient amount in the feeding process, as described above, there is a need to satisfy the following requirement. That is, at least the tops of the recessed portions 221 are lower than the center of gravity of the toner contacting the recessed portions 221 and the coverage of the two-component developer is 90% or more and 200% or less. Further, the coverage may preferably be 100% or more and 200% or less, so that the covering degree is stabilized in a saturation region.

[Projection-Recess Structure Forming Method]

The projection-recess structure at the surface of the developing roller 22 in this embodiment can be formed by the following method. That is, the projection-recess structure can be formed by a photo-nanoimprinting method using a photo-curable resin material, a thermal-nanoimprinting method using a thermoplastic resin material, a laser edging method in which edging is made by scanning with laser light, a diamond edging method in which the developing roller surface is abraded mechanically with a diamond blade, or the like method. Further, the projection-recess structure can also be formed by duplication from a mold for the above methods through electroplating.

Figure 18:
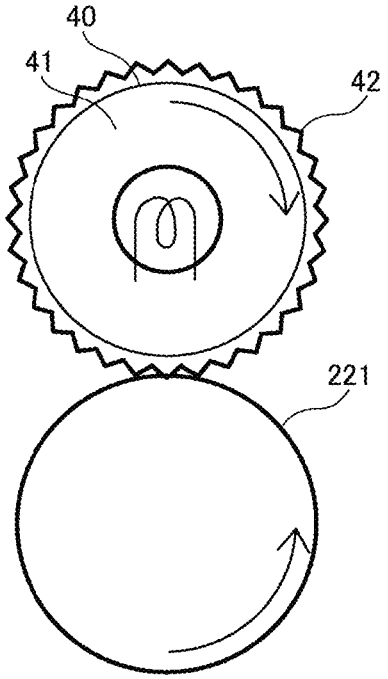
FIG. 18 is a schematic view for illustrating a projection-recess structure forming method through a thermal nanoimprint method.

FIG. 18 is a schematic view of the projection-recess structure forming method using the thermal-nanoimprinting method. A film mold 42 having a structure having a shape reverse to a desired shape of the projection-recess structure is fixed on a transfer roller 40 in which a halogen heater 41 is incorporated, and then is contacted to and pressed against the surface of the developing roller 22. While rotating the transfer roller 40 and the developing roller 22 at the same speed, the projection-recess structure is formed on the developing roller 22 by heating the thermoplastic resin material to within a range from a glass transition temperature to a melting point using the halogen heater 41. At this time, as described above, the projection-recess structure may be directly formed on the elastic layer 221*b* or may also be formed on the coating layer 221*c* formed of the thermoplastic resin material in advance on the elastic layer 221*b*.

In the photo nanoimprinting method, the photo curable resin material is coated on the surface of the developing roller 22 and then is subjected to UV irradiation using a UV light source provided in place of the halogen heater, so that the projection recess structure is formed. In this embodiment, the developing roller 22 used is formed by the photo nanoimprinting method. In order to enhance the adhesive property, a primer layer of several nm in thickness was formed on a 2 mm thick elastic layer 221*b*, and thereon, a fluorine containing photo curable resin material was coated, so that the projection recess structure was formed by the photo nanoimprinting method.

Figure 19:
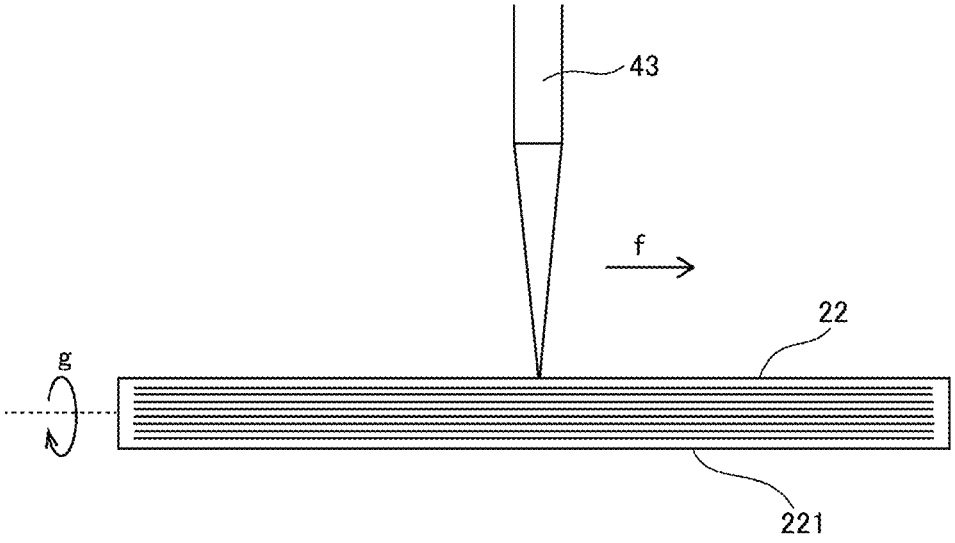
FIG. 19 is a schematic view for illustrating a projection-recess structure forming method through a diamond etching method.

FIG. 19 is a schematic view for illustrating the projection-recess structure forming method using the diamond edging method. The surface of the developing roller 22 is scanned in an arrow f direction with a needle 43 including a diamond blade having a structural shape at its free end and thus is mechanically abraded to form the recessed portion 221. Then, the developing roller 22 is rotated slightly in an arrow g direction, and the developing roller surface is scanned again in the arrow f direction with the needle 43. By repeating this operation, the projection-recess structure is formed on the surface of the developing roller 22. The projection-recess structure can also be formed by the laser edging method in which the scanning is similarly made using laser light.

[Discriminating Method of Projection-Recess Structure]

Figure 20:
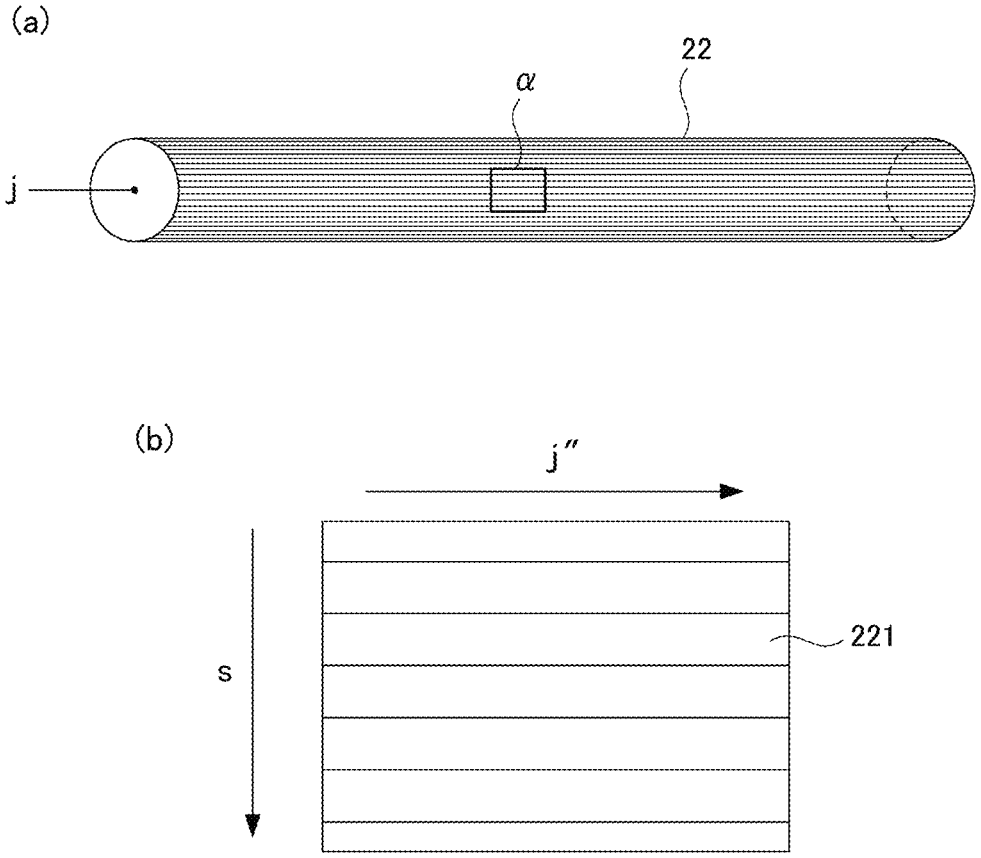
In FIG. 20, (a) and (b) are schematic views for illustrating sampling of a projection-recess structure, in which (a) is a schematic perspective view of the developing roller, and (b) is an enlarged view of a portion α shown in (a) of FIG. 20.

Discrimination of the projection-recess structure on the developing roller 22 was made using an AFM ("Nano-I", manufactured by Pacific Nanotechnology, Inc.) as a measuring device, and measurement was made in accordance with an operation manual of this measuring device. In the following, a discriminating method will be described. In FIG. 20, (a) and (b) are schematic views for illustrating sampling of the projection-recess structure. The sampling is made by cutting the surface of the developing roller 22 at a central portion α using a cutter or a laser, and then by forming (processing) the cut portion in a smooth sheet-like shape. In the case where the processing is difficult, using a general-purpose photo-curable resin material or the like, the shape of the developing roller 22 may be transferred and then is formed in a sheet-like shape.

The measurement using the AFM is made by scanning the developing roller surface with a probe in an arrow s direction in (b) of FIG. 20 which is a perpendicular direction to a horizontal direction j" of a rotational axis j of the developing roller 22, and a scanning area is such an area that a length in each of the horizontal direction j" and the perpendicular direction s is about 10 times the particle size of the toner. Incidentally, the surface of the developing roller 22 may also be directly measured using the AFM and then may be subjected to cylindrical correction.

Figure 21:
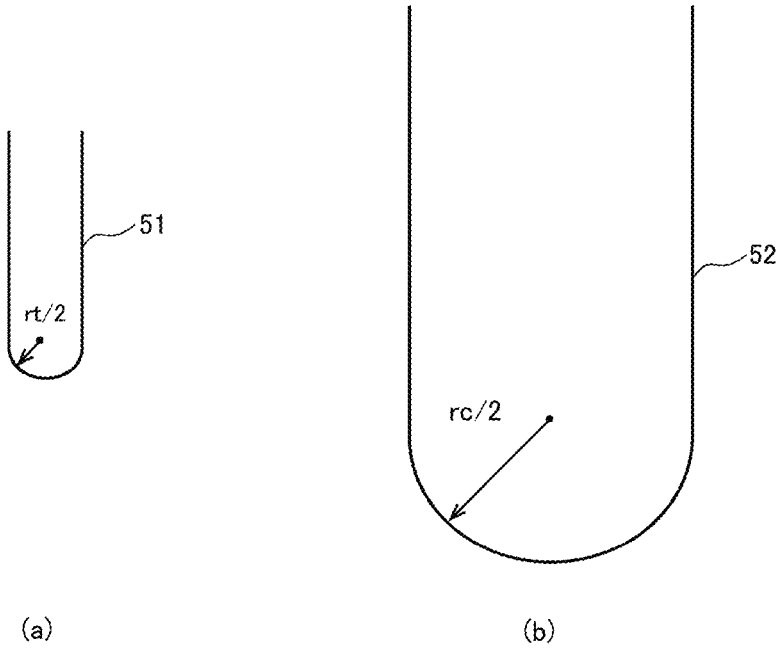
In FIG. 21, (a) and (b) are schematic views for illustrating free end shaped cantilevers (probes) of two species used in measurement with an AFM.
Figure 22:
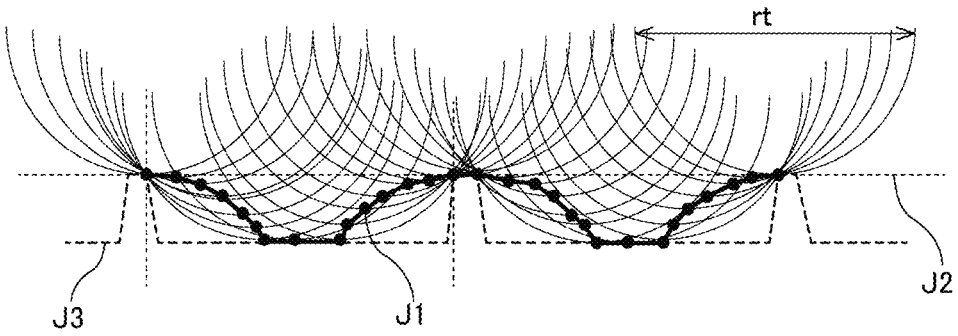
FIG. 22 is an illustration showing an example of a structural shape obtained by being measured through the AFM.

In FIG. 21, (a) and (b) are schematic views showing free end shapes of cantilevers (probes) of two species used for the measurement using the AFM. In FIG. 21, (a) shows a probe 51 having a semi-spherical free end corresponding to the average particle size of the toner, and (b) shows a probe 52 having a semi-spherical free end corresponding to the average particle size rc of the carrier. FIG. 22 shows a shape measured through the AFM using the probes 51 and 52 when the scanning in the perpendicular directions is made in the scanning area described above. A shape J1 indicated by a solid line in FIG. 22 shows a shape of the projection-recess structure measured by the probe 51 through the AFM. A shape J2 indicated by a dotted line in FIG. 22 shows a shape of the projection-recess structure measured by the probe 52 through the AFM. A shape J3 indicated by a broken line in FIG. 22 is a structural shape measured by a non-contact surface/layer cross-section shaping system ("VertScan", manufactured by Ryoka Systems Inc.).

In the measurement through the AFM, a free end position of the probe is measured with respect to the scanning direction, so that the above-described shape is obtained. At this time, a resolution with respect to the scanning direction is sufficiently ensured for a free end diameter rt of the probe 51 and then the measurement is made. Specifically, the resolution may preferably be not more than 1/10 of the free end diameter rt. A difference (J2−J1) between the obtained shapes is calculated. If there is a region of |J2−J1|>0, the region can be discriminated as the recessed portion where the toner having the average particle size is contactable and the magnetic carrier having the average particle size is not contactable.

Here, a width L of the region is taken as a minimum opening width of the recessed portion 221. In the region of |J2−J1|>0, when a maximum of |J2−J1| is rt/2 or less, the top of the recessed portion 221 is discriminated as being lower than the center of gravity of the toner contacting the recessed portion 221, so that the region is discriminated as the projection-recess structure in this embodiment. In the scanning area described above, whether or not there are a plurality of projection-recess structures is discriminated. Without using the AFM, by using the structural shape J3 measured by the non-contact surface/layer cross-section shaping system, the shapes J1 and J2 may also be predicted by moving a circle corresponding to the average particle size rt of the toner and a circle corresponding to the average particle size rc of the carrier so as to contact the shape J3.

However, in that case, there is a need to consider whether or not spheres corresponding to the toner and the magnetic carrier are three dimensionally contactable.

The developing roller 22 in this embodiment is provided at the surface thereof with a plurality of projection recess structures determined by the above discriminating method. Incidentally, a minute structure and a short period structure for which the probe 51 cannot follow and a long period structure in which the probe 52 can enter have no influence on the problem to be solved by the present invention, so that the developing roller 22 surface may contain the above structure.

[Particle Size Measuring Method]

A particle size measuring method of the toner and the carrier will be described. The particle size of the toner is measured using a measuring device ("Coulter Multisizer III", manufactured by Beckman Coulter K. K.) in accordance with an operation manual of the measuring device. Specifically, in 100 ml of an electrolytic solution ("ISOTON"), 0.1 g of a surfactant is added as a dispersing agent and then 5 mg of a measuring sample (toner) is added. The electrolytic solution in which the sample is suspended is dispersed for about 2 minutes by an ultrasonic dispersing device to obtain a sample for measurement. As an aperture, a 100 μm aperture is used, and the number of particles of the sample is measured every channel to calculate a median diameter d50, 10%-diameter d10 and 90%-diameter d90 in a cumulative particle size distribution as number-average particle sizes rt, rt10 and rt90, respectively.

The particle size of the carrier is measured using a laser diffraction particle size distribution measuring device ("SALD-3000", manufactured by Shimadzu Corp.) in accordance with the operation manual of the measuring device. Specifically, 0.1 g of the magnetic carrier (sample) is placed in the measuring device and then the measurement is made. The number of particles of the sample is measured every channel to calculate a median diameter d50 as a number-average particle size rc of the sample.

[Circularity Measuring Method]

A circularity measuring method of the toner will be described. An equivalent circle diameter, circularity and frequency distributions of these are measured using a measuring device ("FPIA-2100", manufactured by Symex Corp.) in accordance with an operation manual of the measuring device, and are calculated using the following formulas 3 and 4.

$$(\text{Equivalent circle diameter})=(\text{Projected particle area}/\pi)^{1/2}\times 2 \qquad \text{formula 3}$$

$$(\text{Circularity})=(\text{Circumferential length of circle having the same area as projected particle area})/(\text{Circumferential length of projected particle image}) \qquad \text{formula 4}$$

Here, "Projected particle area" is defined as an area of a binarized toner particle image, and "Circumferential length of projected particle image" is defined as a length of a contour line obtained by connecting edge points of the toner particle image.

The circularity in this embodiment is an index showing a degree of unevenness of the toner particle, and in the case where the toner particle is a complete spherical, the circularity is 1.00. With an increasing degree of complexity of the surface shape, the circularity is a smaller value. Further, average circularity C which means an average of a circularity frequency distribution is calculated by the following formula 5 when circularity (center value) at a division point i of the particle size distribution is ci and the frequency is fci.

$$C=\Sigma_{i=1}^{m}(Ci\times fci)/\Sigma_{i=1}^{m}(fci) \qquad \text{formula 5}$$

As a specific measuring method, 100 ml of ion exchanged water from which an impure solid matter is removed is prepared in a container, and therein, as a dispersing agent, a surfactant, preferably alkylbenzenesulfonate is added and then 0.02 g of a measuring sample is added, followed by uniform stirring. As a dispersing means, an ultrasonic dispersing device ("Tetora 150", manufactured by Nikkaki Bios Co., Ltd.) is used, and a dispersing process is performed for 2 minutes to obtain a dispersion for measurement. At that time, the dispersion is cooled appropriately so that a temperature of the dispersion does not reach 40° C. or more.

For measurement of the shape of the toner particles, the above-described measuring device ("FPIA-2100") is used. A concentration of the dispersion is adjusted so that a concentration of the toner particles during the measurement is 3,000-10,000 particles/μl, and 1,000 or more toner particles are subjected to the measurement. After the measurement, using data obtained, the average circularity of the toner particles is obtained.

[True Density Measuring Method]

A true density measuring method of the toner and the carrier will be described. The true density is measured using an automatic dry-type density meter ("Accupyc", manufactured by Shimadzu Corp.) as a measuring device in accordance with an operation manual of the measuring device. At this time, a measuring cell of 10 $cm^3$ is used to automatically measure the true density. An average of fine measured values is used as each of a true density pt for the toner and a true density ρc for the carrier.

[Covering Measuring Method]

The coverage which is a percentage of coating of the carrier surface with the toner will be described. About 0.3 g of the two-component developer sufficiently stirred in the developing container 21 is mixed with a mixture liquid of water and a surfactant (e.g., coconut detergent), so that the toner and the carrier are separated from each other and then the weight of each of the toner and the carrier is measured to obtain a TD ratio q of the two-component developer. Using the TD ratio q, a coverage S is calculated by the formula 1 described above.

[Effect of this Embodiment]

According to this embodiment, in a state in which the plurality of recessed portions 221 are provided at the surface of the developing roller 22, the replacement of the toner carried on the developing roller 22 can be satisfactorily performed. First, the developer supplied onto the developing roller 22 provided at the surface with the plurality of recessed portions 221 is principally fed by the magnetic force. In this process, the toner contacting the recessed portions 221 is uniformly coated on the recessed portions 221. Thereafter, the developer carried on the developing roller 22 is collected by the developer collecting device 23 except for the toner coated on the recessed portions 221. The toner remaining on the recessed portions 221 is fed to the developing portion T opposing the photosensitive drum 1, thus developing the electrostatic latent image on the photosensitive drum 1.

On the other hand, the residual toner remaining on the developing roller 22 without contributing to the development is fed to the supplying portion W where the developer is fed again to the developing roller 22. At this time, in the projection-recess structure formed at the surface of the developing roller 22, not only at least the toner having the average particle size is contactable with the inner surface of the recessed portion 221 but also the top of the recessed portion 221 is lower than the center of gravity of the toner contacting the inner surface of the recessed portion 221. Or, the depth d of the recessed portion 221 is not more than the half of the average particle size rt of the toner. For this reason, the residual toner contacting the developer newly supplied in the feeding process is easily peeled off by the developer.

Further, the coverage obtained as a total cross-sectional area of the toner per the surface area of the carrier in the developer is 90% or more and 200% or less, and therefore the surface of the carrier is not substantially exposed. For this reason, a probability that the toner contacting the recessed portions 221 is coated on the recessed portions 221 is sufficiently larger than a probability that the toner is peeled off.

In the feeding process, by the developing magnet 222 which is disposed inside the developing roller 22 and which as the plurality of magnetic poles, contact and slide between the developer and the recessed portions 221 are sufficiently made. For this reason, in the feeding process, the residual toner is peeled off and the new toner is uniformly coated on the recessed portions 221, so that the degree of replacement of the toner carried on the developing roller 22 can be improved. As a result, it is possible to suppress a lowering in image quality with improper replacement.

<Second Embodiment>

A Second Embodiment of the present invention will be described using FIGS. 23 to 29 while making reference to FIG. 2 and so on described in the first Embodiment. In this embodiment, to the constitution in the first Embodiment described above, a constitution as described below is added, so that the degree of replacement of the toner carried on the developing roller 22 can be preferably improved.

First, developing devices including developing rollers which are different in toner (A, B, C), carrier (A, B, C) and structural shape (A, B, C, D) were used and subjected to evaluation of the degree of the replacement of the toner.

Toner A: rt=7.8 μm, ρt=1.1 g/cm$^3$, Average circularity=0.97

Toner B: rt=5.5 μm, ρt=1.1 g/cm$^3$, Average circularity=0.97

Toner C: rt=3.0 μm, ρt=1.1 g/cm$^3$, Average circularity=0.97

Magnetic carrier A: rc=90 μm, ρc=4.8 g/cm$^3$

Magnetic carrier B: rc=60 μm, ρc=4.8 g/cm$^3$

Magnetic carrier C: rc=30 μm, ρc=4.8 g/cm$^3$

Structure A: L=8 μm, d=0.7 μm

Structure B: L=8 μm, d=1.0 μm

Structure C: L=8 μm, d=2.0 μm

Structure D: L=8 μm, d=3.9 μm

Each of the toners in this embodiment is a positive (polarity) toner which is manufactured by the polymerization method and which is subjected to adjustment of a particle size by variably changing a polymerization condition and a classifying condition. Each of the carriers is a spherical carrier obtained by surface treating a ferrite core and is subjected to adjustment of particle size by variably changing a calcining condition and a classifying condition, so that charge control is effected depending on a species and an amount of a coating material. The two component developer consisting of the toner and the carrier is subjected to adjustment of the TD ratio so that the coverage S is 120%. Each of the structural shapes was formed using an associated film mold on the developing roller by the same method as the method employed in the first Embodiment. The evaluation of the degree of replacement of the toner was made in accordance with the same evaluation criterion as in the first Embodiment.

o: Not less than a reference value.

x: Less than the reference value.

The reference value is 80% for the peeling(-off) degree and 0.9 w for the covering degree.

The results are shown in Table 1.

TABLE 1

| Structure | A | B | C | D |
|---|---|---|---|---|
| Toner A + Carrier A | o | o | o | o |
| Toner A + Carrier B | x | o | o | o |
| Toner A + Carrier C | x | x | o | o |
| Toner B + Carrier A | o | o | o | x |
| Toner B + Carrier B | o | o | o | x |
| Toner B + Carrier C | x | o | o | x |
| Toner C + Carrier A | o | o | x | x |
| Toner C + Carrier B | o | o | x | x |
| Toner C + Carrier C | o | o | x | x |

Figure 23:
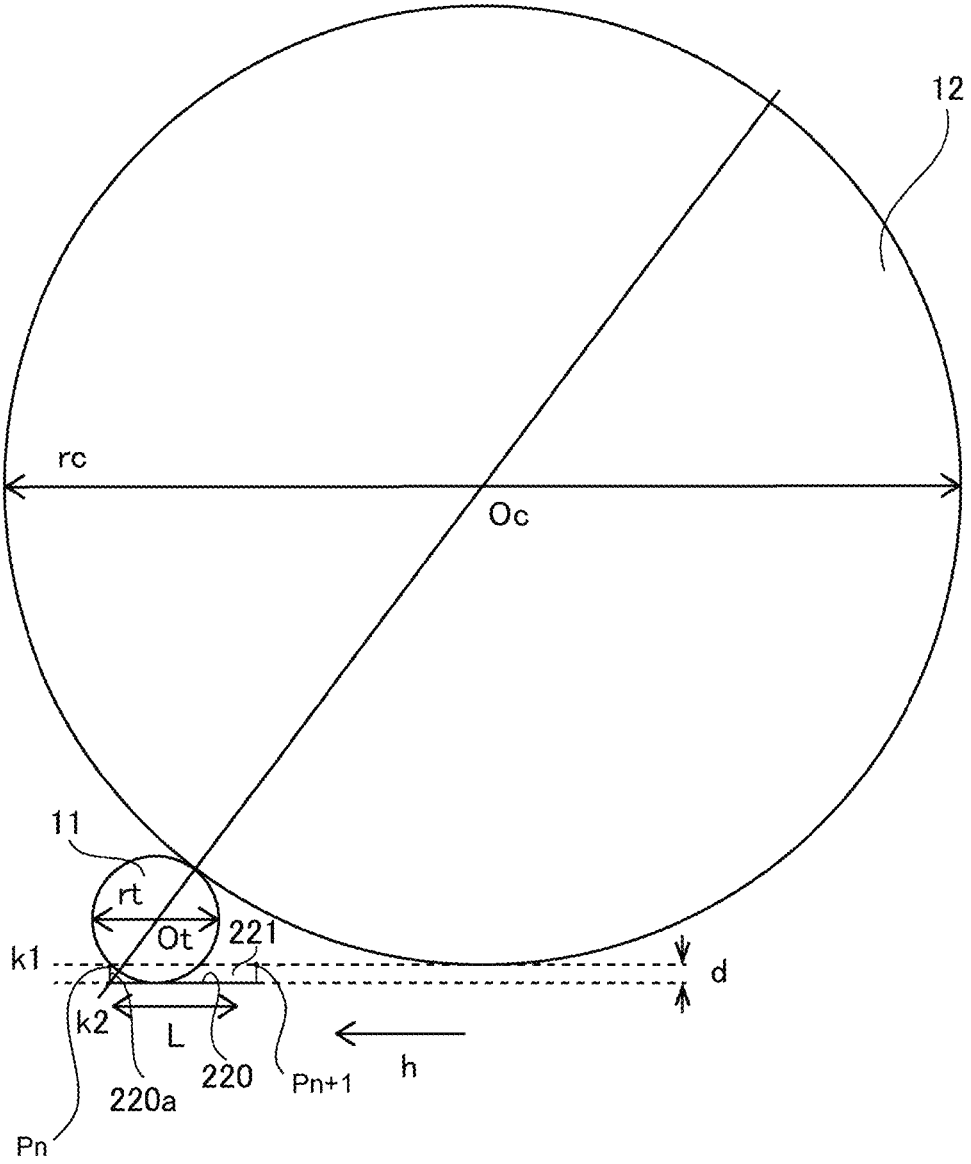
FIG. 23 is a schematic view of a toner and a carrier in a two component developer on a developing roller of a developing device according to a second Embodiment of the present invention, in which the toner (particle) confirmed in the recessed portion is abutted against a subsequently fed carrier (particle).

The reason for the above evaluation results would be considered as follows. First, as shown in FIG. 23, a first phantom line k1 and a second phantom line k2 are defined. The first phantom line k1 is a line (broken line) connecting the tops (Pn, Pn+1) of the recessed portion 221. The second phantom line k2 is a line (solid line) connecting the center of gravity Ot of the toner 11 contacting the bottom surface 220 of the recessed portion 221 and the side surface 220*a* or the top Pn of the recessed portion 221 and the center of gravity Oc of the carrier 12 contacting the first phantom line k1 and the toner 11 and having a predetermined particle size.

As shown in the figure, in the case where the second phantom line k2 passes through the top Pn or the inner surface of the recessed portion 221, a force acting on the toner is directed toward the recessed portion 221, so that the toner is not readily detached from the recessed portion 221. On the other hand, in the case where the second phantom line k2 does not pass through the top Pn or the inner surface of the recessed portion 221, the force acting on the toner is directed toward an outside of the recessed portion 221, so that the toner is liable to detach from the recessed portion 221 more than necessary and therefore it would be considered that the covering degree is liable to lower.

Figure 24:
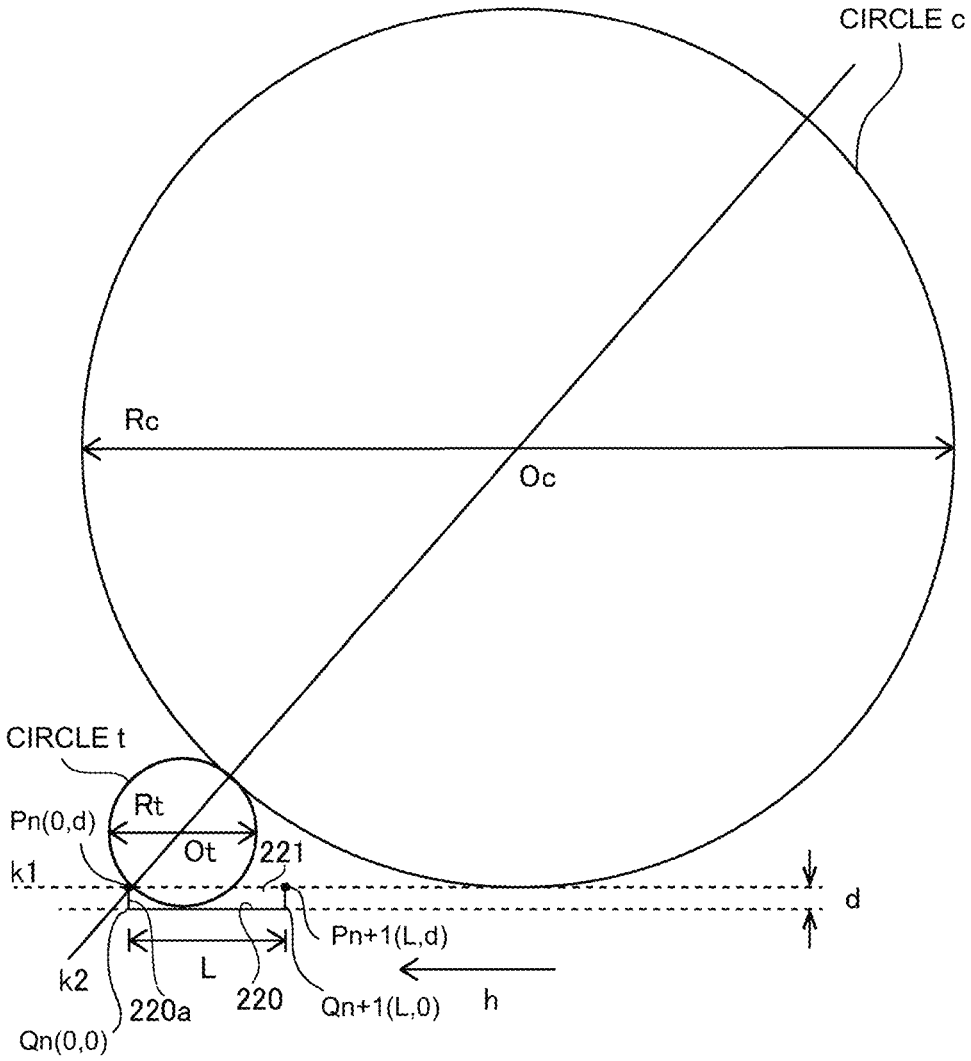
FIG. 24 is a schematic view showing a rectangular recessed portion, a circle t corresponding to a toner having a particle size Pt and a circle c corresponding to a carrier having a particle size Rc.

FIG. 24 is a schematic view showing the recessed portion 221 having a rectangular cross-section (Pn, Qn, Qn+1, Pn+1), a circle t corresponding to the toner having a particle size Rt, and a circle c corresponding to the carrier having a particle size Rc. When the circle t contacts the top Pn and the inner surface of the recessed portion 221, the circle c contacts the circle t and the first phantom line k1, and a geometrical condition in which the second phantom line k2 passes through the top Pn is represented by the following formula 6.

$$d = \frac{Rt^2}{Rc + 2Rt} \qquad \text{formula 6}$$

Figure 25:
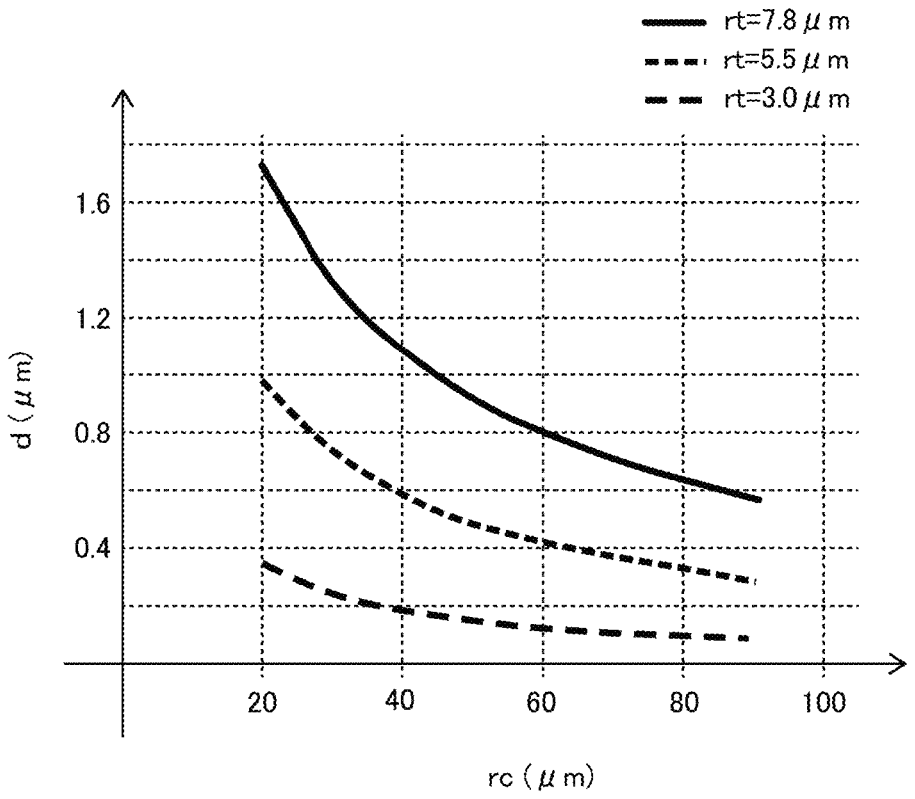
FIG. 25 is a graph showing a relationship, among a toner particle size rt, a magnetic carrier particle size rc and a depth d, obtained by a geometric condition expression.

FIG. 25 is a graph showing a relationship among the toner particle size rt, the carrier particle size rc and the depth d of the recessed portion 221. For example, when rt=5.5 μm (Toner B) and rc=30 μm (Carrier C), the depth d is 0.74 μm. That is, in the case where the depth d is below 0.74 μm (Structure A), the second phantom line k2 does not pass through the top Pn or the inner surface of the recessed portion 221, and therefore it would be considered that the covering degree lowers and thus the degree of replacement of the toner is less than the reference value. On the other hand, the depth d exceeds 50% (2.75 μm) of the toner particle size (Structure D), the first phantom line k1 passes above the center of gravity Ot and the peeling degree lowers for the reason described above, so that it would be considered that the degree of replacement of the toner is less than the reference value. Therefore, the toner accommodated in the developing container 21 (FIG. 2) is defined as follows.

Figure 26:
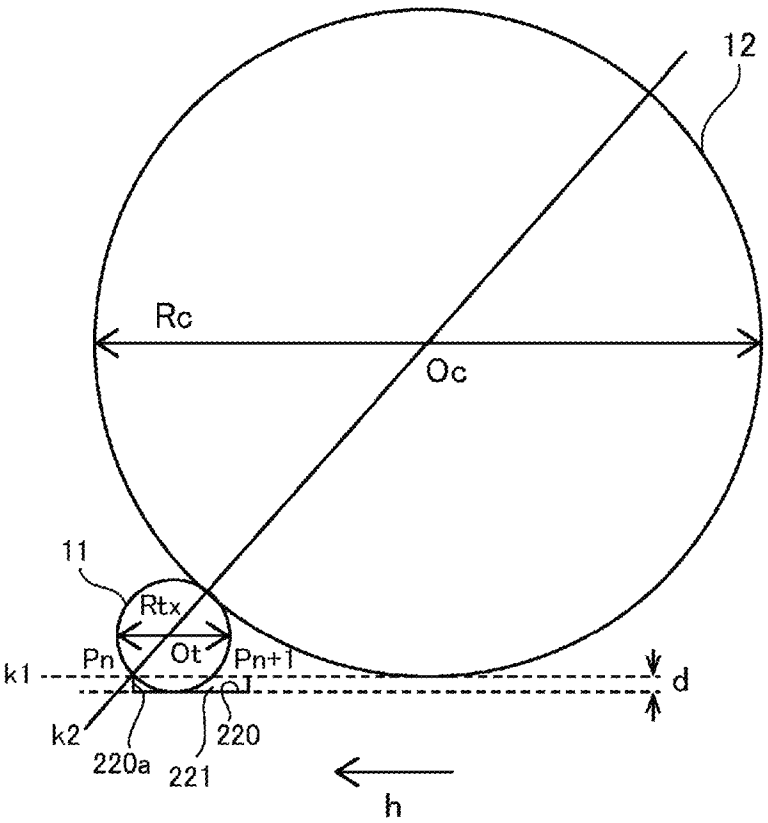
In FIG. 26, (a) and (b) are schematic views for illustrating the toner particle size determined by the recessed portion and the carrier particle size, in which (a) shows a relationship between the toner and the recessed portion, and (b) shows a relationship among the toner, the carrier and the recessed portion.
Figure 26:
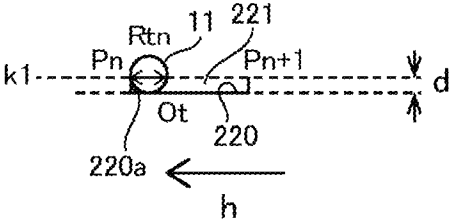

In FIG. 26, (a) and (b) are schematic views for illustrating the toner particle size obtained by the recessed portion 221 and the carrier 12. As shown in (a) of FIG. 26, a toner particle size in the case where the first phantom line k1 passes through the center of gravity Ot of the toner 11 contacting the top Pn of the side surface 220*a* in the downstream side of the recessed portion 221 with respect to the developer feeding direction (rotational direction h) of the developing roller 22 and contacting the bottom surface 220 is Rtn. Here, in an example shown in the figure, the toner 11 contacts the top Pn, but does not contact the top Pn in some cases depending on the shape or inclination of the side surface 220*a*. Accordingly, in consideration of this point, the toner particle size in the case where the first phantom line k1 passes through the center of gravity Ot of the toner contacting the side surface 220*a* or the top Pn, and the bottom surface 220 is taken as Rtn.

As shown in (b) of FIG. 26, a toner particle size in the case where the second phantom line k2 connecting the center of gravity Ot of the toner 11 contacting the bottom surface 220 and the side surface 220*a* or the top Pn and the center of gravity Oc of the carrier passes through the top Pn of the side surface 220*a* is Rtx. The carrier 12 contacts the first phantom line k1 and the toner 11 and has the predetermined particle size as described above. At this time, the toner accommodated in the developing container 21 has an average particle size which is Rtn or more and Rtx or less. As a result, the above-described degree of replacement of the toner is not less than the reference value, so that the replacement of the toner can be satisfactorily performed. A specific toner particle size defining (determining) method will be described.

[Defining Method of Toner Particle Size in Projection-Recess Structure]

Similarly as in the discriminating method of the projection-recess structure described above, using the AFM or the like, the shape difference (J2−J1) is calculated. In the region |J2-J−J1|>0 sandwiched between the two tops (Pn, Pn+1), a maximum of |J2−J1| is obtained, and then Rtn which is twice the maximum is calculated. On the other hand, from the obtained shape and the carrier particle size rc, the toner particle size Rtx when the toner contacting the top Pn and the inner surface of the recessed portion 221 contacts the carrier contacting the first phantom line k1 and the second phantom line k2 connecting the centers of gravity Ot and Oc passes through the top Pn is geometrically calculated. The toner particle size rt is defined within a range of Rtn or more and Rtx or less.

Here, it is further preferable that the 10%-particle size rt10 in the cumulative particle size distribution of the non-magnetic toner is Rtn or more and the 90%-particle size rt90 in the cumulative particle size distribution is Rtx or less. That is, the particle size of the non-magnetic toner may preferably satisfy: Rtn≤10≤rt90≤Rtx. As a result, it is possible to suppress adverse effects such that fine power toner accumulates in the recessed portion 221 and thus causes melt sticking and that coarse powder toner accumulates in the developing container and thus lowers a degree of charge stability. Here, as described above, rt10 represents the 10%-particle size in the cumulative particle size distribution, and rt90 represents the 90%-particle size in the cumulative particle size distribution.

[Relationship Between Toner Particle Size and Minimum Opening Width of Recessed Portion]

Figure 27:
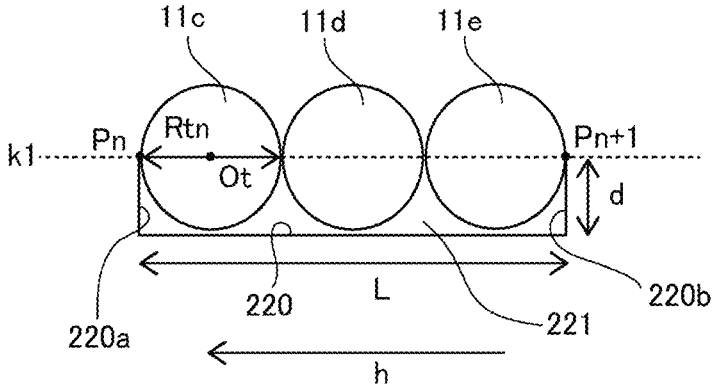
FIG. 27 is a schematic view showing a relationship between an opening width L of the recessed portion and the toner particle size.

Further, the toner particle size may preferably be defined also by a relationship with the minimum opening width L of the recessed portion 221. FIG. 27 is a schematic view in the case where the minimum opening width L of the recessed portion 221 is 3 times the toner particle size. As shown in the figure, a toner 11*c* and a toner 11*e* which are capable of contacting the top and the inner surface of the recessed portion 221 are easily confined by the recessed portion 221 and thus are coated stably. On the other hand, a toner 11*d* positioned between the toners 11*c* and 11*e* contacts the projection-recess structure at one point, and therefore is not readily confined, so that coating becomes unstable. Correspondingly, a degree of stability of the developer amount lowers. In order to obviate this problem, it is preferable that the number of toner particles confined by the recessed portions is limited. Specifically, the minimum opening width L may preferably be smaller than 3 times the toner average particle size rt, more preferably 2 times the toner average particle size rt. As a result, a fluctuation in amount of the toner confined in the recessed portions 221 is suppressed, so that the degree of stability of the developer amount can be improved.

Incidentally, the minimum opening width L is a width of the region of the difference |J2−J1|>0 as described above with reference to FIG. 22. However, in the toner contacting the bottom surface 220 contacts a part of the side surface 220*a*, not the top Pn, the minimum opening width L may also be defined as follows. That is, a distance between a point of contact of the toner having the average particle size with the downstream side surface 220*a* of the recessed portion 221 and a point of contact of the toner having the average particle size with the upstream side surface 220*b* of the recessed portion 221 may also be defined as the minimum opening width L. In this case, the minimum opening width L is obtained using, e.g., the structural shape J3 measured by the non-contact surface/layer cross-section shaping system described above.

[Relationship of Electrostatically Depositing Force Between Toner and Recessed Portion]

A relationship of an electrostatically depositing force between the toner 11 and the recessed portion 221 will be described. In order to further improve the degree of stability in coating amount of the toner on the recessed portion 221, an increase in electrostatically depositing force at a point of contact between the toner 11 and the recessed portion 221 is effective. That is, when the depositing force is large, the toner 11 is easily confined further by the recessed portion 221, so that the degree of stability of coating amount is improved. In the feeding process of the two-component developer 10, there is no need to excessively impart a contact frequency and friction between the developing roller 22 and the toner 11, so that a deterioration of the two-component developer 10 can be suppressed.

Figure 28:
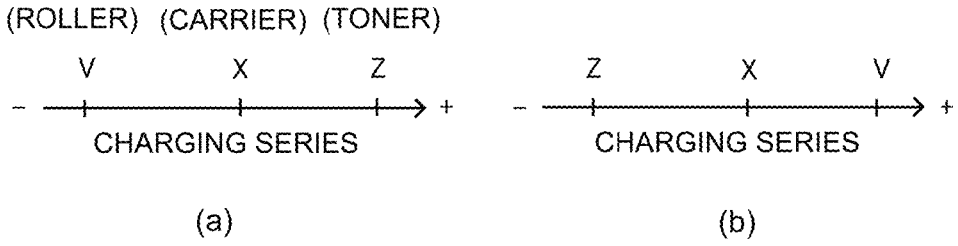
In FIG. 28, (a) and (b) are schematic views each showing a charging series of a developing roller surface (V), a carrier (X) and a toner (Z).

In order to enhance the electrostatically depositing force between the toner 11 and the recessed portion 221, a charging series among the toner 11, the carrier 12 and the surface of the developing roller 22 provided with the projection-recess structure may preferably be created as follows. That is, the carrier 12 may preferably be positioned between the toner 11 and the surface (e.g., the coating layer 221*c*) of the developing roller 22. In FIG. 28, (a) is a schematic view showing the order of a charging series in the case of a positive(-polarity) toner, and (b) is a schematic view showing the order of a charging series in the case of a negative(-polarity) toner. In the figure, Z is the surface material for the developing roller 22, X is the carrier 12, and Z is the toner 11.

In this condition, a difference in charging series between the toner 11 (Z) and the surface material (V) for the developing roller 22 is larger than a difference in charging series between the toner (Z) and the carrier 12 (X). For this reason, when the toner 11 and the developing roller 22 are contacted to and triboelectrically charged with each other, compared with the electrostatically depositing force between the toner 11 and the carrier 12, a strong electrostatically depositing force generates, so that the toner 11 detaches from the carrier 12 and is easily deposited on the surface of the developing roller 22.

Figure 29:
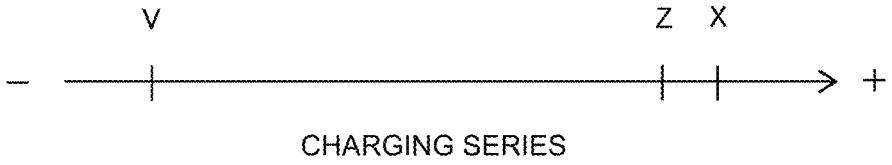
FIG. 29 is a schematic view showing another charging series of the developing roller surface (V), the carrier (X) and the toner (Z).

On the other hand, also in the order of a charging series shown in FIG. 29, the difference in charging series between the toner 11 (Z) and the surface material (V) for the developing roller 22 is larger than the difference in charging series between the toner 11 (Z) and the carrier (X). However, in the case of this order, the toner 11 is triboelectrically charged easily to the negative polarity by the carrier 12 and to the positive polarity by the developing roller 22. In this way, when the toners having different polarities exist, in addition to the toner confined by the recessed portions 221, the toner deposited between itself and the adjacent toner increases in amount, thus causing a lowering in stability of the coating amount.

For the reason described above, in the charging series among the toner 11, the carrier 12 and the surface material for the developing roller 22 provided with the projection-recess structure, it is preferable that the carrier 12 is positioned between the toner 11 and the surface material for the developing roller 22.

[Charging Series Determining Method]

A specific charging series determining method will be described while making reference to FIG. 2. In the developing container 21 of the developing device 20, only the magnetic carrier is placed and then a normal development rotational operation is performed for about 1 min. At this time, the voltage applying portion 26 is disconnected, so that the developing roller 22 and the developer collecting device 23 are placed in an electrically float state. At the position of the developing portion T, a probe of a surface electrometer ("MODEL 347", manufactured by Trek Japan K.K.) is provided opposed to the developing roller 22, and then a surface potential of the developing roller 22 is measured. When the potential difference is positive, the surface of the developing roller 22 is discriminated as being positive relative to the magnetic carrier in the charging series, and when the potential difference is negative, the surface of the developing roller 22 is discriminated as being positive relative to the magnetic carrier in the charging series. On the other hand, based on triboelectric chargeability between the magnetic carrier and the toner, it is possible to discriminate whether the toner is positioned in the positive side or the negative side relative to the magnetic carrier, and therefore, it is possible to determine a relative charging series among the three materials.

<Third Embodiment>

A Third Embodiment of the present invention will be described using FIGS. 30 to 35 while making reference to FIG. 2 described above. In the first and second Embodiments described above, the plurality of recessed portions formed on the surface of the developing roller 22 have a substantially rectangular shape in cross-section. On the other hand, in this embodiment, a bottom surface 220A of a recessed portion 221A of a developing roller 22A has an inclined shape. Other constitutions and actions are similar to those in the first and second Embodiments described above.

Figure 30:
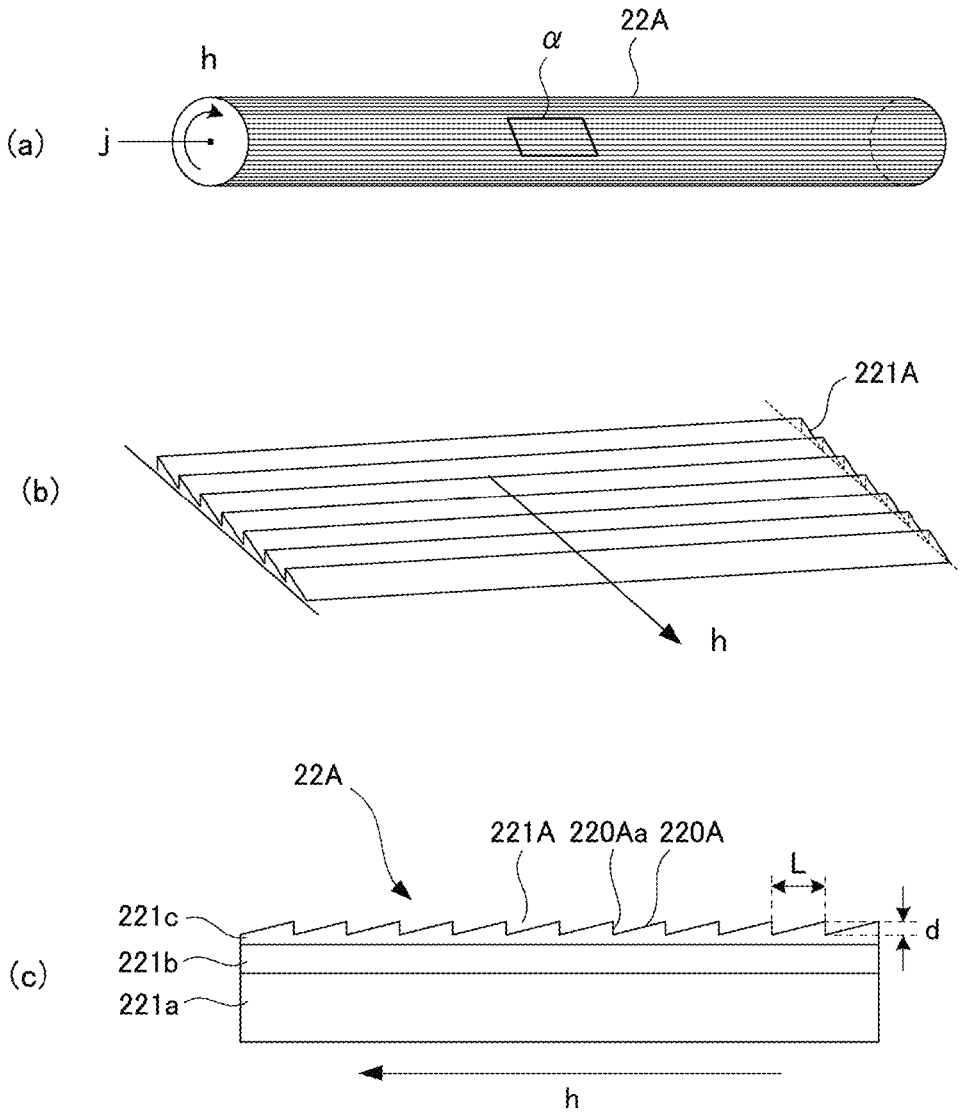
In FIG. 30, (a) is a schematic perspective view of a developing roller in a third Embodiment of the present invention, (b) is an enlarged schematic view of a portion α in (a) of FIG. 30, and (c) is a cross sectional view of a part of the developing roller.

A structure (projection-recess structure) of a plurality of recessed portions 221A formed on the surface of the developing roller 22A will be described using FIGS. 30 and 31. In the figures, the arrow h shows the rotational direction of the developing roller 22A having a rotational axis j. The plurality of recessed portions 221A are formed by a plurality of grooves which are arranged in parallel to the rotational axis j and which are arranged regularly with respect to the rotational direction h. Further, similarly as in the first Embodiment. The developing roller 22A is formed with a member having a structure in which an elastic layer 221*b* is coated on a base layer 221*a* which is a cylindrical member. The elastic layer 221*b* is covered with a coating layer 221*c* on which a plurality of recessed portions 221A are formed.

Figure 31:
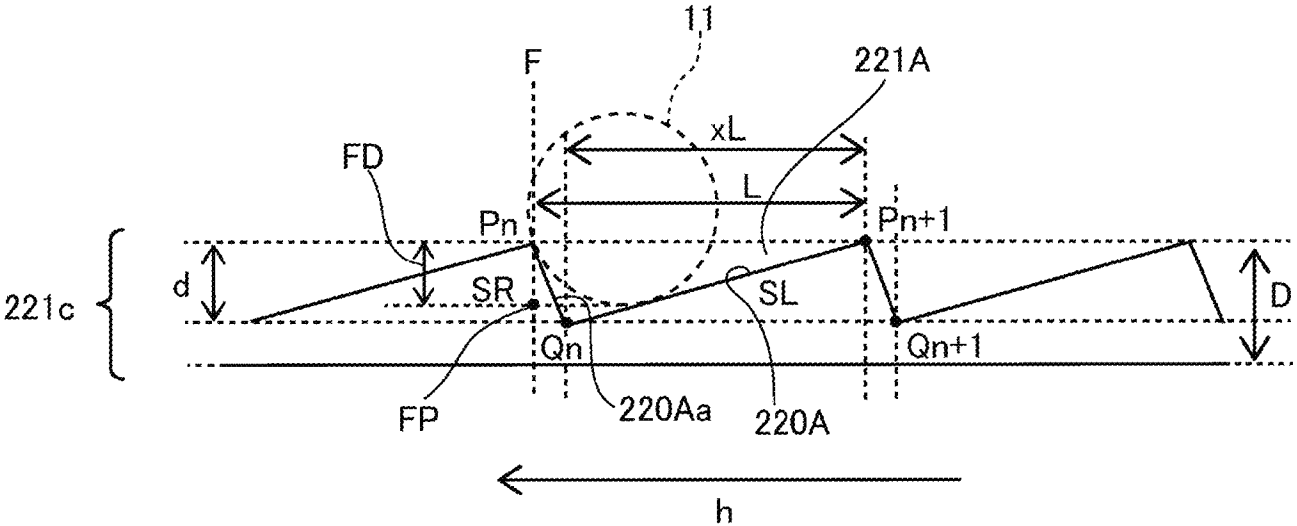
FIG. 31 is a schematic view showing a structure of recessed portions of the developing roller in the third Embodiment.

FIG. 31 is a sectional view of the coating layer 221*c* on which the projection-recess structure in this embodiment is formed. The projection-recess structure in this embodiment is formed by grooves each having a substantially triangular cross-section defined by points Pn, Qn and Pn+1. For this reason, the plurality of recessed portions 221A have side surfaces 220Aa in the downstream side of the developer feeding direction (rotational direction h) of the developing roller 22A and the bottom surfaces 220A inclined from the downstream side toward the upstream side with respect to the developer feeding direction in a direction in which the depth of the recessed portions 221 becomes shallow. Here, a slope SR of the side surface 220Aa between the top Pn and a bottom Qn and a slope SL of the bottom surface 220A between the top Pn+1 and the bottom Qn are different in inclination angle from each other, and the slope SL is gentle compared with the slope SR.

In this embodiment, each recessed portion 221A refers to a recessed shape formed in a region between adjacent tops (Pn and Pn+1), and an inner surface thereof refers to a structural surface, between the tops Pn and Pn+1, from which the tops Pn and Pn+1 are removed. Such a projection-recess structure is grooves which are regularly arranged with a period L in the rotational direction h and which have a depth d, a minimum opening width L and a width xL of the gentle inclined surface (slope) SL. In this embodiment, each recessed portion 221 is 1.9 μm in depth d, 8 μm in minimum opening width L, 7.3 μm in width xL of the gentle slope SL. Incidentally, the depth d is an interval between a line which is parallel to the developer feeding direction and which passes through the top Pn and a line which is parallel to the developer feeding direction and which passes through the bottom Qn. The minimum opening width L is an interval between adjacent tops (Pn, Pn+1).

Also in this embodiment, the plurality of recessed portions 221A are formed so that at least the toner having the average particle size is contactable with the inner surface of the recessed portion 221A and the carrier having the average particle size is not contactable with the inner surface of the recessed portion 221A. Further, the recessed portions 221A are formed so that the top Pn of the recessed portion 221A is lower than the position of the center of gravity of the toner, having the average particle size, contacting the bottom surface 220A of the recessed portion 221A. As shown in FIG. 31, the case where the toner having the average particle size contacts the bottom surface 220A and the side surface 220Aa or the top Pn of the side surface 220A is considered. When a phantom circle of the toner 11 is projected to a phantom plane F which passes through the top Pn of the recessed portion 221A and which is perpendicular to the developer feeding direction, on the phantom plane F, the remotest point from the top Pn of the recessed portion 221A toward the bottom is defined as FP. In this case, the plurality of recessed portions 221A are formed so that a distance FD between this point FP and the top Pn of the recessed portion 221A is not more than a half of the average particle size rt of the toner.

Figure 32:
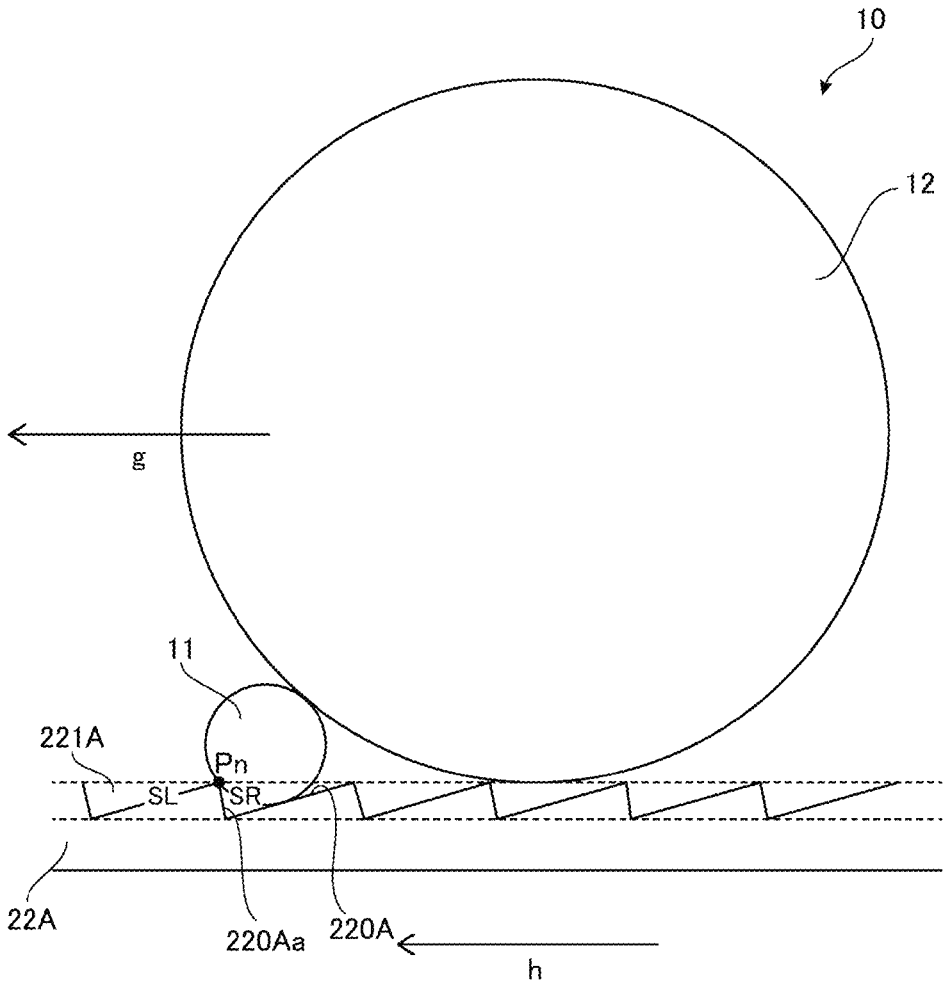
FIG. 32 is a schematic view for illustrating a behavior of the toner on the developing roller during feeding of a two component developer in the third Embodiment.

FIG. 32 is a schematic view for illustrating a state of the two-component developer 10 on the developing roller 22A during the feeding. The non-magnetic toner and the magnetic carrier which are unnecessary for explanation are omitted. As described above, the magnetic chain moves in the arrow g direction in the figure relative to the developing roller 22A with a relative speed difference. Accordingly, for the purpose that the toner 11 coated on the carrier 12 is sandwiched between the carrier 12 and the recessed portion 221A and is triboelectrically charged, so that the toner 11 contacts the top of the recessed portion 221A and the inner surface of the recessed portion 221A in a multipoint contact manner, the following condition is required to be satisfied. That is, there is a need that with respect to the two-component developer feeding direction g, the slope SR adjacent to the top Pn of the recessed portion 221A is positioned upstream of the top Pn and that the slope 3 L adjacent to the top Pn is positioned downstream of the top Pn. In other words, there is a need that the side surface 220Aa is positioned in the downstream side of the developer feeding direction g and that the bottom surface 220A is inclined from the downstream side toward the upstream side with respect to the developer feeding direction g in a direction in which the depth of the recessed portion 221A becomes shallow.

Figure 33:
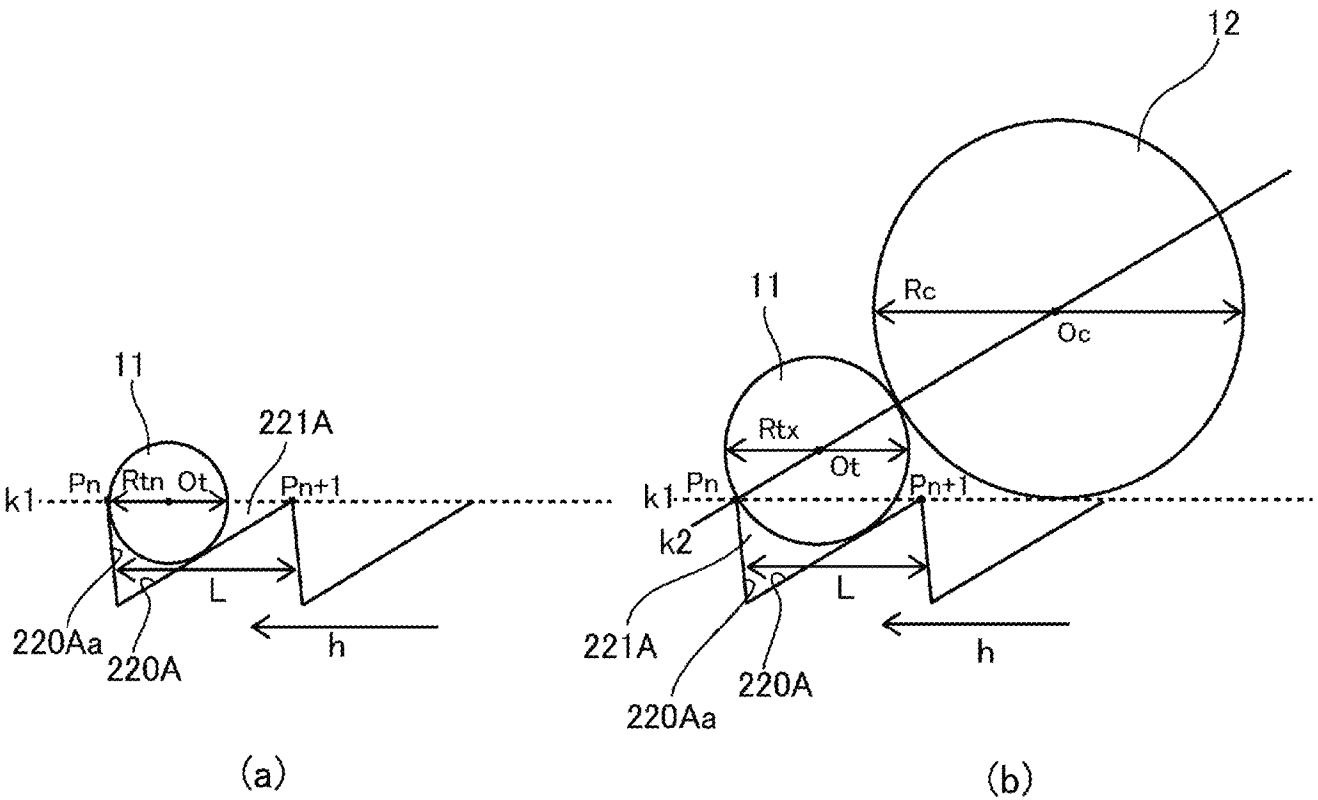
In FIG. 33, (a) and (b) are schematic views for illustrating a toner particle size determined by the recessed portion and a carrier particle size, in which (a) shows a relationship between the toner and the recessed portion, and (b) shows a relationship among the toner, the carrier and the recessed portion.

In FIG. 33, (a) and (b) are schematic views for illustrating the toner particle size obtained by the recessed portion 221 and the carrier 12. First, similarly as in the second Embodiment, the first phantom line k1 and the second phantom line k2 are defined. That is, the first phantom line k1 is a line (broken line) connecting the tops (Pn, Pn+1) of the recessed portion 221A. The second phantom line k2 is a line (solid line) connecting the center of gravity Ot of the toner 11 contacting the bottom surface 220A of the recessed portion 221A and the side surface 220Aa or the top Pn of the recessed portion 221A and the center of gravity Oc of the carrier 12 which contacts the first phantom line k1 and the toner 11 and which has a predetermined particle size.

As shown in (a) of FIG. 33, a toner particle size in the case where the first phantom line k1 passes through the center of gravity Ot of the toner 11 contacting the side surface 220Aa or the top Pn of the side surface 220Aa in the downstream side of the recessed portion 221A with respect to the developer feeding direction (rotational direction h) of the developing roller 22A and contacting the bottom surface 220A is Rtn.

Further, as shown in (b) of FIG. 33, a toner particle size in the case where the second phantom line k2 connecting the center of gravity Ot of the toner 11 contacting the bottom surface 220A and the side surface 220Aa or the top Pn and the center of gravity Oc of the carrier passes through the top Pn of the side surface 220Aa is Rtx. The carrier 12 contacts the first phantom line k1 and the toner 11 and has the predetermined particle size. At this time, also in the case of this embodiment, the toner accommodated in the developing container 21 has an average particle size which is Rtn or more and Rtx or less. Incidentally, the predetermined particle size is the average particle size of the carrier.

Figure 34:
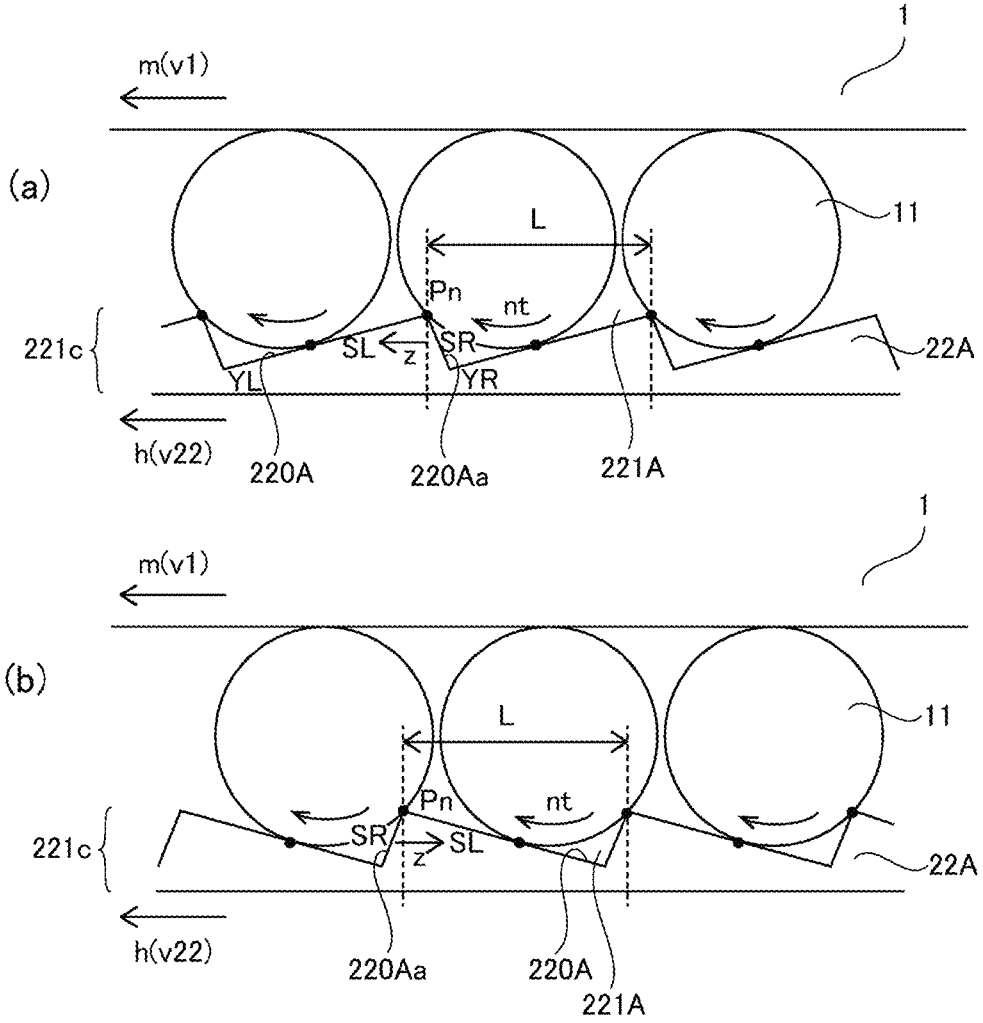
In FIG. 34, (a) and (b) are schematic views for illustrating a behavior of the toner on the recessed portions at a developing portion T in the case where a speed of a surface of the developing roller relative to a surface of a photosensitive drum is positive (for (a)) and a negative (for (b)).

In FIG. 34, (a) and (b) are schematic views for illustrating the developing portion T. In these figures, m (v1) means that the photosensitive drum surface moves in an arrow m direction at a speed v1, and h (v22) means that the developing roller surface moves in an arrow h direction at a speed v22. An arrow Z direction along which the toner 11 ascends the steep slope SR and descends the gentle slope SL via the top Pn of the recessed portion 221A on the developing roller 22A is taken as positive. At this time, as shown in (a) of FIG. 34, the case where a relative speed of the surface movement speed v22 (>v1) of the developing roller 22 to the surface movement speed v1 of the photosensitive drum 1 is set to be positive with respect to the arrow 2 direction is considered. In this case, by the speed difference and the electric field acting between the photosensitive drum 1 and the developing roller 22A, a torque acts on the toner 11 confined by the recessed portion 221A, so that the toner 11 rotates in an arrow nt direction and thus a toner confining force of the recessed portion 221A lowers. For this reason, the toner 11 on the developing roller 22A can be moved to an image portion Im (FIG. 5) on the photosensitive drum 1 without applying an excessive voltage to the developing roller 22A.

On the other hand, as shown in (b) of FIG. 34, the case where a relative speed of the surface movement speed v22 (>v1) of the developing roller 22 to the surface movement speed v1 of the photosensitive drum 1 is set to be negative with respect to the arrow 2 direction is considered. In this case, similarly, the torque acts on the toner 11 so that the toner 11 is to be rotated in the arrow nt direction, but by the influence of the steep slope SR, the toner confining force of the recessed portion 221A is not readily lowered, and thus there is a need to apply the excessive voltage to the developing roller 22A.

For this reason, at the developing portion T, when the arrow z direction along which the toner 11 ascends the steep slope SR and then descends the gentle slope SL via the top Pn is positive, the following condition is preferred. That is, the relative speed of the surface movement speed v22 of the developing roller 22A to the surface movement speed V1 of the photosensitive drum 1 may preferably be set to be positive with respect to the arrow z direction.

[Modified Embodiment of Third Embodiment]

Figure 35A:
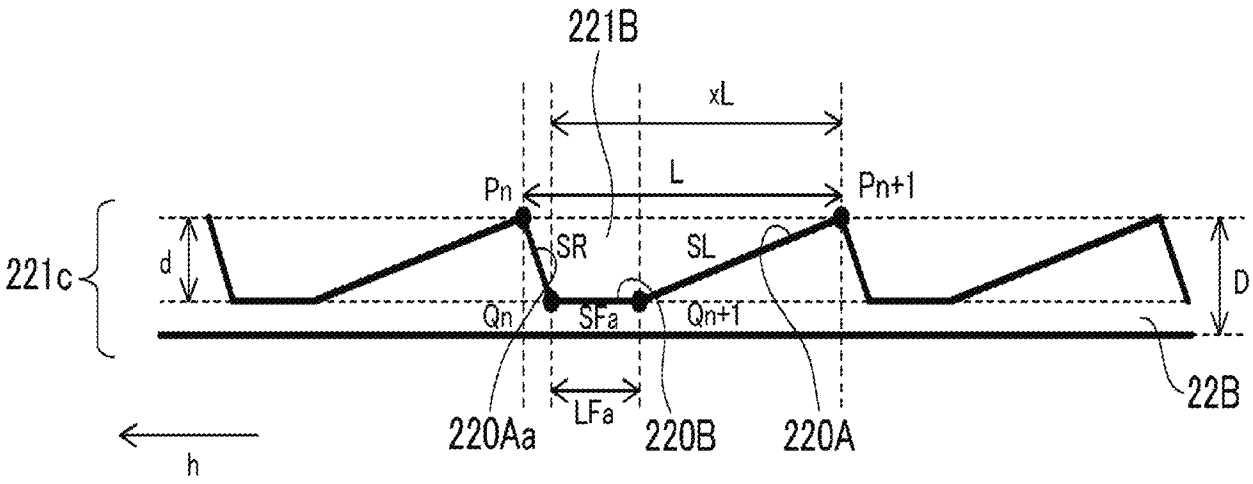
FIGS. 35A, 35B and 35C are schematic views showing three examples of recessed portion structures each as a modified embodiment of the third Embodiment.

A Modified embodiment of this embodiment will be described using FIG. 35. As shown in FIG. 35A, each of a plurality of recessed portions 221B includes, in addition to the steep slope SR and the gentle slope SL, a slope SFa different in inclination angle from those of the slopes SR and SL. That is, each recessed portion 221B includes the side surface 220Aa in the downstream side with respect to the rotational direction h of the developing roller 22 and the inclined bottom surface 220A inclined so that the depth becomes deep from the upstream side toward the downstream side with respect to the rotational direction h. The recessed portion 221B further includes a bottom surface 220B which is provided between the side surface 220Aa and the bottom surface 220A and which is different in inclination angle from those of the surfaces 220Aa and 220A (e.g., which is parallel to the rotational direction h). At this time, the toner confined by the recessed portion 221B may also be contacted to the bottom surface 220B.

Figure 35B:
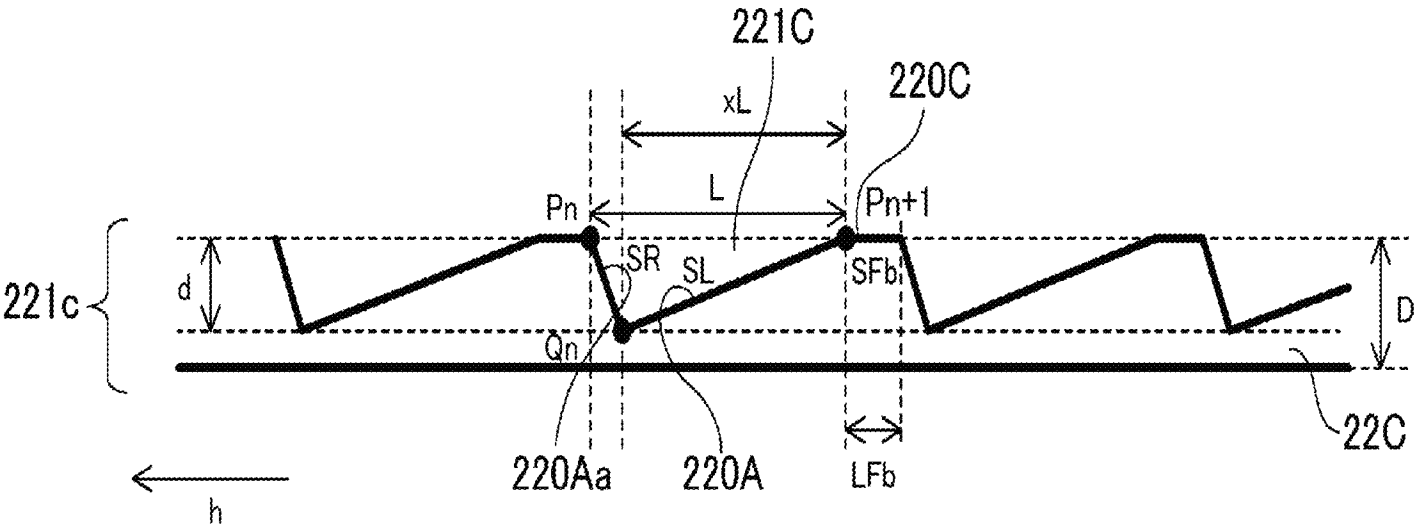
Figure 35C:
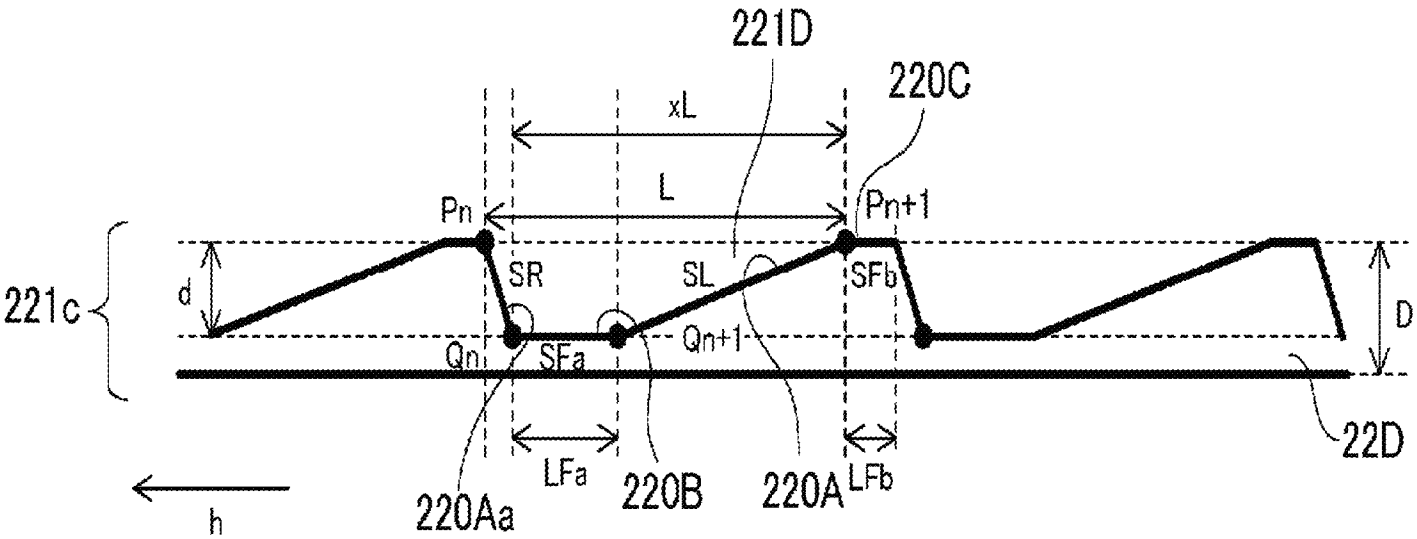

As shown in FIG. 35B, a plurality of recessed portions 221C formed on the surface of a developing roller 22C includes a flat space SFb between adjacent recessed portions. That is, between the side surface 220Aa of a certain recessed portion 221C and the bottom surface 220A of a recessed portion 221C positioned downstream of the certain recessed portion 221C with respect to the rotational direction h, a flat surface 220C is provided. Further, as shown in FIG. 35C, each of a plurality of recessed portions 221D formed on the surface of a developing roller 22D has a constitution having a combination of the constitutions shown in FIGS. 35A and 35B. Incidentally, the shape of the recessed portion is not limited to any shape if the shape is discriminated as the projection-recess structure in the present invention by the above-described discriminating method.

<Fourth Embodiment>

A Fourth Embodiment of the present invention will be described using FIG. 36. In the first to third Embodiments described above, the plurality of recessed portions are formed in the groove shape, but in this embodiment, a shape of plurality of recessed portion 221E formed on the surface of a developing roller 22E is a honeycomb structure. Other constitutions and actions are similar to those in at least any one of the first to third Embodiments described above.

A structure (projection-recess structure) of a plurality of recessed portions 221A formed on the surface of the developing roller 22A will be described using FIGS. 30 and 31. In the figures, the arrow h shows the rotational direction of the developing roller 22A having a rotational axis j. The plurality of recessed portions 221A are formed by a plurality of grooves which are arranged in parallel to the rotational axis j and which are arranged regularly with respect to the rotational direction h. Further, similarly as in first Embodiment. The developing roller 22A is formed with a member having a structure in which an elastic layer 221*b* is coated on a base layer 221*a* which is a cylindrical member.

Figure 36:
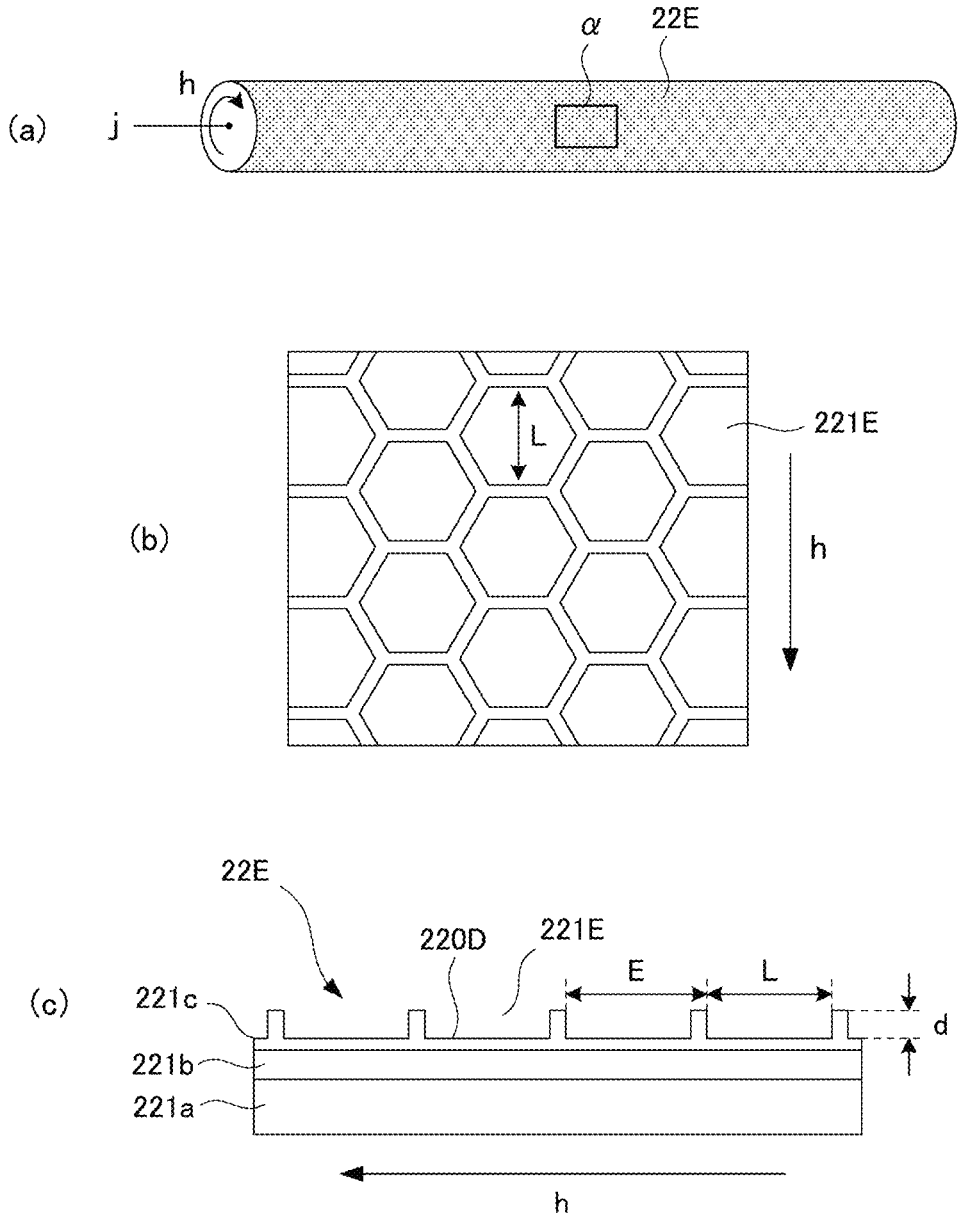
In FIG. 36, (a) is a schematic perspective view of a developing roller in a fourth Embodiment of the present invention, (b) is an enlarged schematic view of a portion α shown in (a) of FIG. 36, and (c) is a cross sectional view of a part of the developing roller.

In FIG. 36, the arrow h shows the rotational direction of the developing roller 22E having a rotational axis j. The developing roller 22E has the honeycomb structure at the surface thereof in which a plurality of isolated recessed portions 221E which are arranged in a closest packed state. Further, similarly as in the first Embodiment, the developing roller 221E is formed with a member having a structure in which an elastic layer 221*b* is coated on a base layer 221*a* which is a cylindrical member. The elastic layer 221*b* is covered with the coating layer 221*c* provided with the plurality of recessed portions 221E. Bottom surfaces 220D of the plurality of recessed portions 221E are formed similarly as in the first Embodiment so that depths thereof are substantially unchanged with respect to the rotational direction h.

In this embodiment, the recessed portion 221E is 1.5 μm in depth d, 8 μm in minimum opening width L and 9.5 μm in pattern width E. Incidentally, the bottom surface 220D may be inclined as in the third Embodiment and may also be shaped as shown in FIG. 35. The plurality of recessed portions may also have a random honeycomb structure with no periodicity, other than a uniform projection recess structure such as periodic grooves or the honeycomb structure as in this embodiment.

The plurality of recessed portions in the present invention are not limited to the structures described above, but may only be required to satisfy the following requirements. That is, when at least the toner having the average particle size is contactable with the inner surface of the recessed portion and the magnetic carrier having the average particle size is not contactable with the inner surface of the recessed portion and the recessed portion has the structure in which the top thereof is lower than the center of gravity of the toner contacting of the recessed portion inner surface. For example, also with respect to the bottom surface of the recessed portion, in addition to the flat surface and the inclined surface as described above, the bottom surface may also be a surface which is curved at least at a part thereof. Further, also with respect to the side surface of the recessed portion, the side surface may be surfaces which are perpendicular to, inclined relative to and curved relative to the bottom surface.

[Proportion (Percentage) of Recessed Portions]

Figure 37:
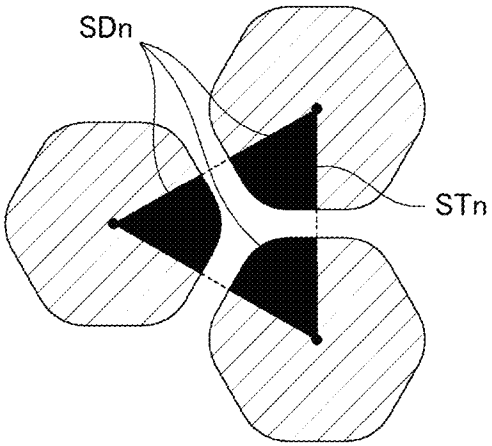
In FIG. 37, (a) and (b) are schematic views each showing a region discriminated as the recessed portion, in which (a) shows a groove structure on the roller surface, and (b) shows a honeycomb structure.
Figure 37:
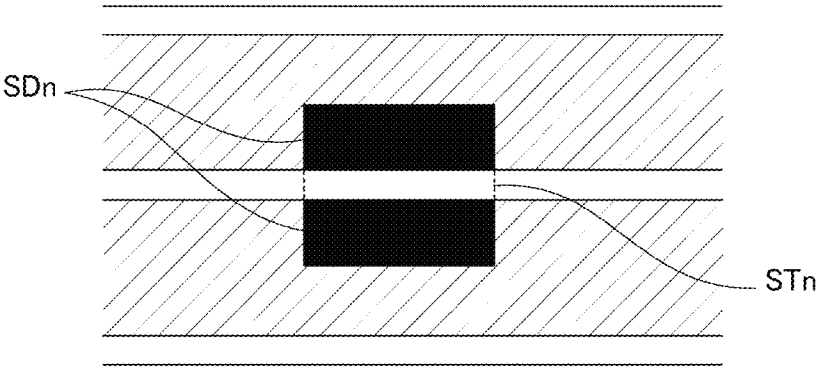

As described above, the projection recess structure of the developing roller surface in the present invention can have various shapes, but in order to uniformly coat the developing roller with the toner in a necessary amount, a proportion (percentage) and arrangement of the recessed portions at the developing roller surface may preferably satisfy conditions described below. In FIG. 37, (a) shows a part of the groove recessed portions as described in the first to third Embodiments, and (b) shows a part of the honeycomb structure as described in the fourth Embodiment. In FIG. 37, (a) and (b) are schematic views each showing a region (hatched portion) which is discriminated as the recessed portions in the present invention in accordance with the above described projection recess structure discriminating method for the associated projection recess structure. In each of the structures, an area of a minimum unit region (broken line region) is STn, and a total area of recessed portion (solid black portion) in the minimum unit region is SDn.

Here, the toner coated on the recessed portions is transferred onto the photosensitive drum for development of the electrostatic latent image and then is transferred and fixed on the recording material, but there is a need that at least a fixed toner image covers the recording material by adhesion between the toner particles with no influence of the gap between the recessed portions. Specifically, in the minimum unit region described above, a total volume of the toner coated on the recessed portions in the region is not less than a volume of a triangular prism determined by the product of the area STn of the minimum unit region and a limit toner layer thickness dt after the fixing, i.e., is represented by the following formula 7. In the formula 7, STn is the area (cm2) of the minimum unit region, SPn is the total area (cm2) of the recessed portions in the minimum unit region, pt is the true specific gravity (g/cm3) of the toner, dt is the limit toner layer thickness (cm) after the fixing, and κ is an amount per unit area (g/cm2) of the toner at the recessed portions.

$$\frac{S_{Dn} \cdot \kappa}{\rho_t} \geq S_{Tn} \cdot d_t \qquad \text{formula 7}$$

The toner amount per unit area κ at the recessed portions can be approximated by the following formula 8 since the toner is filled in the recessed portions in a substantially closest structure. In the formula 8, rt is the toner particle size (μm).

$$\kappa = \frac{\pi \cdot \rho_t \cdot r_t}{3\sqrt{3}} \qquad \text{formula 8}$$

The limit toner layer thickness dt after the fixing can be approximated from the formula 7 by the following formula 9 since the toner can be pressed to about ⅓ of the toner particle size rt under a general-purpose fixing condition.

$$\frac{S_{Dn}}{S_{Tn}} \geq 0.55 \qquad \text{formula 9}$$

When the formula 9 is satisfied, in a microscopic region (minimum unit region described above), the toner image can be fixed by the toner coated on the adjacent recessed portions. In other words, at least in a carrying region in which the developer is capable of being carried (toner carrying region) of the developing roller surface, when a proportion (percentage) of the recessed portions occupying the developing roller surface per unit area is 55% or more in average, the toner image can be fixed using the toner.

Here, the projection-recess structure in the present invention is the structure discriminated by the above-described projection-recess structure discriminating method as being that at least the toner having the average particle size is contactable with the recessed portion inner surface and the carrier having the average particle size is not contactable with the recessed portion inner surface and that the top of the recessed portion is lower than the center of gravity of the toner contacting the recessed portion. Naturally, it is possible to suppress the influence of the gap between the recessed portions by supplying the toner to the photosensitive drum in a large amount using the peripheral speed difference between the developing roller and the photosensitive drum. However, when the peripheral speed difference is excessively provided, adverse effects such as image defect which is called sweeping by which an image density at a trailing end portion of the image increases, and acceleration of a degree of deterioration undesirably generate. That is, even under a condition that the peripheral speed difference is small, by satisfying at least the formula 9, the influence of the gap between the recessed portions can be suppressed.

Figure 38:
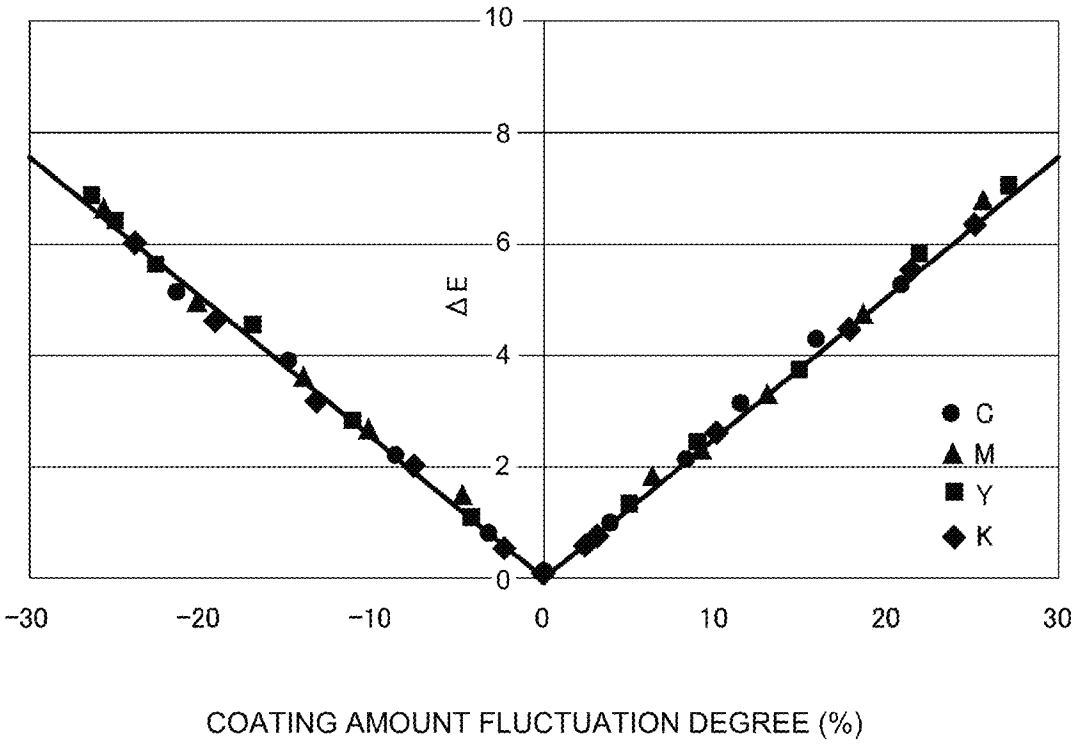
FIG. 38 is a graph showing a measurement result of a color difference ΔE relative to a coating fluctuation degree.

On the other hand, a fluctuation degree of the proportion (percentage) of the recessed portions occupying the developing roller surface per unit area in the toner carrying region of the developing roller may preferably be suppressed to within ±10%. FIG. 38 shows a relationship between a fluctuation degree of a developing roller coating amount and a color difference ΔE. Specifically, FIG. 38 is a graph showing the relationship between the coating amount fluctuation degree and the color difference ΔE on the basis of the time when each of the toners of cyan (C), magenta (M), yellow (Y) and black (K) is coated on the developing roller in an amount of 0.4 mg/cm$^2$. In FIG. 38, ΔE from a center coating amount. That is, a 10%-increase in coating amount means that ΔE fluctuates by 2.5 from the center, and a 10%-decrease in coating amount means that ΔE fluctuates by 2.5 from the center. Accordingly, in order to suppress the in-plane color difference ΔE to within 5, there is a need that a coating amount fluctuation degree Δ is within ±10% so as to suppress each of upper and lower limits to within 2.5. Further, in order to suppress the in-lane color difference ΔE to within 3, the coating amount fluctuation degree may preferably be made within ±6%. In order to further suppress the in-plane color difference, the coating amount fluctuation degree may preferably be made within ±5%, more preferably be made within ±3%. The coating amount M/S (g/cm$^2$) described above is represented by the following formula 10.

$$\frac{M}{S} = \frac{S_{Dn} \cdot \kappa}{S_{Tn}} \propto \frac{S_{Dn}}{S_{Tn}} \qquad \text{formula 10}$$

In order to suppress the coating amount fluctuation degree Δ to within ±10%, there is a need that a fluctuation in percentage of the recessed portions occupying the developing roller surface per unit area in the toner carrying region of the developing roller is suppressed to within ±10%. That is, at least in the toner carrying region of the developing roller, the percentage of the recessed portions occupying the developing roller surface per unit area is 55% or more in average. The fluctuation in percentage of the recessed portions occupying the developing roller surface per unit area is made within ±10%, preferably within ±6%, more preferably within ±5%, further preferably within ±3%. Specific measuring methods of the proportion (percentage) of the recessed portions and the fluctuation in proportion (percentage) will be described.

[Measuring Method of Proportion of Recessed Portions]

Figure 39:
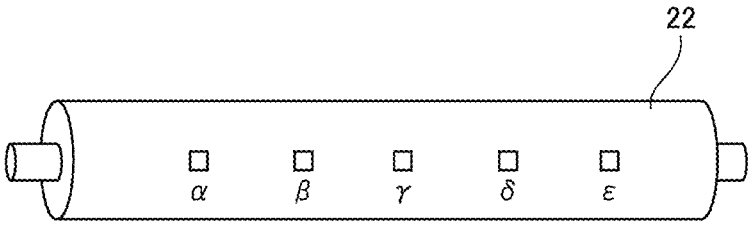
FIG. 39 is a schematic view of the developing roller shown for illustrating a measuring method of a percentage of the recessed portions.

The proportion of the recessed portions occupying the developing roller surface in the toner carrying degree of the developing roller is obtained in the following manner. FIG. 39 is a schematic view showing the developing roller 22. With respect to an axial direction, fine surface layer portions (α, β, γ, δ, ϵ) are cut and subjected to measurement of the recessed portions on the developing roller. The specific measuring method is similar to the projection-recess structure discriminating method described above. In this case, at each of measuring points (α, β, γ, δ, ϵ), a percentage of the recessed portions existing at a surface layer portion (78 μm×78 μm) having one side length which is 10 times the toner particle size is obtained, and an average of obtained percentages is used as the proportion of the recessed portions occupying the developing roller surface in the toner carrying region.

[Measuring Method of Fluctuation Degree in Proportion of Recessed Portions]

At each of the measuring points (α, β, γ, δ, ϵ) obtained in the measuring method of the proportion of the recessed portions, a minimum Mn and a maximum Mx of the recessed portion proportion (percentage) are obtained. A proportion (=(±Δ/Av)×100%) of a fluctuation Δ (=Mx−Av), from an average Av (=(Mn+Mx)/2), to the average Av is determined as a fluctuation degree.

<Fifth Embodiment>

A Fifth Embodiment of the present invention will be described using FIG. 40. In the above described embodiments, as shown in FIG. 2, the developing device 20 includes the developer collecting device 23 as the collecting means for collecting a part of the developer carried on the developing roller 22. The developer collecting device 23 includes the collecting magnet 232 disposed inside the collecting roller 231. On the other hand, in a developing device 20A in this embodiment, a developer collecting member 230 as the collecting means for collecting the part of the developer carried on the developing roller 22 is formed of a magnetic material or a metal material having a permeability higher in amount than a developing roller amount. Other constitutions and actions are basically similar to those for the developing device 20 shown in FIG. 2, and therefore a portion different from the constitution shown in FIG. 2 will be principally described.

The developing roller 22 is provided and supported rotatably in the rotational direction h, and the developing magnet 222 having the plurality of magnetic poles is fixedly disposed inside the developing roller 22. On the surface of the developing roller 22, the projection-recess structure having the constitution in any one of the above-described embodiments, and the developing roller 22 and the photosensitive drum 1 are disposed in non-contact with each other. The developing roller 22 may also be disposed in contact with the photosensitive drum 1. Inside the developing container 21, the feeding members 24*a*, 24*b* for feeding the developer to the developing roller 22 and the developer collecting member 230 for collecting the part of the developer on the developing roller 22 are disposed opposed to the developing roller 22 with gaps. The feeding members 24*a*, 24*b* feeds the developer in the developing container 21 to the supplying portion W where the developing roller 22 and the feeding member 24*b* oppose to each other while stirring the developer collected by the developer collecting member 230 described later. The developer is supplied to the developing roller 22 by the action of the magnetic force acting on the developer by the developing magnet 222 in the developing roller 22.

The developer collecting member 230 is formed in a plate-like shape with a magnet material or a metal material having a permeability higher in amount than a predetermined amount. The developing magnet 222 and the developer collecting member 230 form a magnetic field in cooperation, so that the developer is collected by the developer collecting member 230 by the action of the magnetic force. At the collecting portion U, the developer confined by the developer collecting member 230 finally drops in the developing container 21 by gravitation, and then is fed again to the supplying portion W by the feeding members 24*a*, 24*b*. The developer collecting member 230 is disposed at a position upstream of the developing portion T and downstream of the supplying portion W with respect to the rotational direction h of the developing roller 22. At an opening of the developing container 21, in order to suppress scattering of the toner to the outside of the developing container 21, a scattering preventing sheet 28 is provided.

In this embodiment, the developing roller 22 is formed with an Al (aluminum) bare tube, and on the bare tube, the projection recess structure is formed by the diamond edging method or the laser edging method, and then the negative (polarity) toner is coated. As another example, on a bare tube of Al or SUS, a metal layer of Ni P or the like having a low permeability by electroplating or the like, and then the projection recess structure may also be formed on the metal layer by subjecting the metal layer to the diamond edging method. Further, on the base material, a coating layer of thermoplastic resin material or a photo curable resin material is provided, and on the coating layer, the projection recess structure may also be formed by the nanoimprinting method. Further, in the case where the developing roller 22 and the photosensitive drum 1 are disposed in contact with each other, similarly as in the first Embodiment, the projection recess structure is formed on the elastic layer or the coating layer formed on the elastic layer. In the developing device 20A in this embodiment, the developer collecting member 230 has a simple constitution, and therefore the developing device 20A can be downsized.

<Sixth Embodiment>

A Sixth Embodiment of the present invention will be described using FIG. 41. In the above described embodiments, an example using the developing device as the developer carrying member for carrying the developer was described. On the other hand, in developing devices 20B, 20C in this embodiment, a developing belt 60 is used as the developer carrying member. The developing belt 60 is rotatably supported by the developing container 21 and an endless belt is provided at the surface thereof with a plurality of recessed portions 61. The plurality of recessed portions 61 and the projection recess structure described in any one of the above described embodiments.

Inside the developing belt 60, a developing magnet (permanent magnet) 62 which is fixedly disposed and which has a plurality of magnetic poles, a plurality of rollers 63 for stretching the developing belt 60, and an elastic roller 64 are disposed. Any one of the plurality of rollers 63 is a driving roller for being driven by an unshown motor, and this driving roller is rotated, so that the developing belt 60 is rotated in the arrow h direction. The developing belt 60 is disposed so that the surface thereof has openings facing the surface of the photosensitive drum 1. The elastic roller 64 is disposed so as to sandwich the developing belt 60 between itself and the photosensitive drum 1, so that the surface of the developing belt 60 is contacted to the photosensitive drum 1. Then, by applying a voltage to the elastic roller 64 by the voltage applying portion 26, the electrostatic latent image on the photosensitive drum 1 is developed with the toner carried on the developing belt 60.

Inside the developing container 21, the feeding members 24*a*, 24*b* for feeding the developer to the developing belt 60 are disposed opposed to the developing belt 60 with gaps. In a constitution shown in (a) of FIG. 41, a developer collecting device 23A for collecting a part of the developer on the developing belt 60 is disposed opposed to the developing belt 60 with a gap. On the other hand, in a constitution shown in (b) of FIG. 41, a developer collecting member 230 for collecting a part of the developer on the developing belt 60 is disposed opposed to the developing belt 60 with a gap. The feeding members 24*a*, 24*b* feeds the developer in the developing container 21 to the supplying portion W where the developing belt 60 and the feeding member 24*b* oppose to each other while stirring the developer collected by the developer collecting device 23A or the developer collecting member 230. The developer is supplied to the developing belt 60 by the action of the magnetic force acting on the developer by the developing magnet 62 inside the developing belt 60.

Figure 41:
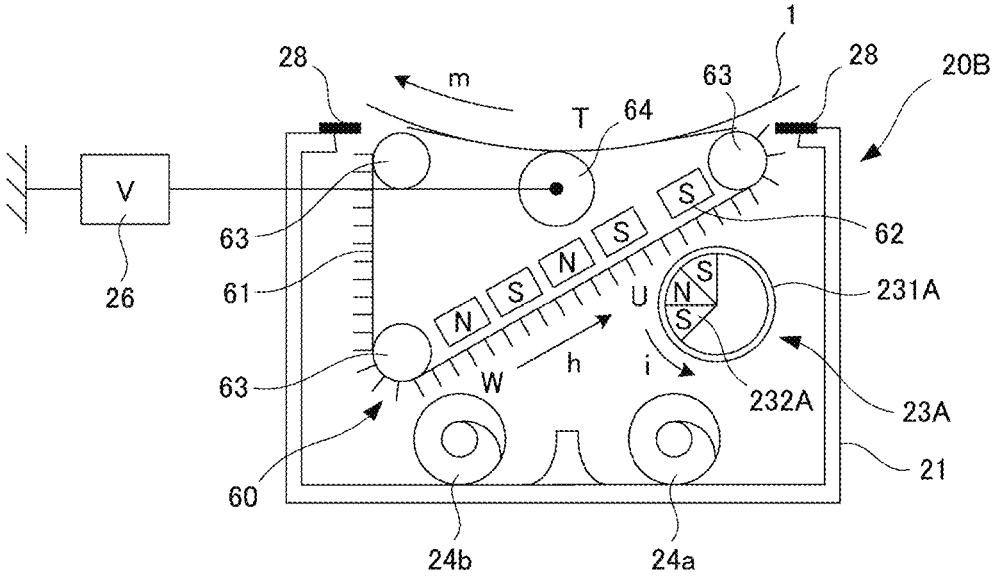
In FIG. 41, (a) and (b) are schematic illustrations showing two examples of a developing device according to a sixth Embodiment of the present invention.
Figure 41:
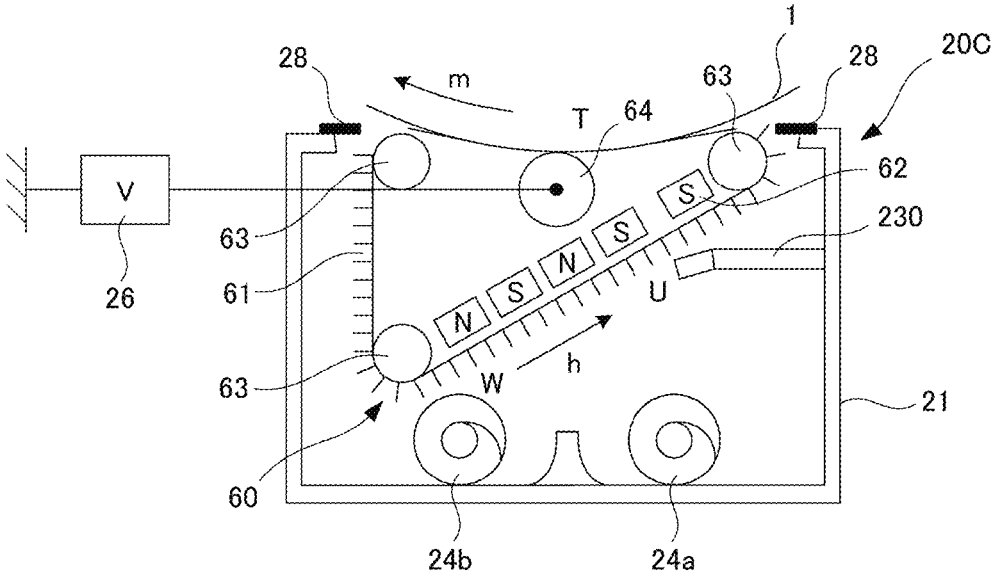

The developer collecting device 23A shown in (a) of FIG. 41 includes, similarly as in FIG. 2, a collecting roller 231A rotatably supported by the developing container 21 and a collecting magnet 232A having a plurality of magnetic poles fixedly disposed inside the collecting roller 231A. The collecting roller 231A is rotationally driven so as to be moved in an opposite direction at the collecting portion U where the collecting roller 231A opposes the developing belt 60. The developer collecting device 23A collects the part of the developer carried on the developing belt 60 by the action of the magnet force by formation of the magnetic field by the collecting magnet 232A in cooperation with the developing magnet 62 disposed inside the developing belt 60. Incidentally, the collecting magnet 232A in this embodiment is different in structure from that shown in FIG. 2, i.e., has no repelling (magnetic) pole for peeling off the developer collected by the collecting roller 231A. Accordingly, the developer confined by the collecting roller 231A at the collecting portion U is fed in the arrow i direction and is finally dropped in the developing container by gravitation at a portion where there is no magnetic pole, and then is fed again to the supplying portion W by the feeding members 24*a*, 24*b*.

Figure 40:
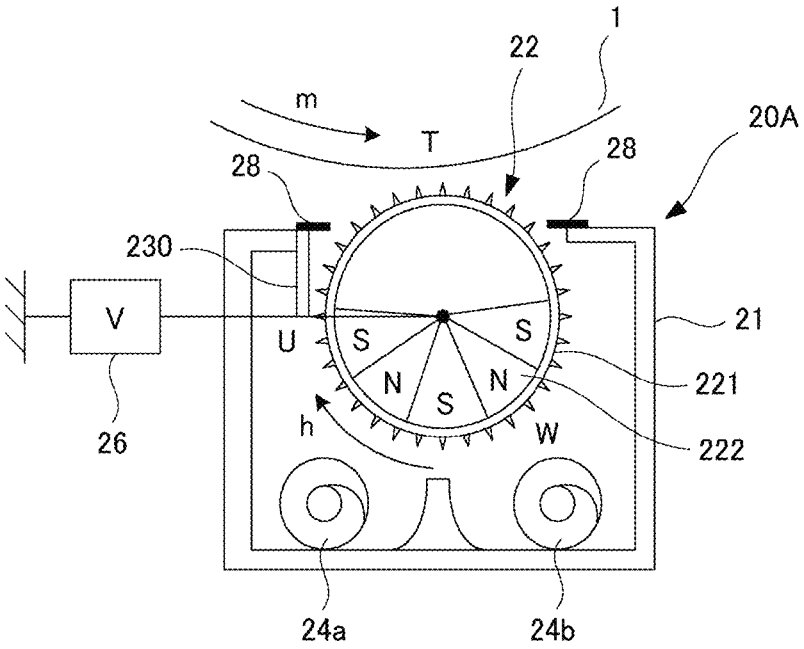
FIG. 40 is a schematic illustration of a developing device according to a fifth Embodiment of the present invention.

The developer collecting member 230 shown in (b) of FIG. 14, similarly as in the constitution shown in FIG. 40, is formed in a plate like shape with a magnet material or a metal material having a permeability higher in amount than a predetermined amount. The developing magnet 62 and the developer collecting member 230 form a magnetic field in cooperation, so that the developer is collected by the developer collecting member 230 by the action of the magnetic force. At the collecting portion U, the developer confined by the developer collecting member 230 finally drops in the developing container by gravitation, and then is fed again to the supplying portion W by the feeding members 24*a*, 24*b*. Incidentally, the metal material having the permeability higher in amount than the predetermined amount may only be required so that the magnetic field is formed between the developer collecting member 230 and the developing magnet 62 and thus the developer can be collected by the developer collecting member 230.

The developer collecting device 23A and the developer collecting member 230 is disposed at a position upstream of the developing portion T and downstream of the supplying portion W with respect to the rotational direction h of the developing belt 60. At an opening of the developing container 21, in order to suppress scattering of the toner to the outside of the developing container 21, a scattering preventing sheet 28 is provided.

In this embodiment, the developing roller 22 is formed with a nylon base material on which the projection-recess structure as described in the above embodiments is formed directly by the thermal nanoimprinting method, and then the negative(-polarity) toner is coated. As another example, the projection-recess structure may also be formed on the base material of polyimide or PMMA. Further, on the base material, a coating layer of thermoplastic resin material or a photo-curable resin material is provided, and on the coating layer, the projection-recess structure may also be formed by the nanoimprinting method. Further, on the base material of SUS or the like, the metal layer of Ni—P or the like having a low permeability by electroplating or the like, and then the projection-recess structure may also be formed on the metal layer by subjecting the metal layer to the diamond edging method.

Further, in order to prevent abrasion or to perform an insulating process, the projection-recess structure may also be coated with a high-hardness material or an insulating material. At this time, there is a need to form a thin coating layer to the extent that the projection-recess structure is sufficiently left. Further, in this embodiment, electric power is supplied to the elastic roller 64 disposed inside the developing belt 60, but may also be supplied directly to the base material for the developing belt 60. In place of the elastic roller 64, an elastic layer may also be formed on the developing belt 60. In the developing devices 20B, 20C in this embodiment, a feeding distance from the supplying portion W to the collecting portion U can be arbitrarily changed variably using the developing belt 60, and therefore the developing devices are not readily subjected to the constraint of a space and thus the feeding distance is easily ensured. Other constitutions and actions are similar to those in any one of the embodiments described above.

<Seventh Embodiment>

Figure 42:
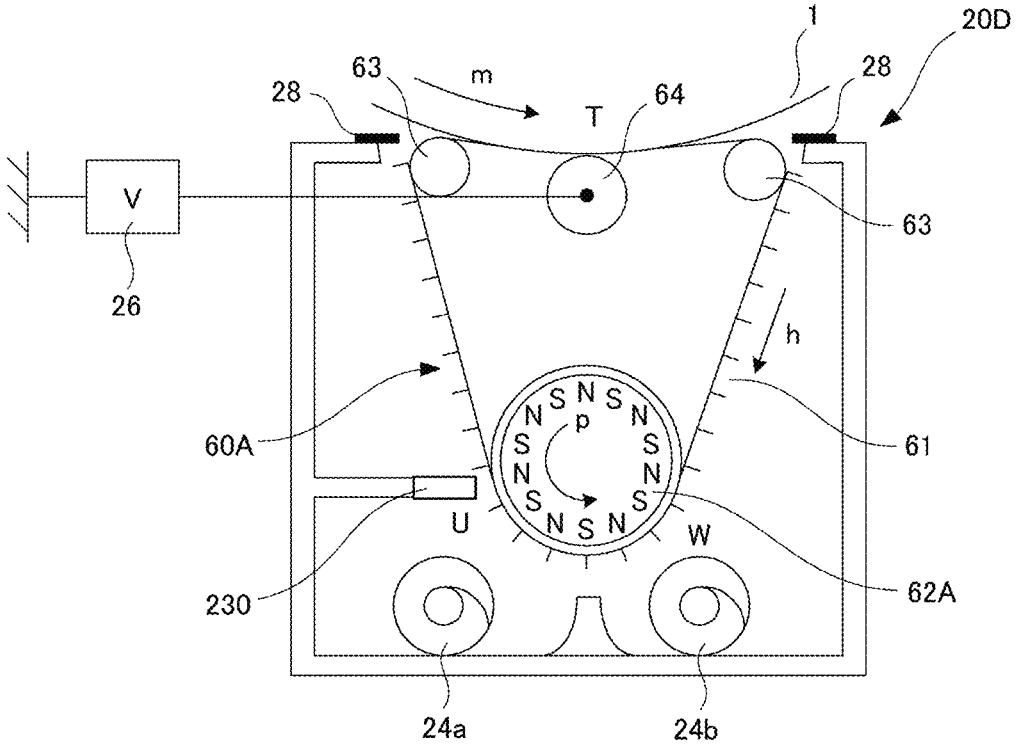
FIG. 42 is a schematic illustration of a developing device according to a seventh Embodiment of the present invention.

A Seventh Embodiment of the present invention will be described using FIG. 42. In the sixth Embodiment described above, the developing magnet 62 disposed inside the developing belt 60 was fixedly used. On the other hand, a developing device 20 in this embodiment includes a developing magnet 62A which is disposed inside a developing belt 60A and which is rotatable. Other constitutions and actions are similar to those in the constitution shown in (b) of FIG. 41, and therefore in the following, a portion different from the constitution in (b) of FIG. 41 will be principally described.

The developing belt 60A is rotatably supported by the developing container 21 and an endless belt provided at the surface thereof with a plurality of recessed portions 61. The plurality of recessed portions 61 and the projection-recess structure described in any one of the above-described embodiments. Inside the developing belt 60A, a developing magnet (permanent magnet) 62A which has a plurality of magnetic poles, a plurality of rollers 63 for stretching the developing belt 60A, and an elastic roller 64 are disposed.

The developing magnet 60A is formed in a cylindrical shape at a peripheral surface thereof and is rotationally driven in an arrow p direction by an unshown motor. The developing belt 60 is stretched by the developing magnet 62 and the plurality of rollers 63. Any one of the plurality of rollers 63 is a driving roller for being driven by an unshown motor, and this driving roller is rotated, so that the developing belt 60 is rotated in the arrow h direction. In this embodiment, the rotational direction of the developing belt 60A and the rotational direction of the developing magnet 62A are opposite to each other.

Inside the developing container 21, the feeding members 24*a*, 24*b* for feeding the developer to the developing belt 60A and the developer collecting member 230 for collecting a part of the developer on the developing belt 60A are disposed opposed to the developing belt 60A with gaps. The feeding members 24*a*, 24*b* feeds the developer in the developing container 21 to the supplying portion W where the developing belt 60A and the feeding member 24*b* oppose to each other while stirring the developer collected by the developer collecting member 230. The developer is supplied to the developing belt 60A by the action of the magnetic force acting on the developer by the developing magnet 62A inside the developing belt 60A. The developer collecting member 230 is formed of a metal material such as iron having a high permeability.

In this embodiment, the developer collecting member 230 is fixedly disposed similarly as in the constitution shown in (b) of FIG. 41, but may also be rotatably provided as in the case of a metal roller. Also in the case of this embodiment, similarly as in the constitution shown in (a) of FIG. 41, the developer collecting device 23A may be disposed.

In the developing device 20 in this embodiment, the magnetic chain is fed on the developing belt 60A while being rotated by rotation of the developing magnet 62A disposed inside the developing belt 60A. For this reason, the contact frequency between the developing belt 60A and the toner can be enhanced in a short feeding distance and in a short time. Further, by controlling the rotational speed of the developing magnet 60A, it is possible to suppress the fluctuation in coating amount of the toner on the developing belt 60A without having the influence on other constitutions.

According to the present invention, the replacement of the toner carried on the developer carrying member can be satisfactorily performed by the structure in which the plurality of recessed portions are provided on the surface of the developer carrying member.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-233149 filed on Nov. 17, 2014, which is hereby incorporated by reference herein in its entirety.

What is claimed is:

1. A developing device comprising:

a developing container for accommodating a developer containing non-magnetic toner particles and magnetic carrier particles;

a developer carrying member, provided opposite to an image bearing member for bearing an electrostatic latent image, for carrying and feeding the developer; and a collecting device for collecting a part of the developer carried on said developer carrying member, wherein said collecting device is provided upstream of a developing portion where said developer carrying member opposes the image bearing member with respect to a developer feeding direction of said developer carrying member, and said collecting device is disposed opposite to said developer carrying member, wherein a coverage which is a percentage of coating of surfaces of the carrier particles with the toner particles is 100% or more and 200% or less, wherein said developer carrying member has a plurality of recessed portions formed on a surface thereof so that at least the toner particles having an average particle size are contactable with inner surfaces of the recessed portions and the carrier particles having an average particle size are not contactable with the inner surfaces of the recessed portions, and wherein, a depth of each recessed portion is smaller than half a size of the toner particles having the average particle size.

2. A developing device according to claim 1, wherein each of minimum opening widths of the recessed portions with respect to the developer feeding direction of said developer carrying member is smaller than three times the average particle size of the toner particles.

3. A developing device according to claim 1, wherein in a charging series among the surface of said developer carrying member, the toner particles and the carrier particles, the carrier particles have a triboelectric chargeability between the surface of the developer carrying member and the toner particles.

4. A developing device according to claim 1, wherein in a carrying region where the developer on the surface of said developer carrying member is capable of being carried, a percentage of the recessed portions per unit area is 55% or more.

5. A developing device according to claim 1, wherein said developer carrying member is a belt rotatably supported by said developing container, and wherein said developer carrying member includes a developing magnet which is fixedly provided inside said belt and which has a plurality of magnetic poles, and includes a plurality of rollers for stretching the belt.

6. A developing device according to claim 1, wherein said developer carrying member is a belt rotatably supported by said developing container, and wherein said developer carrying member includes a developing magnet which is rotatably provided inside said belt and which has a plurality of magnetic poles, and includes a plurality of rollers for stretching the belt.

7. A developing device according to claim 1, wherein said collecting device includes a collecting roller and a collecting magnet which is fixedly provided inside said collecting roller and which has a plurality of magnetic poles.

8. A developing device comprising:

a developing container for accommodating a developer containing non-magnetic toner particles and magnetic carrier particles;

a feeding member for feeding the developer in said developing container;

a developer carrying member, provided opposite to an image bearing member for bearing an electrostatic latent image, for carrying and feeding the developer fed to a surface thereof by said feeding member; and a collecting device for collecting a part of the developer carried on said developer carrying member, wherein said collecting device is provided upstream of a developing portion where said developer carrying member opposes the image bearing member and downstream of a supplying portion where the developer fed by said feeding member is supplied to said developer carrying member with respect to a developer feeding direction of said developer carrying member, and said collecting device is disposed opposite to said developer carrying member, wherein a coverage which is a percentage of coating of surfaces of the carrier particles with the toner particles is 100% or more and 200% or less, wherein said developer carrying member has a plurality of recessed portions formed on a surface thereof so that at least the toner particles having an average particle size are contactable with inner surfaces of the recessed portions and the carrier particles having an average particle size are not contactable with the inner surfaces of the recessed portions, and wherein a depth of each of the recessed portions is smaller than half a size of the toner particles having the average particle size.

9. A developing device according to claim 8, wherein each of minimum opening widths of the recessed portions with respect to the developer feeding direction of said developer carrying member is smaller than three times the average particle size of the toner particles.

10. A developing device according to claim 8, wherein in a charging series among the surface of said developer carrying member, the toner particles and the carrier particles, the carrier particles have a triboelectric chargeability between the surface of the developer carrying member and the toner particles.

11. A developing device according to claim 8, wherein in a carrying region where the developer on the surface of said developer carrying member is capable of being carried, a percentage of the recessed portions per unit area is 55% or more.

12. A developing device according to claim 8, wherein said developer carrying member is a developing roller rotatably supported by said developing container, and wherein said developer carrying member includes a developing magnet which is fixedly provided inside said developing roller and which has a plurality of magnetic poles.

13. A developing device according to claim 8, wherein said developer carrying member is a belt rotatably supported by said developing container, and wherein said developer carrying member includes a developing magnet which is fixedly provided inside said belt and which has a plurality of magnetic poles, and includes a plurality of rollers for stretching the belt.

14. A developing device according to claim 8, wherein said developer carrying member is a belt rotatably supported by said developing container, and wherein said developer carrying member includes a collecting magnet which is rotatably provided inside said belt and which has a plurality of magnetic poles, and includes a plurality of rollers for stretching the belt.

* * * * *